US009785065B2

(12) United States Patent
Inoue et al.

(10) Patent No.: US 9,785,065 B2
(45) Date of Patent: Oct. 10, 2017

(54) TONER, AND METHOD FOR MANUFACTURING TONER

(71) Applicants: Ryota Inoue, Shizuoka (JP); Yoshihiro Moriya, Shizuoka (JP); Masahiko Ishikawa, Shizuoka (JP); Satoshi Takahashi, Kanagawa (JP); Tatsuki Yamaguchi, Shizuoka (JP); Satoshi Kojima, Shizuoka (JP)

(72) Inventors: Ryota Inoue, Shizuoka (JP); Yoshihiro Moriya, Shizuoka (JP); Masahiko Ishikawa, Shizuoka (JP); Satoshi Takahashi, Kanagawa (JP); Tatsuki Yamaguchi, Shizuoka (JP); Satoshi Kojima, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/305,057

(22) PCT Filed: Mar. 24, 2015

(86) PCT No.: PCT/JP2015/058814
§ 371 (c)(1),
(2) Date: Oct. 18, 2016

(87) PCT Pub. No.: WO2015/163073
PCT Pub. Date: Oct. 29, 2015

(65) Prior Publication Data

US 2017/0212437 A1 Jul. 27, 2017

(30) Foreign Application Priority Data

Apr. 23, 2014 (JP) ..... 2014-088880
Oct. 24, 2014 (JP) ..... 2014-216864

(51) Int. Cl.
*G03G 9/08* (2006.01)
*G03G 9/087* (2006.01)
(Continued)

(52) U.S. Cl.
CPC ..... *G03G 9/0819* (2013.01); *G03G 9/0804* (2013.01); *G03G 9/0825* (2013.01);
(Continued)

(58) Field of Classification Search
CPC ..... G03G 9/09378; G03G 9/0819; G03G 9/0825; G03G 9/08711
(Continued)

(56) References Cited

U.S. PATENT DOCUMENTS 7,449,273 B2 11/2008 Ohki et al.
7,459,255 B2 12/2008 Tanaka et al.
(Continued)

FOREIGN PATENT DOCUMENTS

JP 06-059494 3/1994
JP 2003-280474 10/2003
(Continued)

OTHER PUBLICATIONS

International Search Report dated Apr. 21, 2015 for counterpart International Patent Application No. PCT/JP2015/058814 filed Mar. 24, 2015.
(Continued)

*Primary Examiner* — Mark A Chapman
(74) *Attorney, Agent, or Firm* — Oblon, McClelland, Maier & Neustadt, L.L.P.

(57) ABSTRACT

A toner including: binder resin; and release agent, wherein the release agent is 1% to 8% by mass to the toner, as equivalent mass of endothermic amount of the release agent determined by DSC, wherein the release agent present in region from surface of the toner to 0.3 μm depth is 0.1% to
(Continued)

4% by mass, as determined by FTIR-ATR, and wherein, in TEM image of torn surface of the toner, WDa<WDb<WDc is satisfied, WDa denoting number-average-particle-diameter of the release agent in region Aa that is from surface of the toner to depth that is one-sixth of diameter d of the toner (⅙d), WDc denoting number-average-particle-diameter of the release agent in central region Ac that is circular region having center located at center of the toner and radius of ⅙d, WDb denoting number-average-particle-diameter of the release agent in region Ab that is other than region Aa or Ac.

10 Claims, 10 Drawing Sheets

(51) Int. Cl.
*G03G 9/09* (2006.01)
*G03G 9/107* (2006.01)
*G03G 9/113* (2006.01)
*G03G 9/093* (2006.01)

(52) U.S. Cl.
CPC ..... *G03G 9/0827* (2013.01); *G03G 9/08711* (2013.01); *G03G 9/08755* (2013.01); *G03G 9/08782* (2013.01); *G03G 9/0904* (2013.01); *G03G 9/09378* (2013.01); *G03G 9/1075* (2013.01); *G03G 9/1136* (2013.01)

(58) Field of Classification Search
USPC ..... 430/110.1, 108.1
See application file for complete search history.

(56) References Cited

U.S. PATENT DOCUMENTS

| | | | |
|---|---|---|---|
| 7,504,188 | B2 | 3/2009 | Yamada et al. |
| 7,531,279 | B2 | 5/2009 | Watanabe et al. |
| 8,877,420 | B2 | 11/2014 | Tanaka et al. |
| 2005/0026066 | A1 | 2/2005 | Tanaka et al. |
| 2005/0031980 | A1 | 2/2005 | Inoue et al. |
| 2005/0163544 | A1 | 7/2005 | Ito |
| 2005/0164112 | A1 | 7/2005 | Ohki et al. |
| 2006/0057488 | A1 | 3/2006 | Inoue et al. |
| 2006/0068312 | A1 | 3/2006 | Yamashita et al. |
| 2006/0099529 | A1 | 5/2006 | Tanaka et al. |
| 2006/0160011 | A1 | 7/2006 | Inoue et al. |
| 2006/0210903 | A1 | 9/2006 | Ohki et al. |
| 2007/0059626 | A1 | 3/2007 | Inoue et al. |
| 2007/0141506 | A1 | 6/2007 | Inoue et al. |
| 2007/0218383 | A1 | 9/2007 | Seshita et al. |
| 2008/0070144 | A1 | 3/2008 | Nagatomo et al. |
| 2008/0226998 | A1 | 9/2008 | Ishii et al. |
| 2008/0227002 | A1 | 9/2008 | Moriya et al. |
| 2009/0003885 | A1 | 1/2009 | Sabu et al. |
| 2009/0117480 | A1 | 5/2009 | Yamada et al. |
| 2009/0142094 | A1 | 6/2009 | Sawada et al. |
| 2009/0162770 | A1 | 6/2009 | Sako et al. |
| 2010/0003613 | A1 | 1/2010 | Honda et al. |
| 2010/0104965 | A1 | 4/2010 | Inoue et al. |
| 2010/0119255 | A1 | 5/2010 | Seshita et al. |
| 2010/0129748 | A1 | 5/2010 | Inoue et al. |
| 2010/0183967 | A1 | 7/2010 | Sabu et al. |
| 2010/0216068 | A1 | 8/2010 | Kotsugai et al. |
| 2010/0330489 | A1 | 12/2010 | Inoue et al. |
| 2011/0065036 | A1 | 3/2011 | Inoue et al. |
| 2011/0104608 | A1 | 5/2011 | Nakajima et al. |
| 2011/0124838 | A1 | 5/2011 | Kotsugai et al. |
| 2011/0223530 | A1 | 9/2011 | Inoue et al. |
| 2011/0281213 | A1 | 11/2011 | Sakashita et al. |
| 2012/0264049 | A1 | 10/2012 | Masuda et al. |
| 2012/0270147 | A1 | 10/2012 | Katoh et al. |
| 2012/0295188 | A1 | 11/2012 | Nakajima et al. |
| 2013/0045442 | A1 | 2/2013 | Moriya et al. |
| 2013/0065172 | A1 | 3/2013 | Moriya et al. |
| 2013/0095422 | A1 | 4/2013 | Yamamoto et al. |
| 2015/0104739 | A1 | 4/2015 | Nagatomo et al. |
| 2015/0108671 | A1 | 4/2015 | Norikane et al. |
| 2015/0234303 | A1 | 8/2015 | Moriya et al. |
| 2015/0241804 | A1 | 8/2015 | Takahashi et al. |
| 2015/0253686 | A1 | 9/2015 | Miyakoshi et al. |
| 2015/0261111 | A1 | 9/2015 | Inoue et al. |

FOREIGN PATENT DOCUMENTS

| | | |
|---|---|---|
| JP | 2005-091958 | 4/2005 |
| JP | 2007-192952 | 8/2007 |
| JP | 2009-134061 | 6/2009 |
| JP | 2009-294492 | 12/2009 |
| JP | 2010-060896 | 3/2010 |
| JP | 2012-185219 | 9/2012 |
| JP | 2013-37075 A | 2/2013 |
| JP | 2013-218163 A | 10/2013 |

OTHER PUBLICATIONS

Extended European Search Report dated Mar. 13, 2017 in Patent Application No. 15782409.5.

TONER, AND METHOD FOR MANUFACTURING TONER

TECHNICAL FIELD

The present invention relates to a toner used for developing an electrostatic image in electrophotography, electrostatic recording, or electrostatic printing, and a method for producing the toner.

BACKGROUND ART

Toners used in electrophotography, electrostatic recording, or electrostatic printing are, in a developing step, deposited temporarily on image bearers (e.g., electrostatic latent image bearers) on which electrostatic charge images have been formed. Next, in a transfer step, the thus-deposited toners are transferred from the electrostatic latent image bearers onto transfer media (e.g., transfer paper). Then, the thus-transferred toners are fixed on the media in a fixing step. A commonly used method for fixing the toners is a method in which the toners are heat-melted by being brought into contact with a heated roll or a heated belt to fix the toners. This is because this method is excellent in thermal efficiency. However, the method is problematic in that offset is likely to occur. The offset is a phenomenon in which melted toners are melt-adhered to the heated roll or the heated belt.

In order to prevent the offset, release agents (e.g., waxes) may be added to toners themselves. In the above method, the release agents rapidly melt when the toners pass through the heated roll member or the heated belt member, to be exposed on surfaces of toner particles. Thus, the release agents prevent the toners from melt-adhering to fixing members. The release agents have effects on offset at low fixing temperatures (cold offset) and offset at high fixing temperatures (hot offset).

In the case where the release agents are disposed adjacent to surfaces of toner particles in order to facilitate exposure of the release agents from the toner particles, the offset is prevented but other problems are caused. For example, the toner particles are likely to melt-adhere to a carrier or a photoconductor via the release agents during stirring in a developing device. As a result, the toner particles adhere to the carrier or the photoconductor in a crushed form to increase the possibility of decreasing a charging amount of the toner particles. Therefore, it is necessary that the release agents are protected by existing inside the toner particles during stirring or storage, but are exposed on the surface effectively in a short time while the toner particles pass through the fixing member in the fixing step, to exert releasability from the fixing member.

In order to address the above problem, many proposals have been reported with regard to waxes which serve as the release agent and have specified dispersed particle diameters (see, Patent documents 1 and 2). The waxes are effective in maintaining toner granulation performance and preventing the offset at the same time. This effect results from the specified dispersed particle diameter.

However, when a wax is introduced into a toner in a dispersed state, the wax particle diameter typically must be smaller than the toner particle diameter. Therefore, it is very difficult to hold the wax having such a small diameter inside the toner without exposing adjacent to the surface of the toner.

The release agent can more effectively exert offset-resistance in a relatively large aggregate form than in a localized form as small domains in the toner. However, when an unnecessarily large amount of the release agent is added in order to enlarge the domains, toner strength as a whole is weakened to increase the possibility of being crushed. As a result, the toner is more likely to have a decreased charging amount or to deteriorate in background fog.

In particular, when a toner including a release agent is used for non-magnetic one-component developing, an excessive load is applied to the toner by a blade configured to regulate a toner-layer thickness, while the toner passes through the blade. Thus, the toner is crushed to adhere to the blade. This has been found to significantly deteriorate image quality. Therefore, the toner needs to have higher durability than a toner used for two-component developing.

The toner described in the Patent document 2 includes a release agent having a specified aspect ratio and a specified size. The toner is improved in low-temperature fixing ability, background fog, and chargeability. However, the toner is unsatisfactory in terms of exhibiting excellent offset resistance and achieving excellent chargeability and excellent durability through improvement of toner-particle strength.

There has been proposed a toner which is produced by discharging a toner composition liquid from discharging holes to make the toner composition liquid into the liquid droplets. The thus-produced toner is excellent in hot-offset resistance and background fog (see Patent document 3).

However, this technique also has a room for improvement in terms of exhibiting excellent offset resistance, and achieving excellent chargeability and excellent durability through improvement of toner-particle strength.

CITATION LIST

Patent Document

Patent document 1: Japanese Unexamined Patent Application Publication No. 2009-134061
Patent document 2: Japanese Patent No. 5146665
Patent document 3: Japanese Unexamined Patent Application Publication No. 2012-185219

SUMMARY OF THE INVENTION

Technical Problem

The present invention can solve the above existing problems and achieve the following object. That is, the present invention has an object to provide a toner capable of exhibiting well-balanced good results with regard to all of toner chargeability, toner durability, and offset resistance through improvement and maintenance of toner-particle strength and exertion of excellent release effect.

Solution to Problem

Means for solving the above problem is as follows. That is, a toner of the present invention includes at least a binder resin and a release agent.

An amount of the release agent contained in the toner is from 1% by mass through 8% by mass relative to an amount of the toner, as expressed as an equivalent mass of an endothermic amount of the release agent determined by differential scanning calorimetry (DSC).

An amount of the release agent that is present in a region from a surface of the toner to a depth of 0.3 μm is from 0.1% by mass through 4% by mass, as determined by attenuated total reflection Fourier transform infrared spectroscopy (FTIR-ATR).

In an image of a torn surface of the toner, the image being taken by a transmission electron microscope (TEM), a relationship below is satisfied:

$$WDa < WDb < WDc$$

where

WDa denotes a number average particle diameter of the release agent present in a region Aa that is a region from a surface of the toner to a depth that is one-sixth of a diameter d of the toner (⅙d);

WDc denotes a number average particle diameter of the release agent present in a central region Ac that is a circular region having a center located at a center of the toner and a radius of ⅙d; and WDb denotes a number average particle diameter of the release agent present in a region Ab that is a region other than the Aa or the Ac.

Effects of the Invention

The present invention can solve the above existing problems and achieve the above object. That is, the present invention can provide a toner capable of exhibiting well-balanced good results with regard to all of toner chargeability, toner durability, and offset resistance through improvement and maintenance of toner-particle strength and exertion of excellent release effect.

Figure 1:
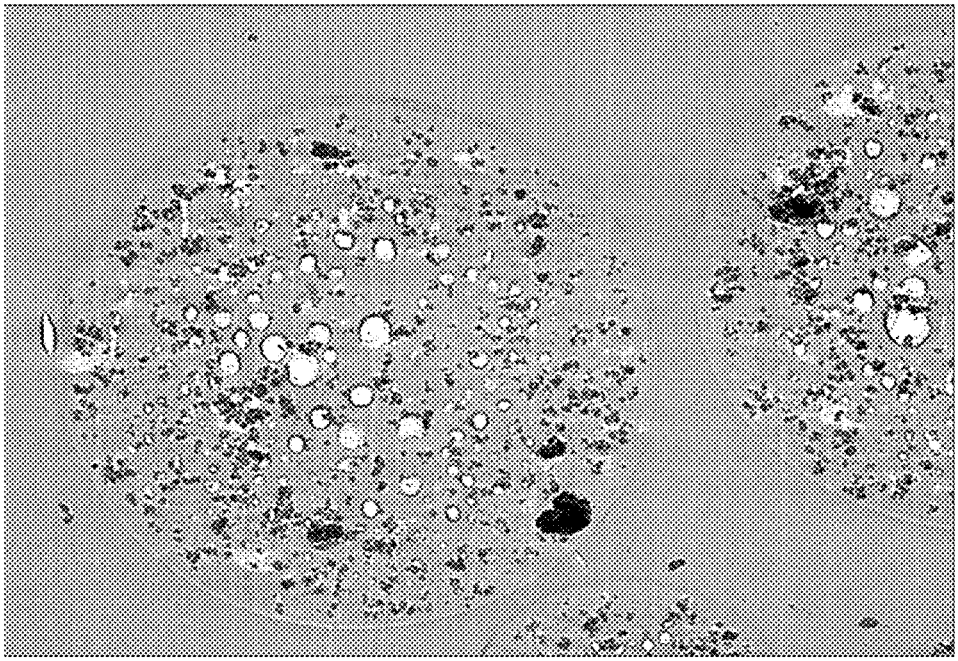
FIG. 1 is a cross-sectional view illustrating one exemplary toner of the present invention.

MODE FOR CARRYING OUT THE INVENTION (Toner)

A toner of the present invention includes at least a binder resin and a release agent; and, if necessary, further includes other components such as a colorant and a charging control agent.

An amount of the release agent contained in the toner is from 1% by mass through 8% by mass relative to an amount of the toner, as expressed as an equivalent mass of an endothermic amount of the release agent determined by differential scanning calorimetry (DSC).

An amount of the release agent that is present in a region from a surface of the toner to a depth of 0.3 μm is from 0.1% by mass through 4% by mass, as determined by attenuated total reflection Fourier transform infrared spectroscopy (FTIR-ATR).

In an image of a torn surface of the toner, the image being taken by a transmission electron microscope (TEM), a relationship below is satisfied:

$$WDa < WDb < WDc$$

where

WDa denotes a number average particle diameter of the release agent present in a region Aa that is a region from a surface of the toner to a depth that is one-sixth of a diameter d of the toner (⅙d);

WDc denotes a number average particle diameter of the release agent present in a central region Ac that is a circular region having a center located at a center of the toner and a radius of ⅙d; and WDb denotes a number average particle diameter of the release agent present in a region Ab that is a region other than the Aa or the Ac.

The toner of the present invention satisfies the above-described requirement, that is, includes a release agent having a desired size in a desired region in the toner. Therefore, the toner of the present invention allows the release agent to effectively migrate to a surface of the toner during fixing of the toner without impairing toner strength. As a result, the toner is excellent in offset resistance, charging stability, and background fog. Moreover, the toner can form high-definition, high-quality images for a long period of time.

<Binder Resin>

The binder resin is not particularly limited and may be appropriately selected from those known in the art depending on the intended purpose, so long as the binder resin can dissolve in an organic solvent to be used in the below-described production method. Examples of the binder resin include homopolymers of vinyl monomers such as styrene monomers, acrylic monomers, and methacrylic monomers; copolymers of two or more kinds of the above-described monomers; polyester resins; polyol resins; phenolic resins; silicone resins; polyurethane resins; polyamide resins; furan resins; epoxy resins; xylene resins; terpene resins; coumarone-indene resins; polycarbonate resins; and petroleum-based resins. These may be used alone or in combination.

—Vinyl Monomer—

The styrene monomers are not particularly limited and may be appropriately selected depending on the intended purpose. Examples of the styrene monomers include styrenes such as styrene, o-methylstyrene, m-methylstyrene, p-methylstyrene, p-phenylstyrene, p-ethylstyrene, 2,4-dimethylstyrene, p-n-amylstyrene, p-tert-butylstyrene, p-n-hexylstyrene, p-n-octylstyrene, p-n-nonylstyrene, p-n-decylstyrene, p-n-dodecylstyrene, p-methoxystyrene, p-chlorostyrene, 3,4-dichlorostyrene, m-nitrostyrene, o-nitrostyrene, and p-nitrostyrene; and derivatives of the above-described styrenes.

The acrylic monomers are not particularly limited and may be appropriately selected depending on the intended purpose. Examples of the acrylic monomers include acrylic acid and acrylic esters.

The acrylic esters are not particularly limited and may be appropriately selected depending on the intended purpose. Examples of the acrylic esters include methyl acrylate, ethyl acrylate, propyl acrylate, n-butyl acrylate, isobutyl acrylate, n-octyl acrylate, n-dodecyl acrylate, 2-ethylhexyl acrylate, stearyl acrylate, 2-chloroethyl acrylate, and phenyl acrylate.

The methacrylic monomers are not particularly limited and may be appropriately selected depending on the intended purpose. Examples of the methacrylic monomers include methacrylic acid and methacrylic esters.

The methacrylic esters are not particularly limited and may be appropriately selected depending on the intended purpose. Examples of the methacrylic esters include methyl methacrylate, ethyl methacrylate, propyl methacrylate, n-butyl methacrylate, isobutyl methacrylate, n-octyl methacrylate, n-dodecyl methacrylate, 2-ethylhexyl methacrylate, stearyl methacrylate, phenyl methacrylate, dimethylaminoethyl methacrylate, and diethylaminoethyl methacrylate.

Other monomers which can be formed into the homopolymers or the copolymers of the vinyl monomers are not particularly limited and may be appropriately selected depending on the intended purpose. Examples of the other monomers include (1) to (18) below:

(1) monoolefins such as ethylene, propylene, butylene, and isobutylene;

(2) polyenes such as butadiene and isoprene;

(3) vinyl halides such as vinyl chloride, vinylidene chloride, vinyl bromide, and vinyl fluoride;

(4) vinyl esters such as vinyl acetate, vinyl propionate, and vinyl benzoate;

(5) vinyl ethers such as methyl vinyl ether, ethyl vinyl ether, and isobutyl vinyl ether;

(6) vinyl ketones such as methyl vinyl ketone, hexyl vinyl ketone, and methyl isopropenyl ketone;

(7) N-vinyl compounds such as N-vinylpyrrole, N-vinylcarbazole, N-vinylindole, and N-vinylpyrrolidone;

(8) vinylnaphthalenes;

(9) derivatives of acrylic acid or methacrylic acid such as acrylonitrile, methacrylonitrile, and acrylamide;

(10) unsaturated dibasic acids such as maleic acid, citraconic acid, itaconic acid, alkenylsuccinic acid, fumaric acid, and mesaconic acid;

(11) unsaturated dibasic acid anhydrides such as maleic anhydride, citraconic anhydride, itaconic anhydride, and alkenylsuccinic anhydride;

(12) unsaturated dibasic acid monoesters such as maleic acid monomethyl ester, maleic acid monoethyl ester, maleic acid monobutyl ester, citraconic acid monomethyl ester, citraconic acid monoethyl ester, citraconic acid monobutyl ester, itaconic acid monomethyl ester, alkenylsuccinic acid monomethyl ester, fumaric acid monomethyl ester, and mesaconic acid monomethyl ester;

(13) unsaturated dibasic acid esters such as dimethyl maleate and dimethyl fumarate;

(14) α,β-unsaturated acids such as crotonic acid and cinnamic acid;

(15) α,β-unsaturated acid anhydrides such as crotonic anhydride and cinnamic anhydride;

(16) monomers including carboxyl groups such as anhydrides of the above-described α,β-unsaturated acids with lower fatty acids, alkenyl malonate, alkenyl glutarate, alkenyl adipate, and anhydrides and monoesters of the above-described acids;

(17) acrylic hydroxyalkyl esters or methacrylic hydroxyalkyl esters such as 2-hydroxyethyl acrylate, 2-hydroxyethyl methacrylate, and 2-hydroxypropyl methacrylate; and

(18) monomers including hydroxy groups such as 4-(1-hydroxy-1-methylbutyl)styrene and 4-(1-hydroxy-1-methylhexyl)styrene.

Among them, combinations of monomers to be formed into styrene-based copolymers or styrene-acrylic copolymers are preferable.

The copolymers serving as the binder resin may include a cross-linking structure cross-linked by a cross-linking agent including two or more vinyl groups.

The cross-linking agent is not particularly limited and may be appropriately selected depending on the intended purpose. Examples of the cross-linking agent include aromatic divinyl compounds such as divinylbenzene and divinylnaphthalene; diacrylate compounds linked with alkyl chains, such as ethylene glycol diacrylate, 1,3-butyleneglycol diacrylate, 1,4-butanediol diacrylate, 1,5-pentanediol diacrylate, 1,6-hexanediol diacrylate, and neopentyl glycol diacrylate, and compounds in which acrylate moieties of the above-described diacrylate compounds are substituted with methacrylates; and diacrylate compounds linked with alkyl chains including ether bonds such as diethylene glycol diacrylate, triethylene glycol diacrylate, tetraethylene glycol diacrylate, polyethylene glycol #400 diacrylate, polyethylene glycol #600 diacrylate, dipropylene glycol diacrylate, and compounds in which acrylate moieties of the above-described diacrylate compounds are substituted with methacrylates.

Other examples include diacrylate compounds linked with chains including aromatic groups and ether bonds and dimethacrylate compounds linked with chains including aromatic groups and ether bonds.

Additional examples of the cross-linking agent include polyester-based diacrylates such as MANDA (available from Nippon Kayaku Co., Ltd.).

Further examples of the cross-linking agent include multifunctional cross-linking agents such as pentaerythritol triacrylate, trimethylolethane triacrylate, trimethylolpropane triacrylate, tetramethylolmethane tetraacrylate, oligoester acrylate, compounds in which acrylate moieties of the above-described compounds are substituted with methacrylates, triallyl cyanurate, and triallyl trimellitate.

Among these cross-linking agents, aromatic divinyl compounds (particularly, divinylbenzene) and diacrylate compounds linked with chains including an aromatic group and one ether bond are preferable from the viewpoint of offset resistance and fixability in resins for toners.

When the binder resin is a styrene/acrylic-based resin, the binder resin preferably has at least one peak in a molecular weight range of from 3,000 through 50,000 (in terms of a number average molecular weight) in a molecular weight distribution by GPC of tetrahydrofuran (THF) soluble matter in the resin component.

—Polyester Resin—

Monomers constituting the polyester resin (polyester-based polymer) are not particularly limited and may be appropriately selected depending on the intended purpose, but preferably include an alcohol component and an acid component.

Examples of the alcohol component are described below.

Examples of bivalent alcohol include ethylene glycol, propylene glycol, 1,3-butanediol, 1,4-butanediol, 2,3-butanediol, diethylene glycol, triethylene glycol, 1,5-pentanediol, 1,6-hexanediol, neopentyl glycol, 2-ethyl-1,3-hexanediol, hydrogenated bisphenol A, and diols obtained by polymerizing bisphenol A with cyclic ethers such as ethylene oxide and propylene oxide.

Use of trivalent or higher polyvalent alcohols and trivalent or higher acids in combination allows the polyester resin to undergo cross-linking. However, the trivalent or higher polyvalent alcohols or the trivalent or higher acids need to be used in an amount in which the resin is not prevented from dissolving in an organic solvent.

Examples of the trivalent or higher polyvalent alcohol include sorbitol, 1,2,3,6-hexanetetrol, 1,4-sorbitan, pentaerythritol (e.g., dipentaerythritol and tripentaerythritol), 1,2,4-butanetriol, 1,2,5-pentatriol, glycerol, 2-methylpropanetriol, 2-methyl-1,2,4-butanetriol, trimethylolethane, trimethylolpropane, and 1,3,5-trihydroxybenzene.

Examples of acid components constituting the polyester-based polymer include benzenedicarboxylic acids such as phthalic acid, isophthalic acid, and terephthalic acid, or anhydrides of the above-described benzenedicarboxylic acids; alkyldicarboxylic acids such as succinic acid, adipic acid, sebacic acid, and azelaic acid, or anhydrides of the above-described alkyldicarboxylic acids; unsaturated dibasic acids such as maleic acid, citraconic acid, itaconic acid, alkenylsuccinic acid, fumaric acid, and mesaconic acid; and unsaturated dibasic acid anhydrides such as maleic anhydride, citraconic anhydride, itaconic anhydride, and alkenylsuccinic anhydride.

Examples of trivalent or higher polyvalent carboxylic acid components include trimellitic acid, pyromellitic acid, 1,2,4-benzenetricarboxylic acid, 1,2,5-benzenetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxy-2-methyl-2-methylenecarboxypropane, tetra(methylene carboxy)methane, 1,2,7,8-octanetetracarboxylic acid, and empol trimer acid, or anhydrides and partial lower alkyl esters of the above-described carboxylic acids.

In the present invention, an aspect in which the binder resin includes a polyester resin as a main component is preferable. In particular, when the below-described release agent is an ester wax including an aliphatic ester as a main component, an aspect in which the binder resin is a polyester resin and is used in combination with the ester wax is more preferable.

When the binder resin is the polyester-based resin, the binder resin preferably has at least one peak in a molecular weight range of from 3,000 through 50,000 in a molecular weight distribution of THF soluble matter in the resin component from the viewpoints of fixability and offset resistance of the resultant toner. Meanwhile, the binder resin in which from 70% through 100% of the THF soluble matter has a molecular weight of 100,000 or less is preferable from the viewpoint of dischargeability. Moreover, the binder resin more preferably has at least one peak in a molecular weight range of from 5,000 through 20,000.

In the present invention, a molecular weight distribution of the binder resin is measured by gel permeation chromatography (GPC) using THF as a solvent.

When the binder resin is the polyester resin, an acid value of the polyester resin is not particularly limited and may be appropriately selected depending on the intended purpose, but is preferably from 0.1 mgKOH/g through 100 mgKOH/g, more preferably from 0.1 mgKOH/g through 70 mgKOH/g, further preferably from 0.1 mgKOH/g through 50 mgKOH/g.

In the present invention, the acid value of the binder resin component in a toner composition is measured basically according to JIS K-0070 in the following manner.

(1) Additives other than the binder resin (polymer component) are previously removed from a sample. Alternatively, components of the sample other than the binder resin and the cross-linked binder resin are previously measured for acid values and amounts. A pulverized product of the sample is precisely weighed in an amount of from 0.5 g through 2.0 g.

A weight of the polymer component is expressed as Wg. For example, when the acid value of the binder resin is measured from a toner, acid values and amounts of components (e.g., a colorant and a magnetic material) are separately measured and the acid value of the binder resin is determined by calculation.

(2) The sample is placed in a 300 mL beaker. A mixed liquid of toluene/ethanol (at a volume ratio of 4/1) (150 mL) is added to the beaker to dissolve the sample.

(3) Titration is performed with a potentiometric titrator using a 0.1 mol/L potassium hydroxide (KOH) solution in ethanol.

(4) An amount of the KOH solution used in the titration is expressed as S (mL). At the same time, a blank is measured and an amount of the KOH solution used for the blank is expressed as B (mL). The acid value is calculated according to a formula below:

$$\text{Acid value (mgKOH/g)}=[(S-B)\times f\times 5.61]/W$$

where f denotes a factor of KOH.

A glass transition temperature (Tg) of the binder resin and a toner composition including the binder resin is not particularly limited and may be appropriately selected depending on the intended purpose, but is preferably from 35° C. through 80° C., more preferably from 40° C. through 70° C. from the viewpoint of storability of the resultant toner.

When the glass transition temperature (Tg) is lower than 35° C., the resultant toner may be more likely to deteriorate under a high-temperature atmosphere. When the glass transition temperature (Tg) is higher than 80° C., fixability may be deteriorated.

The binder resin may be appropriately selected from those described above depending on an organic solvent to be used and a release agent to be used. Use of a release agent having excellent solubility in an organic solvent may lower a softening point of the resultant toner. In such a case, it is effective, for maintaining a good hot-offset property, to raise the softening point of the binder resin by increasing a weight average molecular weight of the binder resin.

<Release Agent>

The release agent is not particularly limited and may be appropriately selected from those known in the art depending on the intended purpose, so long as the release agent dissolves in the organic solvent. Waxes are preferable.

Examples of the release agent include aliphatic hydrocarbon-based waxes such as low molecular-weight polyethylene, low molecular-weight polypropylene, polyolefin waxes, microcrystalline waxes, paraffin waxes, and Sasol waxes; oxides of aliphatic hydrocarbon-based waxes such as polyethylene oxide waxes, or block copolymers of the oxides; vegetable waxes such as candelilla wax, carnauba wax, Japan wax, and jojoba wax; animal waxes such as beeswax, lanolin, and spermaceti wax; mineral waxes such as ozokerite, ceresin, and petrolatum; waxes mainly made of fatty acid esters, such as montanoic acid ester wax and caster wax; various synthetic ester waxes; and synthetic amide waxes.

Other examples of the release agent include saturated straight chain fatty acids such as palmitic acid, stearic acid, montanoic acid, and other straight chain alkyl carboxylic acids including straight chain alkyl groups; unsaturated fatty acids such as prandinic acid, eleostearic acid, and parinaric acid; saturated alcohols such as stearyl alcohol, eicosyl alcohol, behenyl alcohol, carnaupyl alcohol, ceryl alcohol, mesilyl alcohol, and other long-chain alkyl alcohols; polyvalent alcohols such as sorbitol; fatty acid amides such as linoleic acid amide, olefin acid amide, and lauric acid amide; saturated fatty acid bisamides such as methylenebiscapric acid amide, ethylenebislauric acid amide, and hexamethylenebisstearic acid amide; unsaturated fatty acid amides such as ethylenebisoleic acid amide, hexamethylenebisoleic acid amide, N,N'-dioleyladipic acid amide, and N,N'-dioleylsebacic acid amide; aromatic bisamides such as m-xylenebisstearic acid amide and N,N-distearyl isophthalic acid amide; fatty acid metal salts such as calcium stearate, calcium laurate, zinc stearate, and magnesium stearate; waxes obtained by grafting aliphatic hydrocarbon-based waxes with vinyl-based monomers such as styrene and acrylic acid; partial ester compounds of fatty acids and polyvalent alcohols, such as behenic acid monoglyceride; and methyl ester compounds including hydroxyl groups obtained by hydrogenating vegetable fats or vegetable oils.

In the present invention, the release agent is preferably ester waxes including fatty acid esters as a main component or amide waxes including fatty acid esters as a main component. In particular, when the release agent is ester waxes including fatty acid esters as a main component, an aspect in which the binder resin is a polyester resin and the ester waxes are used in combination is more preferable.

Other preferable examples of the release agent include those obtained by making a molecular weight distribution of the above-described waxes sharp by a press sweating method, a solvent method, a recrystallization method, a vacuum distillation method, a supercritical gas extraction method, or a solution crystallization method, and those obtained by removing a low-molecular-weight solid fatty acid, a low-molecular-weight solid alcohol, a low-molecular-weight solid compound, and other impurities from the above-described waxes.

Solubility of the release agent is preferably 20 g or more, more preferably 70 g or more, further preferably 200 g or more relative to 100 g of ethyl acetate of 45° C. from the viewpoint of a balance among fixability, offset resistance, and adherence resistance. When the release agent has the solubility of 20 g/(100 g of ethyl acetate) or more, the resultant toner exerts satisfactory adherence resistance while having fixability and offset resistance.

A melting point of the release agent is preferably lower than 70° C., more preferably 60° C. or lower, further preferably a range of from 50° C. through 60° C. from the viewpoint of a balance between fixability and offset resistance. The melting point of 50° C. or higher prevent blocking resistance of the resultant toner from deteriorating. The melting point of lower than 60° C. allows the resultant toner to exert satisfactory offset resistance.

Note that, in the present invention, a peak top temperature of the maximum peak among endothermic peaks of a wax measured according to differential scanning calorimetry (DSC) is determined as the melting point of the release agent.

A device for measuring the melting point of the release agent or the toner by DSC is preferably a high-precision inner-heat input-compensation type differential scanning calorimeter. The melting point is measured according to ASTM D3418-82. A DSC curve used in the present invention is generated by measuring during raising a temperature at a heating rate of 10° C./min after taking a previous history by subjecting one cycle of heating and cooling.

In the present invention, it is important to consider a kind and an amount of the release agent in order to obtain a toner including the release agent having a desired size in a desired region in the toner.

<<Amount of Release Agent>>

An amount of the release agent contained in the toner is from 1% by mass through 8% by mass relative to an amount of the toner, as expressed as an equivalent mass of an endothermic amount of the release agent determined by differential scanning calorimetry (DSC).

An amount of the release agent that is present in a region from a surface of the toner to a depth of 0.3 μm is from 0.1% by mass through 4% by mass, as determined by attenuated total reflection Fourier transform infrared spectroscopy (FTIR-ATR).

The release agent that is present in a region from a surface of the toner to a depth of 0.3 μm can easily migrate to the surface of the toner. As a result, the release agent satisfying the above-described requirement can effectively exert toner releasability. Therefore, the amount of the release agent that is present in a region from a surface of the toner to a depth of 0.3 μm as determined by FTIR-ATR is preferably a range of from 0.1% by mass through 4% by mass, more preferably 0.1% by mass through 3% by mass. When the amount is 0.1% by mass or more, an amount of the release agent which is present adjacent to the surface of the toner is not excessively small, leading to satisfactory releasability during fixing. When the amount is 4% by mass or less, an amount of the release agent which is present adjacent to the surface of the toner is not excessively large. Therefore, the release agent is not exposed on the outermost surface of the toner, and thus, the toner is prevented from adhering to a surface of a carrier via the release surface to a greater extent. As a result, a developer can be prevented from deteriorating in filming resistance. Thus, the toner satisfying the above-described requirement can achieve offset resistance during fixing, concurrently with chargeability, develop ability, and filming resistance.

A total amount of the release agent as determined by DSC is preferably from 1% by mass through 8% by mass in a toner particle. When the total amount of the release agent is 1% by mass or more, an amount of the release agent included in the toner particle is not excessively small. As a result, the resultant toner can achieve satisfactory releasability during fixing and is prevented from deteriorating in offset resistance. When the total amount of the release agent is 8% by mass or less, the toner is prevented from deteriorating in filming resistance and a color image which has been fixed is prevented from losing a gloss. Thus, the above-described range is preferable.

The amount of the release agent can be measured by the differential scanning calorimetry (DSC) or the attenuated total reflection Fourier transform infrared spectroscopy (FTIR-ATR) in the following manner.

[Measurement of Amount (% by Mass) of Release Agent by Differential Scanning Calorimetry (DSC)]

A total amount of a release agent in a toner particle is measured by differential scanning calorimetry (DSC). A toner sample and a release agent sample are separately measured by the device described below under the conditions described below. An amount of the release agent contained in the toner is calculated from a ratio of endothermic amounts of the release agents obtained from the toner sample and the release agent sample.

Measuring device: DSC instrument (DSC60; available from Shimadzu Corporation)

Amount of sample: about 5 mg

Heating rate: 10° C./min

Measurement range: from room temperature through 150° C.

Measurement atmosphere: nitrogen gas atmosphere

The total amount of the release agent is calculated according to a formula below.

Total amount of release agent (% by mass)=(Endothermic amount (J/g) of release agent in toner sample)×100)/(Endothermic amount (J/g) of release agent only).

This method is able to measure the total amount of the release agent in the toner particle, even when whole amount of an added release agent is not incorporated in the toner due to leakage of the release agent during a toner production process.

[Measurement of Content (% by Mass) of Release Agent by Attenuated Total Reflection Fourier Transform Infrared Spectroscopy (FTIR-ATR)]

A surface release agent amount in a toner particle can be determined by attenuated total reflection Fourier transform infrared spectroscopy (FTIR-ATR). An analytical depth is about 0.3 μm according to the measurement principle. This method is able to measure an amount of the release agent that is present in a region from a surface of the toner particle to a depth of 0.3 μm. The amount is measured in the following manner.

First, as a sample, 3 g of a toner is formed into a pellet having a diameter of 40 mm (thickness: about 2 mm) by pressing using an automatic pellet molder (Type M No. 50 BRP-E, available from MAEKAWA TESTING MACHINE CO.) under a load of 6 t for 1 min.

A surface of the resultant toner pellet is measured by FTIR-ATR.

A microscopic FTIR instrument used is SPECTRUM ONE (available from PERKIN ELMER Co., Ltd.) equipped with a MULTISCOPE FTIR unit. This measurement is performed by micro ATR using a germanium (Ge) crystal having a diameter of 100 μm.

The measurement is performed 20 times cumulatively at an infrared incident angle of 41.5° at a resolution of 4 $cm^{-1}$.

A ratio of intensities of a peak from the release agent and a peak from the binder resin is determined as a relative release agent amount in a surface of a toner particle. An average of measurements obtained by measuring 4 times at different measurement positions is used.

A surface release agent amount of the sample is calculated based on a relation with a relative release agent amount of a sample for a calibration curve in which a known amount of a release agent is dispersed uniformly.

<Other Components>

The toner of the present invention may include other components such as a colorant and a charging control agent.

<<Colorant>>

The colorant is not particularly limited and may be appropriately selected from those known in the art depending on the intended purpose. Examples of the colorant include carbon black, nigrosine dyes, iron black, naphthol yellow S, Hansa yellow (10G, 5G, and G), cadmium yellow, yellow iron oxide, yellow ocher, yellow lead, titanium yellow, polyazo yellow, oil yellow, Hansa yellow (GR, A, RN, and R), pigment yellow L, benzidine yellow (G and GR), permanent yellow (NCG), vulcan fast yellow (5G, R), tartrazine lake, quinoline yellow lake, anthrasan yellow BGL, isoindolinone yellow, red iron oxide, red lead, lead vermilion, cadmium red, cadmium mercury red, antimony vermilion, permanent red 4R, parared, fiser red, para chloro ortho nitro aniline red, lithol fast scarlet G, brilliant fast scarlet, brilliant carmine BS, permanent red (F2R, F4R, FRL, FRLL, and F4RH), fast scarlet VD, vulcan fast rubin B, brilliant scarlet G, lithol rubin GX, permanent red FSR, brilliant carmine 6B, pigment scarlet 3B, Bordeaux 5B, toluidine Maroon, permanent Bordeaux F2K, Helio Bordeaux BL, Bordeaux 10B, BON maroon light, BON maroon medium, eosin lake, rhodamine lake B, rhodamine lake Y, alizarin lake, thioindigo red B, thioindigo maroon, oil red, quinacridone red, pyrazolone red, polyazo red, chrome vermilion, benzidine orange, perinone orange, oil orange, cobalt blue, cerulean blue, alkali blue lake, peacock blue lake, Victoria blue lake, metal-free phthalocyanine blue, phthalocyanine blue, fast sky blue, indanthrene blue (RS and BC), indigo, ultramarine, iron blue, anthraquinone blue, fast violet B, methyl violet lake, cobalt purple, manganese violet, dioxane violet, anthraquinone violet, chrome green, zinc green, chromium oxide, viridian, emerald green, pigment green B, naphthol green B, green gold, acid green lake, malachite green lake, phthalocyanine green, anthraquinone green, titanium oxide, zinc flower, lithopone, and a mixture of the above-described colorants.

An amount of the colorant is not particularly limited and may be appropriately selected depending on the intended purpose, but is preferably from 1% by mass through 15% by mass, more preferably from 3% by mass through 10% by mass relative to an amount of the toner.

The colorant may be used as a masterbatch which is a composite of the colorant with a resin.

The resin kneaded together with the masterbatch is not particularly limited and may be appropriately selected depending on the intended purpose. Examples of the resin include modified polyester resins obtained by modifying polyester resins with isocyanate groups or epoxy and unmodified polyester resins formed of polyester resins and polycarboxylic acids. Other examples than the modified polyester resins and the unmodified polyester resins include polymers of styrene or substituted styrene (e.g., polystyrene, poly-p-chlorostyrene, and polyvinyltoluene); styrene copolymers (e.g., styrene-p-chlorostyrene copolymers, styrene-propylene copolymers, styrene-vinyl toluene copolymers, styrene-vinylnaphthalene copolymers, styrene-methyl acrylate copolymers, styrene-ethyl acrylate copolymers, styrene-butyl acrylate copolymers, styrene-octyl acrylate copolymers, styrene-methyl methacrylate copolymers, styrene-ethyl methacrylate copolymers, styrene-butyl methacrylate copolymers, styrene-methyl α-chloromethacrylate copolymers, styrene-acrylonitrile copolymers, styrene-methyl vinyl ketone copolymers, styrene-butadiene copolymers, styrene-isoprene copolymers, styrene-acrylonitrile-indene copolymers, styrene-maleic acid copolymers, and styrene-maleic acid ester copolymers); polymethyl methacrylate, polybutyl methacrylate, polyvinyl chloride, polyvinyl acetate, polyethylene, polypropylene, polyester, epoxy resins, epoxy polyol resins, polyurethane, polyamide, polyvinyl butyral, polyacrylate resins, rosin, modified rosin, terpene resins, aliphatic or alicyclic hydrocarbon resins, aromatic petroleum resins, chlorinated paraffin, and paraffin waxes. These may be used alone or in combination.

The masterbatch can be prepared by mixing and kneading the colorant with the resin for the masterbatch with high shear being applied.

In the mixing and kneading, organic solvents may be used for the purpose of enhancing interaction between the colorant and the resin. A so-called flushing method may be used. In the flushing method, an aqueous paste including the colorant is mixed and kneaded with the resin and the organic solvent, the colorant is transferred to the resin, and then water and the organic solvent are removed. Use of the flushing method is preferable because a wet cake of the colorant is used as it is, and it is not necessary to dry the wet cake of the colorant.

For the mixing and kneading, a high-shear disperser (e.g., a three-roll mill) is suitably used.

An amount of the masterbatch is not particularly limited and may be appropriately selected depending on the intended purpose, but is preferably from 0.1 parts by mass through 20 parts by mass relative to 100 parts by mass of the binder resin.

It is preferable that the resin for the masterbatch have an acid value of 30 mgKOH/g or less and an amine value of from 1 through 100, and the colorant be dispersed in the resin. It is more preferable that the resin for masterbatch have an acid value of 20 mgKOH/g or less and an amine value of from 10 through 50, and the colorant be dispersed in the resin.

When the acid value is more than 30 mgKOH/g, the resultant toner may be deteriorated in chargeability under high-humidity conditions and a pigment may be insufficiently dispersed. When the amine value is less than 1 or more than 100, a pigment may be insufficiently dispersed.

The acid value can be measured, for example, according to a procedure described in JIS K0070. The amine value can be measured, for example, according to a procedure described in JIS K7237.

<<<Pigment Dispersion Liquid>>>

The colorant may also be used in the form of a colorant dispersion liquid in which the colorant is dispersed in a pigment dispersion liquid.

The pigment dispersing agent is not particularly limited and may be appropriately selected from those known in the art depending on the intended purpose. The pigment dispersing agent is preferably highly compatible with the binder resin from the viewpoint of dispersibility of a pigment. Examples of commercially-available pigment dispersing agents which are highly compatible with the binder resin include "AJISPER PB821" and "AJISPER PB822" (available from Ajinomoto Fine-Techno Co., Inc.), "DISPERBYK-2001" (available from Byk-Chemie GmbH), and "EFKA-4010" (available from EFKA Corporation).

A weight average molecular weight of the pigment dispersing agent is preferably from 500 to 100,000 in terms of styrene at the local maximum of a main peak obtained by gel permeation chromatography. The weight average molecular weight is more preferably from 3,000 to 100,000, further preferably from 5,000 to 50,000, particularly preferably from 5,000 to 30,000 from the viewpoint of dispersibility of a pigment. When the molecular weight is less than 500, the pigment dispersing agent may have higher polarity, potentially leading to deteriorated dispersibility of the colorant. When the molecular weight is greater than 100,000, the pigment dispersing agent may have higher affinity with the organic solvent, potentially leading to deteriorated dispersibility of the colorant.

An amount of the pigment dispersing agent to be added is not particularly limited and may be appropriately selected depending on the intended purpose, but is preferably from 1 part by mass through 200 parts by mass, more preferably from 5 parts by mass through 80 parts by mass relative to 100 parts by mass of the colorant. When the amount is less than 1 part by mass, the pigment dispersion liquid may be deteriorated in dispersing ability. When the amount is more than 200 parts by mass, the resultant toner may be deteriorated in chargeability.

<<Charging Control Agent>>

The charging control agent is not particularly limited and may be appropriately selected from those known in the art depending on the intended purpose. Examples of the charging control agent include nigrosine-based dyes, triphenylmethane-based dyes, chrome-including metal complex dyes, molybdic-acid chelate pigments, rhodamine-based dyes, alkoxy-based amines, quaternary ammonium salts (including fluorine-modified quaternary ammonium salts), alkylamides, phosphorus, phosphorus compounds, tungsten, tungsten compounds, fluorine-based active agents, metal salts of salicylic acid, and metal salts of salicylic acid derivatives.

Specific examples include BONTRON 03 (a nigrosine-based dye), BONTRON P-51 (a quaternary ammonium salt), BONTRON S-34 (a metal-including azo dye), E-82 (an oxynaphthoic-acid-based metal complex), E-84 (a salicylic acid-based metal complex), and E-89 (a phenol-based condensate) (available from ORIENT CHEMICAL INDUSTRIES CO., LTD); TP-302 and TP-415 (quaternary-ammonium-salt molybdenum-complexes) (available from Hodogaya Chemical Co., Ltd.); COPY CHARGE PSY VP 2038 (a quaternary ammonium salt), COPY BLUE PR (a triphenylmethane derivative), COPY CHARGE NEG VP2036 (a quaternary ammonium salt), and COPY CHARGE NX VP434 (available from Hoechst AG); LRA-901 and LR-147 (a boron complex) (available from Japan Carlit Co., Ltd.); copper phthalocyanine; perylene; quinacridone; azo-pigments; polymeric compounds including functional groups (e.g., sulfonic acid groups, carboxyl groups, and quaternary ammonium salts); phenol-based resins; and fluorine-based compounds.

An amount the charging control agent to be used is not particularly limited and may be appropriately selected depending on a kind of the binder resin, the presence or absence of optionally used additives, and a toner production method (including a dispersing method). The amount of the charging control agent is preferably from 0.1 parts by mass through 10 parts by mass, more preferably from 0.2 parts by mass through 5 parts by mass, relative to 100 parts by mass of the binder resin. When the amount is more than 10 parts by mass, fixability of the resultant toner may be impaired.

The charging control agent can be preferably dissolved in an organic solvent from the viewpoint of production stability. The charging control agent may also be finely dispersed in an organic solvent with, for example, a bead mill prior to addition.

<Toner Property>

In an image of a torn surface of the toner of the present invention taken by a transmission electron microscope (TEM), a relationship below is satisfied:

$$WDa<WDb<WDc$$

where

WDa denotes a number average particle diameter of the release agent present in a region Aa that is a region from a surface of the toner to a depth that is one-sixth of a diameter d of the toner (⅙d);

WDc denotes a number average particle diameter of the release agent present in a central region Ac that is a circular region having a center located at a center of the toner and a radius of ⅙d; and WDb denotes a number average particle diameter of the release agent present in a region Ab that is a region other than the Aa or the Ac.

The toner satisfying the above relationship is excellent in all of offset resistance, toner particle strength, toner chargeability, and toner durability.

The Aa, the Ab, the Ac, the WDa, the WDb, and the WDc can be determined based on a photograph of a torn surface of a toner particle taken by a transmission electron microscope (TEM) in the following manner.

The release agent included in the toner of the present invention is characterized in that the release agent is distributed with a gradient of particle diameter in which a particle diameter of the release agent becomes larger from a surface of the toner towards a center of the toner in the TEM image. This results in preventing the release agent from exposing on the surface of the toner while allowing the release agent to appropriately migrate to the surface during fixing. Moreover, the resultant toner has enhanced particle strength, making it possible to prevent a decrease of a charging amount or background fog, the decrease being caused by bleeding of the release agent.

In order to obtain a desired toner defined in the present invention, it is necessary to carefully consider kinds and amounts of the binder resin, the release agent, and other components to be included in the toner. In the present invention, the desired toner is suitably produced by using the below-described production method. At that time, a kind of an organic solvent included in a toner composition liquid and solubility of the release agent in the organic solvent are preferably considered. Moreover, in the below-described production method, liquid droplets are preferably dried under an atmosphere adjusted to a temperature of (Tc−5°) C. or higher where Tc (° C.) denotes a recrystallization temperature of the release agent. Alternatively, even under an atmosphere of a temperature of lower than (Tc−5°) C., liquid droplets may be dried so long as a relative humidity of the atmosphere is adjusted to a range of from 10% through 40% on the organic solvent in the toner composition liquid basis.

A temperature slightly lower than (Tc−5°) C. is not problematic. However, it is noted that, when the liquid droplets are dried at a temperature significantly (e.g., 10° C. or more) lower than (Tc−5°) C., the liquid droplets are more likely to coalesce with each other, potentially leading to significant deterioration of a particle distribution.

FIG. 1 illustrates one exemplary cross-sectional view of the toner of the present invention.

Figure 2A:
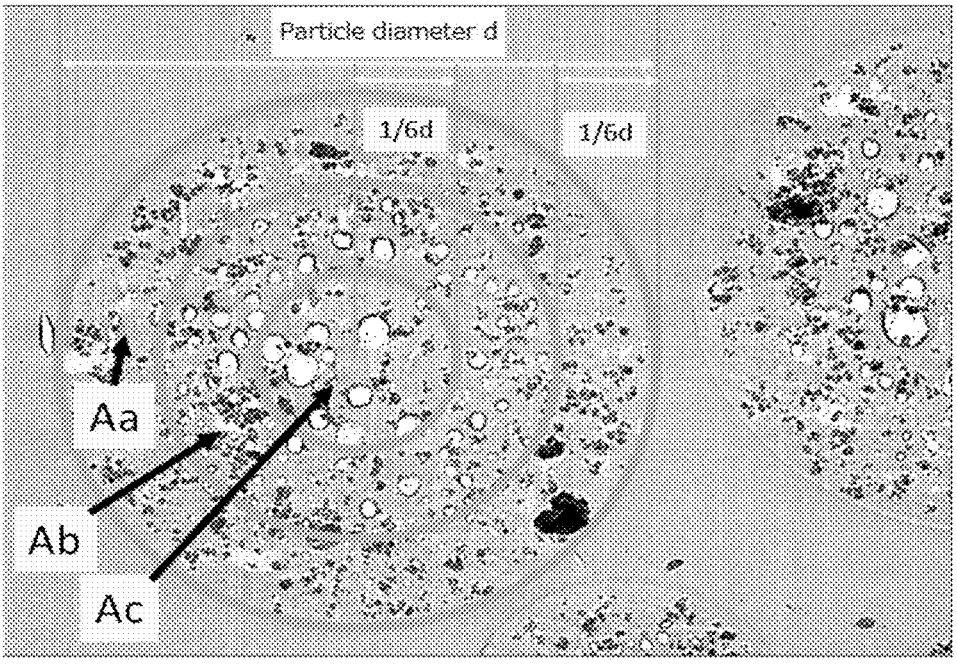
FIG. 2A is a contrast-adjusted view of FIG. 1.

FIG. 2A is a view in which a contrast of FIG. 1 is adjusted to emphasize a profile of the toner. From this view, a relationship among Aa, Ab, and Ac can be found.

A region Aa refers to a region from a surface of the toner to a depth that is one-sixth of a diameter d of the toner (⅙d).

A region Ac refers to a central region a central region within a distance equivalent to one-sixth of a diameter d of the toner (⅙d) from a center of the toner, that is, a circular, central region having a center located at a center of the toner and a radius of ⅙d.

A region Ad refers to a region other than the Aa or the Ac.

Figure 2B:
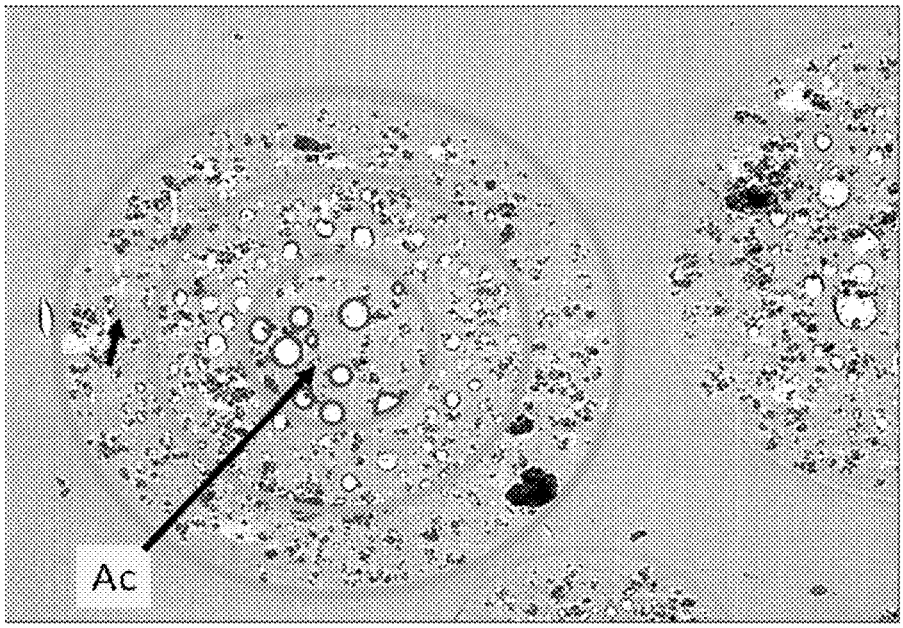
FIG. 2B is a contrast-adjusted view of FIG. 1.

FIG. 2B is a view in which release agents in the region Ac in the toner particle of FIG. 1 are emphasized. The image may be binarized in these views, if necessary. An image processing method may be appropriately selected so as to be able to observe a distribution of the release agents.

Number average particle diameters WDa, WDb, and WDc of the release agents in the toner particle satisfy a relationship: WDa<WDb<WDc.

Unless this condition is satisfied, the release agent is more likely to expose on a surface or particle strength of the toner particle is lowered. As a result, background fog or a decrease of a charging amount is more likely to occur, the decrease being caused by bleeding of the release agent.

The WDa is preferably a range of from 0.15 μm through 0.35 mm, more preferably from 0.15 μm through 0.25 μm. When the WDa is less than 0.15 μm, the release agent disposed in a surface of the toner is less likely to exert a release effect. As a result, the release agent may be prevented from migrating to the surface during fixing, potentially leading to deterioration of an offset property. When the WDa is more than 0.35 μm, the release agent is more likely to expose on a surface of the toner. As a result, background fog or a decrease of a charging amount is more likely to occur, the decrease being caused by bleeding of the release agent.

The WDb is preferably a range of from 0.50 μm through 0.60 μm. When the WDb is less than 0.50 μm, the release agent disposed in a surface of the toner is less likely to exert a release effect. As a result, the release agent may be prevented from migrating to the surface during fixing, potentially leading to deterioration of an offset property. When the WDb is more than 0.60 μm, the release agent is more likely to expose on a surface of the toner. As a result, background fog or a decrease of a charging amount is more likely to occur, the decrease being caused by bleeding of the release agent.

The WDc is preferably a range of from 0.60 μm through 1.00 μm. When the WDc is less than 0.60 μm, the release agent disposed in a surface of the toner is less likely to exert a release effect. As a result, the release agent may be prevented from migrating to the surface during fixing, potentially leading to deterioration of an offset property. When the WDc is more than 1.00 μm, the release agent is more likely to expose on a surface of the toner. As a result, background fog or a decrease of a charging amount is more likely to occur, the decrease being caused by bleeding of the release agent.

A ratio of the WDc to the WDa (WDc/WDa) is preferably a range of from 3.5 through 4.0. When the WDc/WDa is less than 3.5, the release agent disposed in a surface of the toner is less likely to exert a release effect. As a result, the release agent may be prevented from migrating to the surface during fixing, potentially leading to deterioration of an offset property. When the WDc/WDa is more than 4.0, the release agent is more likely to expose on a surface of the toner. As a result, background fog or a decrease of a charging amount is more likely to occur, the decrease being caused by bleeding of the release agent.

The Aa, the Ab, the Ac, the WDa, the WDb, and the WDc are measured in the following manner.

[Measurement of Aa, Ab, Ac, WDa, WDb, and WDc]

In TEM observation, for example, a toner is embedded in an epoxy resin, and sliced at a cross-section passing through a center of the toner with an ultramicrotome (ultrasonic) to produce a section of the toner. The section is observed with a transmission electron microscope (TEM) while adjusting a magnification. The regions Aa, Ab, and Ac and the number average particle diameters WDa, WDb, and WDc are determined on a torn surface of the toner.

A torn surface is prepared from each of 50 toners.

The torn surfaces are observed by enlarging a microscopic field to the extent that the Aa, the Ab, the Ac, the WDa, the WDb, and the WDc can be measured. Thus, 50 torn surfaces of the toners are extracted as measurement samples. Then, image files of the samples are processed with an image analysis software IMAGEJ to determine the Aa, the Ab, the Ac, the WDa, the WDb, and the WDc.

Values of the WDa, the WDb, and the WDc are calculated for each of the torn surfaces of 50 samples of the toner of the present invention, and it is verified whether average values of the 50 samples satisfy the relationship: WDa<WDb<WDc.

<Toner Shape>

A volume average particle diameter of the toner of the present invention is preferably from 1 μm through 8 μm from the viewpoint of forming high-definition, high-quality images with high-resolution.

A particle size distribution (volume average particle diameter/number average particle diameter) of the toner is preferably from 1.00 through 1.15 from the viewpoint of maintaining stable images for a long period of time.

Moreover, the toner of the present invention preferably has the second most frequent (by number) peak within a range of from 1.21 times through 1.31 times as large as the most frequent (by number) number particle diameter (may be referred to as "the most frequent diameter") in a distribution plot of number particle diameter of the toner versus frequency (by number) of the toner.

When the toner does not have the second most frequent (by number) peak, in particular, when the particle size distribution (volume average particle diameter/number average particle diameter) is close to 1.00 (monodisperse), the toner is extremely highly close-packed. As a result, the toner is more likely to be deteriorated in initial flowability or cleaning failure is more likely to occur. It is not preferable that the toner has the second most frequent (by number) peak greater than 1.31 times as large as the most frequent (by number) number particle diameter, because a large number of coarse toner particles are included in the toner, leading to deterioration of image quality and granularity.

Figure 13:
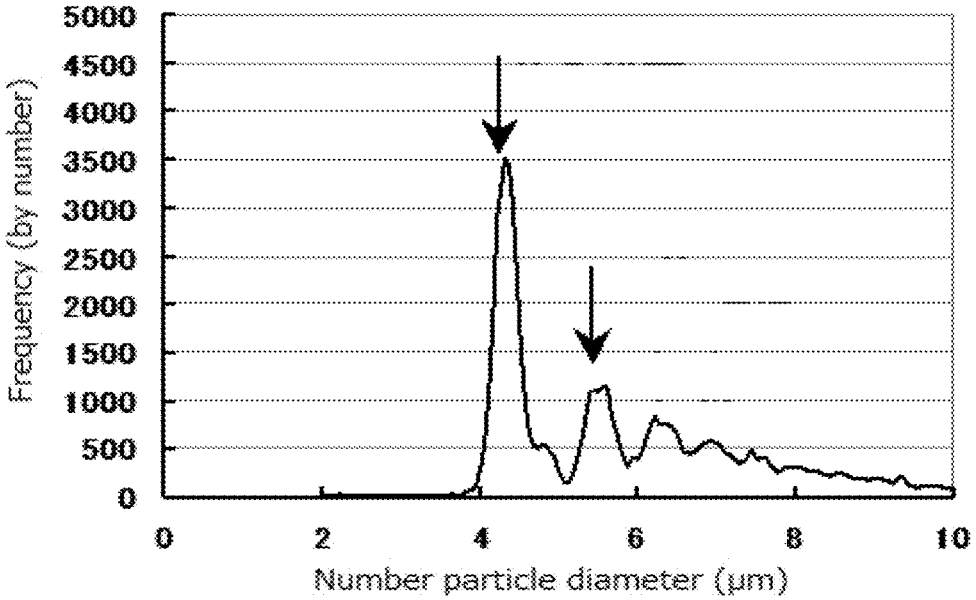
FIG. 13 is a graph illustrating one exemplary distribution plot of number particle diameter of a toner of the present invention versus frequency (by number) of a toner of the present invention.

FIG. 13 is a graph illustrating one exemplary distribution plot of number particle diameter of a toner of the present invention versus frequency (by number) of a toner of the present invention. In FIG. 13, a horizontal axis represents number particle diameter (μm) and a vertical axis represents frequency (by number). It can be found from this graph that the toner has the second most frequent (by number) peak within a range of from 1.21 times through 1.31 times as large as the most frequent (by number) number particle diameter (may be referred to as "the most frequent diameter").

The particle diameter and the particle size distribution are measured in the following manner.

[Measurement of Particle Diameter and Particle Size Distribution of Toner]

A volume average particle diameter (Dv) and a number average particle diameter (Dn) of the toner of the present invention are measured with a particle size measuring device ("MULTISIZER III," available from Beckman Coulter Inc.) at an aperture diameter of 50 μm. After the volume and the number of the toner particles are measured, a volume distribution and a number distribution are calculated. The volume average particle diameter (Dv) and the number average particle diameter (Dn) of the toner can be determined based on the resultant distributions. The particle size distribution is represented by a ratio Dv/Dn which is obtained by dividing the volume average particle diameter (Dv) of the toner by the number average particle diameter (Dn) of the toner. This ratio is 1 when the toner is completely monodispersed. The greater this ratio, the broader the distribution is.

External additives such as a flowability improving agent and a cleanability improving agent may be added to the toner of the present invention, if necessary.

<<Flowability Improving Agent>>

A flowability improving agent may be added to the toner of the present invention. By being added to a surface of the toner, the flowability improving agent improves flowability of the toner (makes the toner easy to flow).

The flowability improving agent is not particularly limited and may be appropriately selected depending on the intended purpose. Examples of the flowability improving agent include particles of metal oxides [e.g., silica powder (e.g., wet silica and dry silica), titanium oxide powder, and alumina powder], and treated silica, treated titanium oxide, and treated alumina obtained by subjecting the silica powder, titanium oxide powder, and alumina powder to surface-treatment with a silane coupling agent, a titanium coupling agent, or silicone oil; and fluorine-based resin powder such as vinylidene fluoride powder and polytetrafluoroethylene powder. Among them, silica powder, titanium oxide powder, and alumina powder are preferable, and treated silica obtained by subjecting the silica powder to surface-treatment with a silane coupling agent or silicone oil is more preferable.

A particle diameter of the flowability improving agent is not particularly limited and may be appropriately selected depending on the intended purpose. An average primary particle diameter of the flowability improving agent is preferably from 0.001 μm through 2 μm, more preferably from 0.002 μm through 0.2 μm.

The silica powder is powder produced through gas-phase oxidation of a silicon halide compound, and may be referred to as dry silica or fumed silica.

Examples of commercially-available products of the silica powder produced through gas-phase oxidation of a silicon halide compound include the tradenames AEROSIL-130, AEROSIL-300, AEROSIL-380, AEROSIL-TT600, AEROSIL-MOX170, AEROSIL-MOX80, and AEROSIL-COK84 (available from Nippon Aerosil Co., Ltd.); the tradenames Ca—O-SiL-M-5, Ca—O—SiL-MS-7, Ca—O—SiL-MS-75, Ca—O—SiL-HS-5, and Ca—O-SiL-EH-5 (available from CABOT Corporation); the tradenames WACKER HDK-N20 V15, WACKER HDK-N20E, WACKER HDK-T30, and WACKER HDK-T40 (available from WACKER-CHEMIE GmbH); the tradename D-CFine-Silica (available from Dow Corning Corporation); and the tradename Fransol (available from Fransil Corporation).

Treated silica powder obtained by hydrophobizing the silica powder produced through gas-phase oxidation of a silicon halide compound is more preferable. Treated silica powder which has been treated so as to preferably have hydrophobicity of from 30% through 80% as measured by a methanol titration test is particularly preferable. Silica powder is hydrophobized by being chemically or physically treated with an organosilicon compound which is reactive with or physically adsorbs to the silica powder. A method in which the silica powder produced through gas-phase oxidation of a silicon halide compound is treated with an organosilicon compound is preferably used.

Examples of the organosilicon compound include hydroxypropyl trimethoxysilane, phenyl trimethoxysilane, n-hexadecyl trimethoxysilane, n-octadecyl trimethoxysilane, vinylmethoxysilane, vinyltriethoxysilane, vinyltriacetoxysilane, dimethylvinylchlorosilane, divinylchlorosilane, γ-methacryloxypropyltrimethoxysilane, hexamethyldisilane, trimethylsilane, trimethylchlorosilane, dimethyldichlorosilane, methyltrichlorosilane, allyldimethylchlorosilane, allylphenyldichlorosilane, benzyldimethylchlorosilane, bromomethyldimethylchlorosilane, α-chloroethyltrichlorosilane, β-chloroethyltrichlorosilane, chloromethyldimethylchlorosilane, triorganosilylmercaptan, trimethylsilylmercaptan, triorganosilylacrylate, vinyldimethylacetoxysilane, dimethylethoxysilane, trimethylethoxysilane, trimethylmethoxysilane, methyltriethoxysilane, isobutyltrimethoxysilane, dimethyldimethoxysilane, diphenyldiethoxysilane, hexamethyldisiloxane, 1,3-divinyltetramethyldisiloxane, 1,3-diphenyltetramethyldisiloxane; and dimethylpolysiloxane including from 2 through 12 siloxane units per molecule and including from 0 through 1 hydroxyl group bonded with Si at each terminal siloxane unit. Further examples include silicone oils such as dimethylsilicone oil. These may be used alone or in combination.

A number average particle diameter of the flowability improving agent is not particularly limited and may be appropriately selected depending on the intended purpose, but is preferably from 5 nm through 100 nm, more preferably from 5 nm through 50 nm.

A specific surface area of the flowability improving agent is not particularly limited and may be appropriately selected depending on the intended purpose, but is preferably 30 $m^2/g$ or more, more preferably from 60 $m^2/g$ through 400 $m^2/g$ in terms of a nitrogen adsorption specific surface area measured according to the BET method.

When the flowability improving agent is surface-treated powder, the specific surface area of the surface-treated powder is preferably 20 $m^2/g$ or more, more preferably from 40 $m^2/g$ through 300 $m^2/g$.

An amount the flowability improving agent to be applied is preferably from 0.03 parts by mass through 8 parts by mass relative to 100 parts by mass of toner particles.

<<Cleanability Improving Agent>>

A cleanability improving agent may be used for the purpose of improving removability of a toner remaining on an electrostatic latent image bearer or a primary transfer medium after the toner is transferred onto, for example, a sheet of recording paper. The cleanability improving agent is not particularly limited and may be appropriately selected depending on the intended purpose. Examples of the cleanability improving agent include metal salts of fatty acids such as zinc stearate, calcium stearate, and stearic acid; and polymer particles produced through soap-free emulsion polymerization, such as polymethyl methacrylate particles and polystyrene particles. The polymer particles preferably have a relatively narrow particle size distribution and a weight average particle diameter of from 0.01 μm through 1 μm.

The flowability improving agent and the cleanability improving agent are also called as external additives because the flowability improving agent and the cleanability improving agent are used with being deposited or immobilized on a surface of the toner. A method for externally adding such external additives to the toner is not particularly limited and may be appropriately selected depending on the intended purpose. For example, various powder mixers are used. Examples of the powder mixers include V type mixers, rocking mixers, Lodige mixers, Nauta mixers, and Henschel mixers. Examples of powder mixers used when immobilization is also performed include hybridizers, mechanofusions, and Q-mixers.

(Method for Producing Toner)

A method for producing the toner of the present invention includes at least a liquid droplet forming step and a liquid-droplet solidifying step; and, if necessary, further includes other steps.

A toner produced through the liquid droplet forming step and the liquid-droplet solidifying step can have properties defined in the present invention.

<Liquid Droplet Forming Step>

The liquid droplet forming step is a step of forming liquid droplets by discharging a toner composition liquid in which at least a binder resin and a release agent is dissolved or dispersed in an organic solvent.

The toner composition liquid can be obtained by dissolving or dispersing a toner composition in an organic solvent. The toner composition includes at least the binder resin and the release agent; and, if necessary, further includes other components such as a colorant, a pigment dispersing agent, and a charging control agent.

The organic solvent is not particularly limited and may be appropriately selected depending on the intended purpose, so long as the organic solvent is a volatile one in which the toner composition in the toner composition liquid can be dissolved or dispersed and the binder resin and the release agent in the toner composition liquid can be dissolved without phase-separation.

Ethers, ketones, esters, hydrocarbons, and alcohols are preferable, and tetrahydrofuran (THF), acetone, methyl ethyl ketone (MEK), ethyl acetate, toluene, and water are particularly preferable. These may be used alone or in combination.

In the present invention, when ethyl acetate is used as the organic solvent, as described above, release agents which can be dissolved in an amount of 20 g or more, more preferably 70 g or more, further preferably 200 g or more relative to 100 g of ethyl acetate of 45° C. are preferably used.

—Method for Preparing Toner Composition Liquid—

The toner composition liquid can be obtained by dissolving or dispersing the toner composition in an organic solvent. In preparation of the toner composition liquid, for the purpose of preventing clogging of a discharging hole, it is important to make a dispersoid (e.g., a colorant) sufficiently fine relative to an opening dimeter of a nozzle using, for example, a homomixer or a bead mill.

A solid content of the toner composition liquid is preferably from 3% by mass through 40% by mass. When the solid content is less than 3% by mass, productivity is lowered. Additionally, a dispersoid (e.g., a colorant) is more likely to settle out or aggregate. As a result, toner particles tend to have different compositions from each other, potentially leading to deteriorated toner quality. When the solid content is more than 40% by mass, it may be impossible to obtain a toner having a small particle diameter.

The step of forming liquid droplets by discharging a toner composition liquid can be performed by discharging the liquid droplets using a liquid-droplet discharging means.

A temperature of the toner composition liquid is preferably from about 50° C. through about 60° C. When the temperature is lower than 50° C., the resultant liquid droplets are not instantly dried immediately after the toner composition liquid is discharged. As a result, the liquid droplets coalesce with each other, potentially leading to deterioration of a particle size distribution. When the temperature is higher than 60° C., a solvent is more likely to evaporate to increase a solid content concentration. As a result, a toner having the desired particle diameter may not be obtained, as described above.

<<Liquid-Droplet Discharging Means>>

The liquid-droplet discharging means is not particularly limited and may be appropriately selected from those known in the art depending on the intended purpose, so long as the liquid-droplet discharging means discharges liquid droplets having a narrow particle size distribution. Examples of the liquid-droplet discharging means include one-fluid nozzles, two-fluid nozzles, membrane-vibration discharging means, Rayleigh-breakup discharging means, liquid-vibration discharging means, and liquid-column-resonance discharging means.

The membrane-vibration liquid-droplet discharging means are described in, for example, Japanese Unexamined Patent Application Publication No. 2008-292976. The Rayleigh-breakup liquid-droplet discharging means are described in, for example, Japanese Patent No. 4647506. The liquid-vibration liquid-droplet discharging means are described in, for example, Japanese Unexamined Patent Application Publication No. 2010-102195.

In order to make the liquid droplets have a narrow particle size distribution and ensure toner productivity, liquid-droplet forming liquid-column-resonance generated by the liquid-column-resonance discharging means can be utilized. Specifically, vibration is applied to the toner composition liquid in a liquid-column resonance liquid-chamber having at least one or more discharging ports to form a standing wave based on liquid-column resonance. Then, the toner composition liquid is discharged from the discharging ports disposed in regions corresponding to anti-nodes of the standing wave to form liquid droplets.

<<<Liquid-Column Resonance Discharging Means>>>

The liquid-column resonance discharging means configured to discharge liquid droplets by utilizing the liquid-column resonance will now be described.

Figure 3:
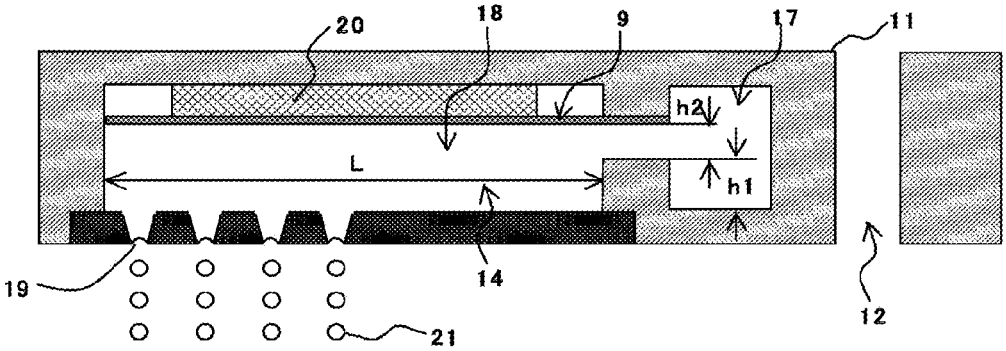
FIG. 3 is a schematic, cross-sectional view illustrating one exemplary liquid-column resonance liquid-droplet forming means.

FIG. 3 is a schematic, cross-sectional view illustrating one exemplary liquid-column resonance liquid-droplet forming means. A liquid-column resonance liquid-droplet forming means 11 includes a common liquid supplying-path 17 and a liquid-column resonance liquid-chamber 18 configured to store the toner composition liquid. The liquid-column resonance liquid-chamber 18 communicates with the common liquid supplying-path 17 disposed on one of wall surfaces at both ends in a longitudinal direction. The liquid-column resonance liquid-chamber 18 includes discharging holes 19 and a vibration generating means 20. The discharging holes 19 are disposed on one of wall surfaces that are coupled to the wall surfaces at the both ends and are configured to discharge liquid droplets 21. The vibration generating means 20 is disposed at a wall surface opposite to the wall surface on which the discharging holes 19 are disposed and is configured to generate a high frequency vibration in order to form a liquid-column resonance standing wave. Note that, a high-frequency power-source (not illustrated) is coupled to the vibration generating means 20.

The toner composition liquid to be discharged into the liquid-column resonance liquid-chamber 18 may be in a state of a particle-component including liquid, that is, a state in which components of particles to be produced are dissolved or dispersed. Alternatively, the toner composition liquid may include no organic solvent when the toner composition liquid is liquid under a discharging condition. In this case, the toner composition liquid may be in a state of a particle-component melted liquid, that is, a state in which components of particle are melted.

Figure 4:
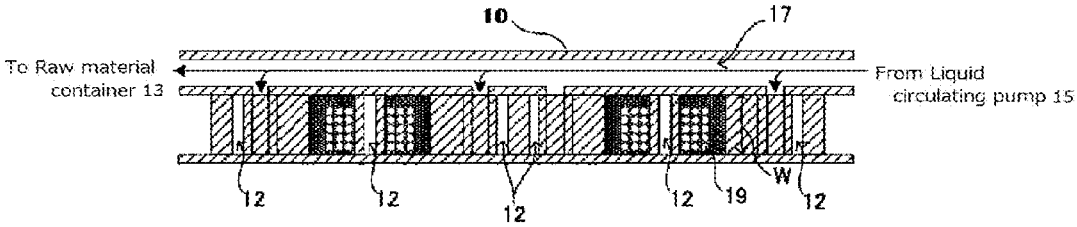
FIG. 4 is a schematic view illustrating one exemplary liquid-column resonance liquid-droplet unit and a bottom view viewed from a discharging surface of FIG. 3.

A toner composition liquid 14 is supplied into the common liquid supplying-path 17 of a liquid-column resonance liquid-droplet forming unit 10 illustrated in FIG. 4 through a liquid supplying pipe by a liquid circulating pump (not illustrated). Then, the toner composition liquid 14 is supplied into the liquid-column resonance liquid-chamber 18 of the liquid-column resonance liquid-droplet discharging means 11 illustrated in FIG. 3. In the liquid-column resonance liquid-chamber 18 filled with the toner composition liquid 14, a pressure distribution is formed by the action of a liquid-column resonance standing-wave generated by the vibration generating means 20. Then, the liquid droplets 21 are discharged from the discharge holes 19 which are disposed in the regions corresponding to the anti-nodes, where an amplitude and pressure fluctuation are large, of the liquid-column resonance standing-wave. The anti-node of the liquid-column resonance standing-wave refers to regions other than nodes of the standing wave. The anti-node is preferably a region in which the pressure fluctuation of the standing wave has a large amplitude enough to discharge the liquid, and more preferably a region having a width corresponding to ±¼ of a wavelength from a position of a local maximum amplitude of a pressure standing wave (i.e., a node of a velocity standing wave) in each direction toward positions of a local minimum amplitude. Even when a plurality of discharge holes are opened, substantially uniform liquid droplets can be formed from the plurality of discharge holes so long as the discharge holes are disposed in the regions corresponding to the anti-nodes of the standing wave. Moreover, the liquid droplets can be discharged efficiently, and the discharge holes are less likely to be clogged. Note that, the toner composition liquid 14 which has flowed through the common liquid supplying-path 17 is returned to a raw-material container via a liquid returning pipe (not illustrated). When the liquid droplets 21 are discharged to decrease an amount of the toner composition liquid 14 in the liquid-column resonance liquid-chamber 18, a larger amount of the toner composition liquid 14 is supplied from the common liquid supplying-path 17 by suction power generated by the action of the liquid-column resonance standing-wave in the liquid-column resonance liquid-chamber 18. As a result, the liquid-column resonance liquid-chamber 18 is refilled with the toner composition liquid 14. When the liquid-column resonance liquid-chamber 18 is refilled with the toner composition liquid 14, an amount of the toner composition liquid 14 flowing through the common liquid supplying-path 17 returns to as before.

The liquid-column resonance liquid-chamber 18 of the liquid-column resonance liquid-droplet discharging means 11 is formed by joining frames with each other. The frames are formed of materials having high stiffness to the extent that a liquid resonance frequency is not influenced at a driving frequency (e.g., metals, ceramics, and silicons). As illustrated in FIG. 3, a length L between wall surfaces at both ends of the liquid-column resonance liquid-chamber 18 in a longitudinal direction is determined based on the principle of the liquid column resonance described below. A width W of the liquid-column resonance liquid-chamber 18 illustrated in FIG. 4 is desirably shorter than ½ of the length L of the liquid-column resonance liquid-chamber 18 so as not to add any frequency unnecessary for the liquid column resonance. A single liquid droplet forming unit preferably includes a plurality of liquid-column resonance liquid-chambers 18 in order to improve productivity drastically. The number of the liquid-column resonance liquid-chambers is not limited, but a single liquid droplet forming unit most preferably includes from 100 through 2,000 liquid-column resonance liquid-chambers 18 because both of operability and productivity can be achieved. The common liquid supplying-path 17 is coupled to and communicated with a liquid supplying-path for each liquid-column resonance liquid-chamber. The common liquid supplying-path 17 is communicated with a plurality of liquid-column resonance liquid-chambers 18.

The vibration generating means 20 of the liquid-column resonance liquid-droplet discharging means 11 is not particularly limited, so long as the vibration generating means can be driven at a predetermined frequency. However, the vibration generating means is desirably formed by attaching a piezoelectric material onto an elastic plate 9. The elastic plate constitutes a portion of the wall of the liquid-column resonance liquid-chamber so as not to contact the piezoelectric material with the liquid. The piezoelectric material may be, for example, piezoelectric ceramics such as lead zirconate titanate (PZT), and is often laminated due to small displacement amount. Other examples of the piezoelectric material include piezoelectric polymers (e.g., polyvinylidene fluoride (PVDF)) and monocrystals (e.g., crystal, $LiNbO_3$, $LiTaO_3$, and $KNbO_3$). The vibration generating means 20 is desirably disposed so as to be individually controlled for each liquid-column resonance liquid-chamber. It is desirable that the liquid-column resonance liquid-chambers can be individually controlled via the elastic plates by partially cutting a block-shaped vibration member, which is formed of one of the above-described materials, according to geometry of the liquid-column resonance liquid-chambers.

An opening diameter of the discharge hole 19 is desirably in a range of from 1 μm through 40 μm. When the opening diameter is less than 1 μm, very small liquid droplets are formed, so that the toner is not obtained in some cases. Moreover, when solid particles (e.g., pigment) are included as a component of the toner, the discharge holes 19 may frequently be clogged to deteriorate productivity. When the opening diameter is more than 40 μm, liquid droplets having a larger diameter are formed. As a result, when the liquid droplets having a larger diameter are dried and solidified to achieve a desired toner particle diameter in a range of from 3 μm through 6 μm, a toner composition needs to be diluted with an organic solvent to a very thin liquid. Therefore, a lot of drying energy is disadvantageously needed for obtaining a predetermined amount of the toner.

As can be seen from FIG. 4, the discharge holes 19 are preferably disposed in a width direction of the liquid-column resonance liquid-chamber 18 because many discharge holes 19 can be disposed to improve production efficiency. Additionally, a liquid-column resonance frequency is desirably determined appropriately after verifying how the liquid droplets are discharged because the liquid-column resonance frequency varies depending on arrangement of the discharge holes 19.

A cross-sectional shape of the discharge hole 19 is illustrated in, for example, FIG. 3 as a tapered shape with the opening diameter gradually decreasing. However, the cross-sectional shape may be appropriately selected.

FIGS. 5A to 5D are schematic views illustrating shapes of discharging holes viewed from a cross-section of a liquid-column resonance liquid-chamber. FIGS. 5A to 5D illustrate possible cross-sectional shapes of the discharging holes 19.

Figure 5A:
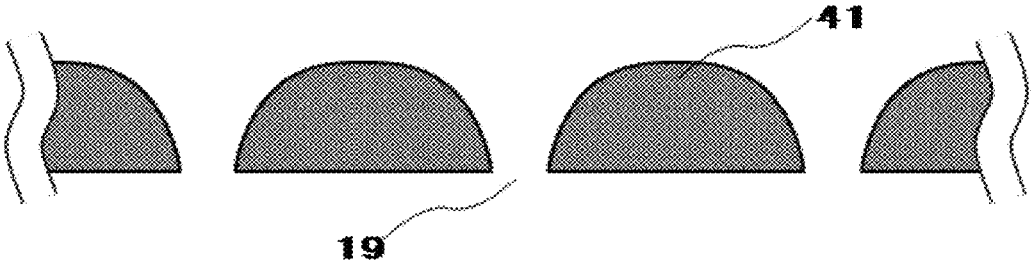
FIG. 5A is a schematic view illustrating one exemplary shape of a discharging hole viewed from a cross-section of a liquid-column resonance liquid-chamber.

In FIG. 5A, the discharging holes 19 have a rounded shape in which the opening diameter of the discharging holes 19 decreases from liquid-contact surfaces to discharge ports. In this case, when thin films 41 vibrate, the maximum pressure is applied to the liquid adjacent to exits of the discharging holes 19. Therefore, the above-described shape is the most preferable from the viewpoint of stable discharging.

Figure 5B:
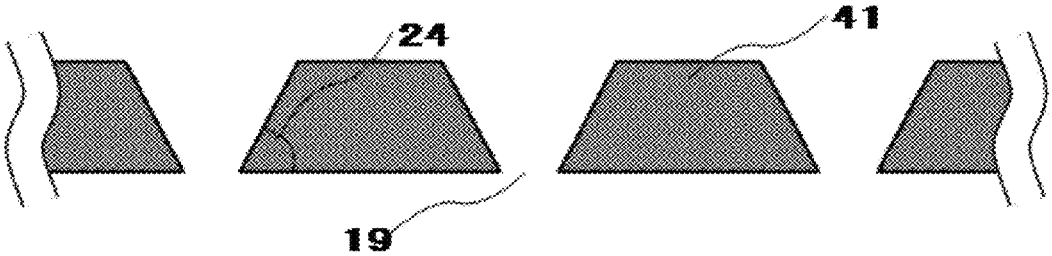
FIG. 5B is a schematic view illustrating one exemplary shape of a discharging hole viewed from a cross-section of a liquid-column resonance liquid-chamber.
Figure 5C:
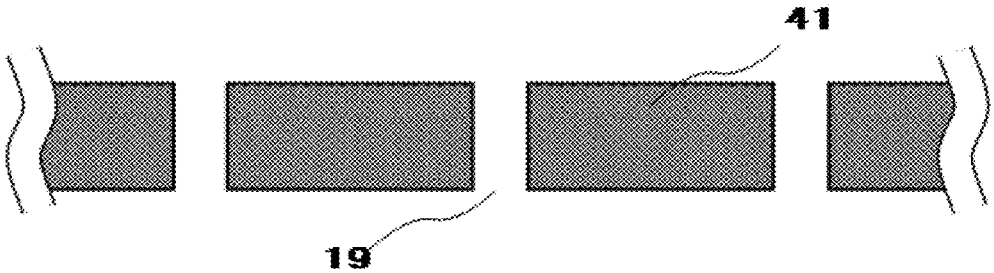
FIG. 5C is a schematic view illustrating one exemplary shape of a discharging hole viewed from a cross-section of a liquid-column resonance liquid-chamber.

In FIG. 5B, the discharging holes 19 have a shape in which the opening diameter of the discharging holes 19 decreases from the liquid-contact surfaces to the discharge ports at a constant angle. This nozzle angle 24 can be changed appropriately. It is possible by the action of the nozzle angle to increase pressure to be applied to the liquid adjacent to the exits of the discharging holes 19 when thin films 41 vibrate, like the shape illustrated in FIG. 5A. The nozzle angle is preferably from 60° through 90°. The nozzle angle of 60° or less is unfavorable because pressure is less likely to be applied to the liquid and the thin films 41 are difficult to process. FIG. 5C illustrates the discharging holes 19 in the case of the nozzle angle 24 of 90°. Pressure is less likely to be applied to the exits as the nozzle angle increases. Therefore, the nozzle angle of 90° is the largest possible value. When the nozzle angle is 90° or greater, no pressure is applied to the exits of holes 12, leading to very unstable discharging of the liquid droplets.

Figure 5D:
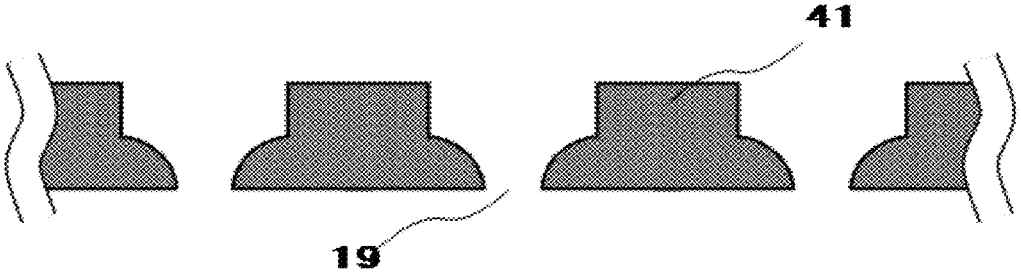
FIG. 5D is a schematic view illustrating one exemplary shape of a discharging hole viewed from a cross-section of a liquid-column resonance liquid-chamber.

In FIG. 5D, the discharging holes 19 have a combined shape of the shape illustrated in FIG. 5A with the shape illustrated in FIG. 5B. The shape of the discharging holes 19 may be varied stepwise in this way.

—Mechanism of Liquid Droplet Formation—

A mechanism by which liquid droplets are formed by the liquid-droplet forming unit utilizing the liquid column resonance will now be described.

Firstly, the principle of a liquid-column resonance phenomenon that occurs in the liquid-column resonance liquid-chamber 18 of the liquid-column resonance liquid-droplet discharging means 11 illustrated in FIG. 3 will now be described. A wavelength λ at which liquid resonance occurs is determined according to (Expression 1):

$$\lambda = c/f \quad \text{(Expression 1)}$$

where c denotes sound velocity of the toner component liquid in the liquid-column resonance liquid-chamber; and f denotes a driving frequency applied by the vibration generating means 20 to the toner composition liquid 14 serving as a medium.

In the liquid-column resonance liquid-chamber 18 of FIG. 3, a length from a frame end at a fixed end side to an end at a common liquid supplying-path 17 side is represented as L. A height h1 (=about 80 μm) of the frame end at the common liquid supplying-path 17 side is set to about 2 times as high as a height h2 (=about 40 μm) of a communication port. In the case where both ends are considered to be fixed, that is, the end at the common liquid supplying-path 17 side is considered to be equivalent to a closed fixed end, resonance is most efficiently formed when the length L corresponds to an even multiple of ¼ of the wavelength λ. This can be represented by the following (Expression 2):

$$L = (N/4)\lambda \quad \text{(Expression 2)}$$

where N denotes an even number.

The (Expression 2) is also satisfied when the both ends are free, that is, the both ends are completely opened.

Likewise, when one end is equivalent to a free end from which pressure is released, and the other end is closed (fixed end), that is, when one of the ends is fixed or one of the ends is free, resonance is most efficiently formed when the length L corresponds to an odd multiple of ¼ of the wavelength λ. That is, N in the (Expression 2) denotes an odd number.

The most efficient driving frequency f is determined according to (Expression 3) which is derived from the (Expression 1) and the (Expression 2):

$$f = N \times c/(4L) \quad \text{(Expression 3)}$$

where

L denotes a length of the liquid-column resonance liquid-chamber in a longitudinal direction;

c denotes sound velocity of the toner component liquid; and

N denotes an integer.

However, actually, vibration is not amplified unlimitedly because liquid has viscosity which attenuates resonance. Therefore, the resonance has a Q factor, and also occurs at a frequency adjacent to the most efficient driving frequency f calculated according to the (Expression 3), as represented by (Expressions 4) and (Expression 5) described below.

Figure 6A:
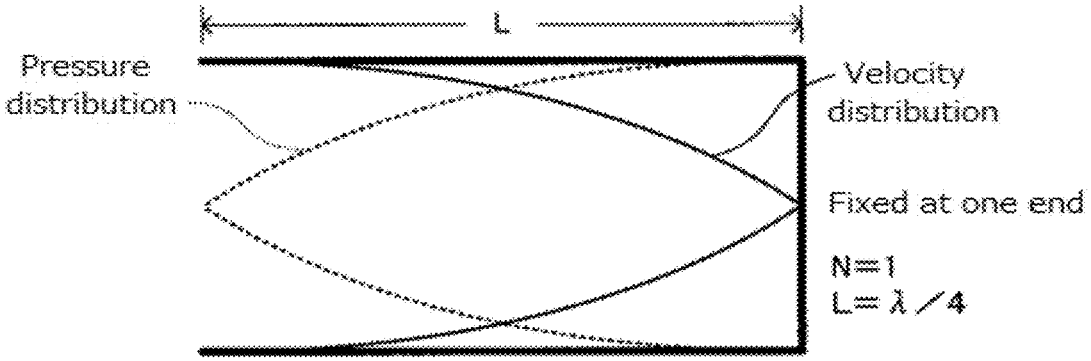
FIG. 6A is a schematic, explanatory graph illustrating a standing wave of velocity fluctuation and a standing wave of pressure fluctuation when a liquid-column resonance liquid-chamber is fixed at one end and N=1.
Figure 6B:
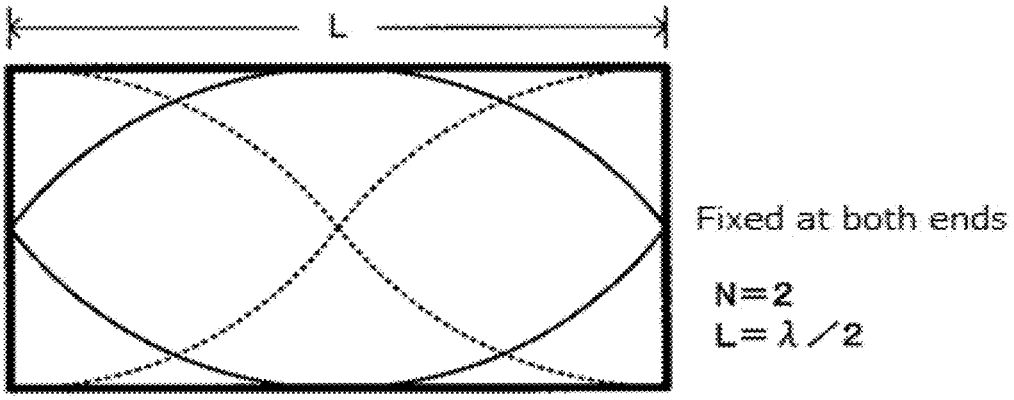
FIG. 6B is a schematic, explanatory graph illustrating a standing wave of velocity fluctuation and a standing wave of pressure fluctuation when a liquid-column resonance liquid-chamber is fixed at both ends and N=2.
Figure 6C:
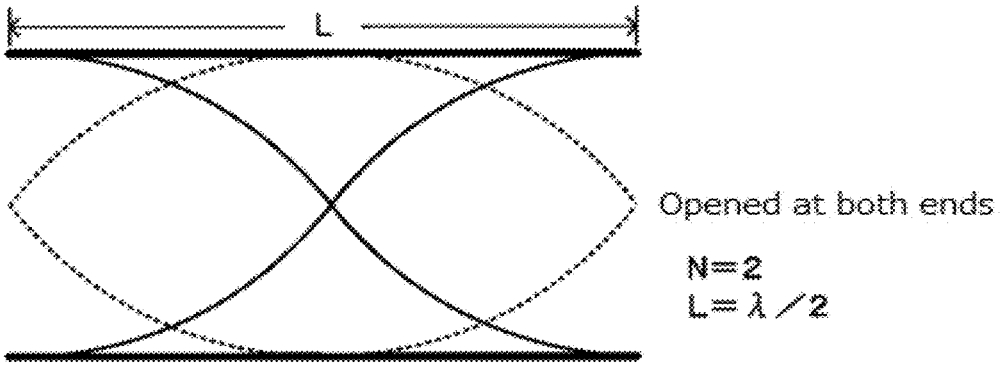
FIG. 6C is a schematic, explanatory graph illustrating a standing wave of velocity fluctuation and a standing wave of pressure fluctuation when a liquid-column resonance liquid-chamber is free at both ends and N=2.
Figure 6D:
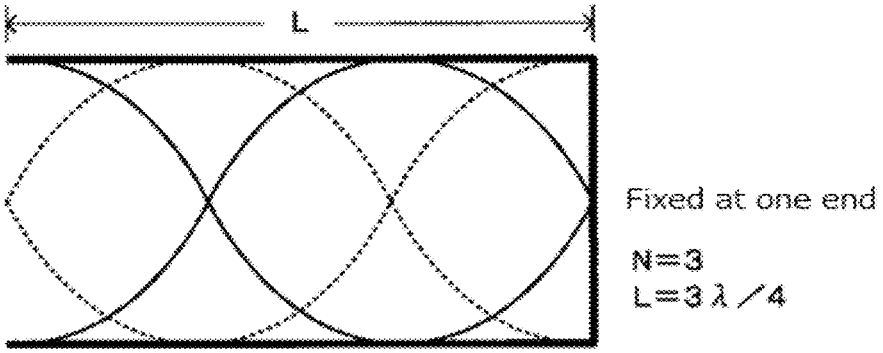
FIG. 6D is a schematic, explanatory graph illustrating a standing wave of velocity fluctuation and a standing wave of pressure fluctuation when a liquid-column resonance liquid-chamber is fixed at one end and N=3.

FIGS. 6A to 6D illustrate shapes of standing waves of velocity and pressure fluctuation (resonance mode) when N=1, 2, and 3. FIGS. 6A to 6C illustrate shapes of standing waves of velocity and pressure fluctuation (resonance mode) when N=4 and 5.

A standing wave is actually a compressional wave (longitudinal wave), but is commonly expressed as illustrated in FIGS. 6A to 6D and 7A to 7C. In FIGS. 6A to 6D and 7A to 7C, a solid line represents a velocity standing wave and a dotted line represents a pressure standing wave.

For example, as can be seen from FIG. 4A in which one end is fixed and N=1, an amplitude of a velocity distribution is zero at a closed end and the maximum at an opened end, which is understandable intuitively.

Assuming that a length between both ends of the liquid-column resonance liquid-chamber in a longitudinal direction is L and a wavelength at which liquid column resonance of liquid occurs is λ; the standing wave most efficiently occurs when the integer N is from 1 through 5. A standing wave pattern varies depending on whether each end is opened or closed. Therefore, standing wave patterns in various opening/closing conditions are also described in the drawings. As described below, conditions of the ends are determined depending on states of openings of the discharge holes and states of openings at a supply side.

Note that, in the acoustics, an opened end refers to an end at which moving velocity of a medium (liquid) is zero in a longitudinal direction, but pressure of the medium (liquid) reaches the local maximum. Conversely, a closed end is defined as an end at which moving velocity of a medium is zero. The closed end is considered as an acoustically hard wall and reflects a wave. When an end is ideally perfectly closed or opened, resonance standing waves as illustrated in FIGS. 6A to 6D and 7A to 7C are formed by superposition of waves. Standing wave patterns vary depending on the number of the discharge holes and positions at which the discharge holes are opened. Therefore, a resonance frequency appears in a position shifted from a position determined according to the (Expression 3). However, stable discharging conditions can be created by appropriately adjusting the driving frequency.

For example, assuming that sound velocity c of the liquid is 1,200 m/s, a length L of the liquid-column resonance liquid-chamber is 1.85 mm, and a resonance mode in which both ends are completely equivalent to fixed ends due to the presence of walls on the both ends and N=2 is used; the most efficient resonance frequency is calculated as 324 kHz from the (Expression 2).

In another example, assuming that the sound velocity c of the liquid is 1,200 m/s and the length L of the liquid-column resonance liquid-chamber is 1.85 mm, these conditions are the same as above, and a resonance mode in which both ends are equivalent to fixed ends due to the presence of walls at the both ends and N=4 is used; the most efficient resonance frequency is calculated as 648 kHz from the (Expression 2). Thus, a higher-order resonance can be utilized even in a liquid-column resonance liquid-chamber having the same configuration.

Figure 7A:
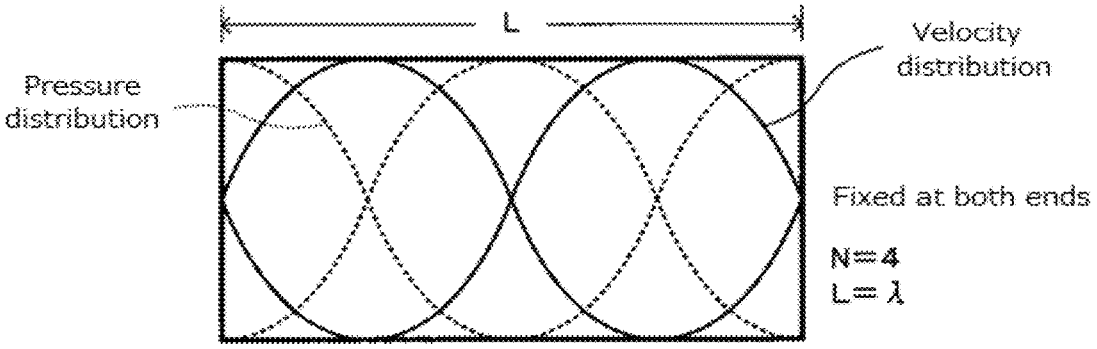
FIG. 7A is a schematic, explanatory graph illustrating a standing wave of velocity fluctuation and a standing wave of pressure fluctuation when a liquid-column resonance liquid-chamber is fixed at both ends and N=4.
Figure 7B:
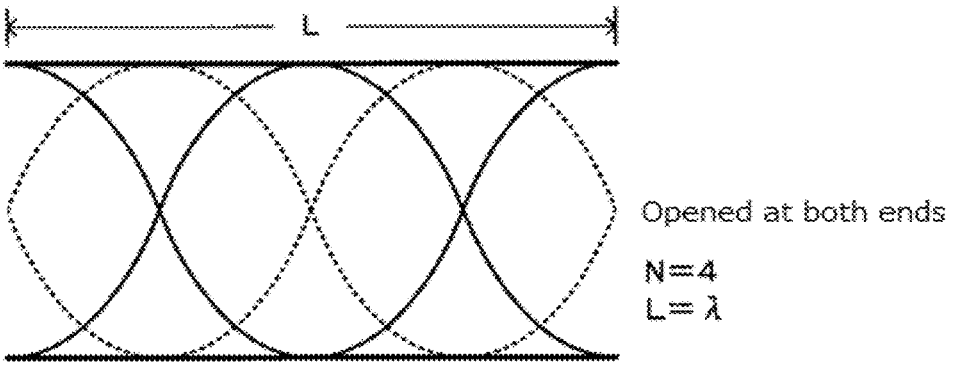
FIG. 7B is a schematic, explanatory graph illustrating a standing wave of velocity fluctuation and a standing wave of pressure fluctuation when a liquid-column resonance liquid-chamber is free at both ends and N=4.
Figure 7C:
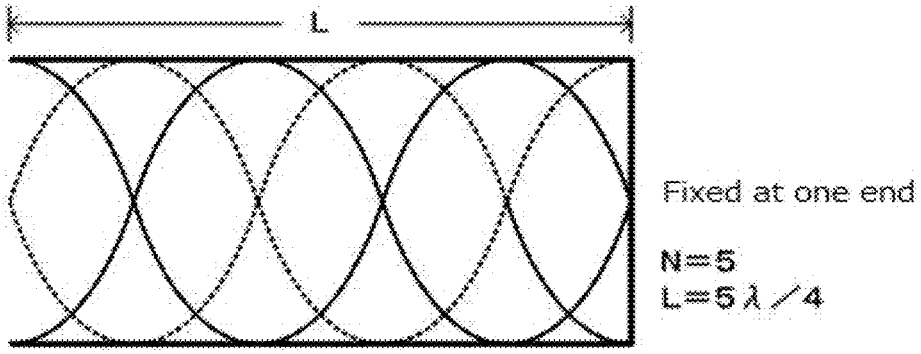
FIG. 7C is a schematic, explanatory graph illustrating a standing wave of velocity fluctuation and a standing wave of pressure fluctuation when a liquid-column resonance liquid-chamber is fixed at one end and N=5.

In order to increase the frequency, the liquid-column resonance liquid-chamber 18 of the liquid-column resonance liquid-droplet discharging means 11 illustrated in FIG. 3 preferably has both ends which are equivalent to a closed end or are considered as an acoustically soft wall due to influence from openings of the discharge holes 19. However, the both ends may be free. The influence from openings of the discharge holes 19 means decreased acoustic impedance and, in particular, increased compliance component. Therefore, the configuration in which walls are formed at both ends of the liquid-column resonance liquid-chamber 18 in a longitudinal direction, as illustrated in FIGS. 6B and 7A, is preferable because both of a resonance mode in which both ends are fixed and a resonance mode in which one of ends is free, that is, an end at a discharge hole side is considered to be opened can be used.

The number of openings of the discharge holes 19, positions at which the openings are disposed, and cross-sectional shapes of the discharge holes are also factors which determine the driving frequency. The driving frequency can be appropriately determined based on these factors.

For example, when the number of the discharge holes 19 is increased, the liquid-column resonance liquid-chamber 18 gradually becomes free at an end which has been fixed. As a result, a resonance standing wave which is approximately the same as a standing wave at an opened end occurs and the driving frequency is increased. Further, the end which has been fixed becomes free starting from a position at which an opening of the discharge hole 19 that is the closest to the liquid supplying-path 17 is disposed. As a result, a cross-sectional shape of the discharge hole 19 is changed to a rounded shape or a volume of the discharge hole is varied depending on a thickness of the frame, so that an actual standing wave has a shorter wavelength and a higher frequency than the driving frequency. When a voltage is applied to the vibration generating means at the driving frequency determined as described above, the vibration generating means 20 deforms and the resonance standing wave occurs most efficiently at the driving frequency. The liquid-column resonance standing-wave also occurs at a frequency adjacent to the driving frequency at which the resonance standing wave occurs most efficiently. That is, assuming that a length between both ends of the liquid-column resonance liquid-chamber in a longitudinal direction is L and a distance to a discharge hole 19 that is the closest to an end at the common liquid supplying-path 17 side is Le; the driving frequency f can be determined according to the following (Expression 4) and (Expression 5) using both of the lengths L and Le. A driving waveform having, as a main component, the driving frequency f can be used to vibrate the vibration generating means and induce the liquid column resonance to discharge the liquid droplets from the discharge holes.

$$N\times c/(4L)\leq f\leq N\times c/(4Le) \quad \text{(Expression 4)}$$

$$N\times c/(4L)\leq f\leq (N+1)\times c/(4Le) \quad \text{(Expression 5)}$$

where

L denotes a length of the liquid-column resonance liquid-chamber in a longitudinal direction;

Le denotes a distance to a discharging hole that is the closest to an end at a liquid supplying side;

c denotes velocity of an acoustic wave of a toner composition liquid; and

N denotes an integer.

Note that, a ratio of the length L between both ends of the liquid-column resonance liquid-chamber in a longitudinal direction to the distance Le to the discharge hole that is the closest to the end at the liquid supplying side preferably satisfies: Le/L>0.6.

Based on the principle of the liquid-column resonance phenomenon described above, a liquid column resonance pressure standing wave is formed in the liquid-column resonance liquid-chamber 18 illustrated in FIG. 3, and the liquid droplet are continuously discharged from the discharge holes 19 disposed in a portion of the liquid-column resonance liquid-chamber 18. Note that, the discharge holes 19 are preferably disposed at positions at which pressure of the standing wave vary to the greatest extent from the viewpoints of high discharging efficiency and driving at a lower voltage.

One liquid-column resonance liquid-chamber 18 may include one discharge hole 19, but preferably includes a plurality of discharge holes from the viewpoint of productivity. Specifically, the number of discharge holes is preferably in a range of from 2 through 100. When the number of discharge holes is 100 or less, a voltage to be applied to the vibration generating means 20 when desired liquid droplets are discharged from the discharge holes 19 can be maintained at a low level. As a result, a piezoelectric material can stably behave as the vibration generating means 20. When the plurality of discharge holes 19 are opened, a pitch between the discharge ports is preferably 20 μm or longer but equal to or shorter than the length of the liquid-column resonance liquid-chamber. When the pitch between the discharge ports is 20 μm or more, the possibility that liquid droplets, which are discharged from discharge ports adjacent to each other, collide with each other to form a larger droplet can be decreased. As a result, a toner having an excellent particle diameter distribution can be obtained.

Next, a liquid column resonance phenomenon which occurs in the liquid-column resonance liquid-chamber of a liquid-droplet discharging head of the liquid-droplet forming unit will be described referring to FIGS. 8A to 8E.

Note that, in FIGS. 8A to 8E, a solid line drawn in the liquid-column resonance liquid-chamber represents a velocity distribution plotting velocity at arbitrary measuring positions between an end at the fixed end side and an end at the common liquid supplying path side in the liquid-column resonance liquid-chamber. A direction from the common liquid supplying-path to the liquid-column resonance liquid-chamber is assumed as plus, and the opposite direction is assumed as minus. A dotted line drawn in the liquid-column resonance liquid-chamber represents a pressure distribution plotting pressure at arbitrary measuring positions between an end at the fixed end side and an end at the common liquid supplying path side in the liquid-column resonance liquid-chamber. A positive pressure relative to atmospheric pressure is assumed as plus, and a negative pressure is assumed as minus. In the case of the positive pressure, pressure is applied in a downward direction in the drawings. In the case of negative pressure, pressure is applied in an upward direction in the drawings.

In FIGS. 8A to 8E, as described above, the end at the common liquid supplying-path side is opened, and the height of the frame serving as the fixed end (height h1 in FIG. 3) is about 2 times or more as high as the height of an opening at which the common liquid supplying-path 17 is communicated with the liquid-column resonance liquid-chamber 18 (height h2 in FIG. 3). Therefore, the drawings represent temporal changes of a velocity distribution and a pressure distribution under an approximate condition in which the liquid-column resonance liquid-chamber 18 are approximately fixed at both ends.

Figure 8A:
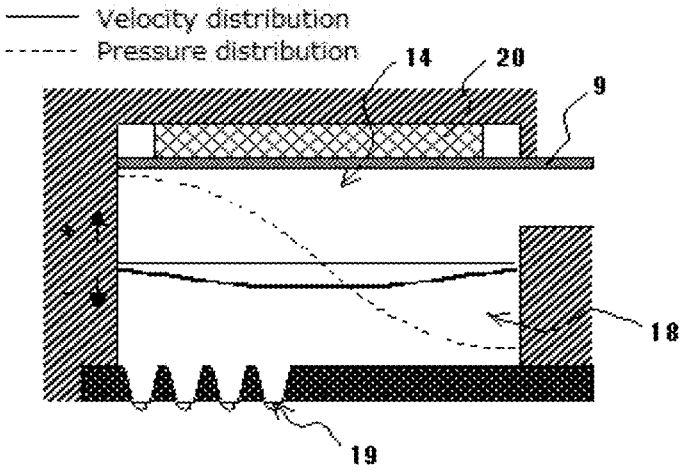
FIG. 8A is a schematic view illustrating a liquid-column resonance phenomenon arising in a liquid-column resonance liquid-chamber in a liquid-column resonance liquid-droplet forming method.
Figure 8B:
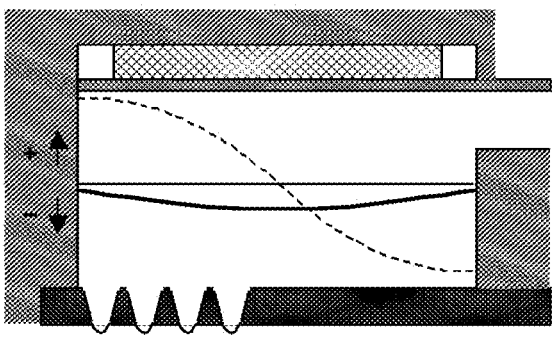
FIG. 8B is a schematic view illustrating a liquid-column resonance phenomenon arising in a liquid-column resonance liquid-chamber in a liquid-column resonance liquid-droplet forming method.
Figure 8C:
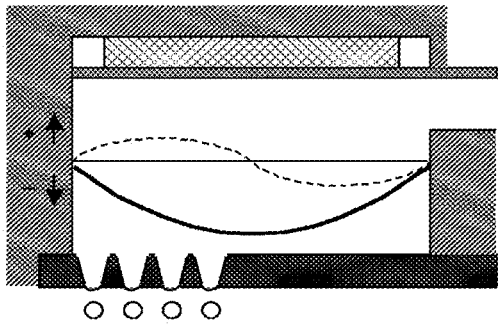
FIG. 8C is a schematic view illustrating a liquid-column resonance phenomenon arising in a liquid-column resonance liquid-chamber in a liquid-column resonance liquid-droplet forming method.

FIG. 8A illustrates a pressure waveform and a velocity waveform in the liquid-column resonance liquid-chamber 18 at a time when liquid droplets are discharged. In FIG. 8B, meniscus pressure is increased again after the liquid droplets are discharged and immediately then the liquid is supplied. As illustrated in FIGS. 8A and 8B, pressure in a flow path, on which the discharge holes 19 are disposed, in the liquid-column resonance liquid-chamber 18 is the local maximum. Then, as illustrated in FIG. 8C, positive pressure adjacent to the discharge holes 19 is decreased and shifted to a negative pressure side. Thus, the liquid droplets 21 are discharged.

Figure 8D:
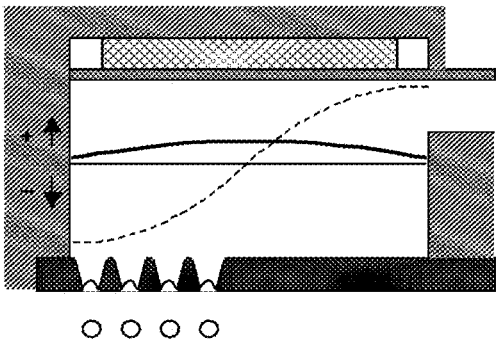
FIG. 8D is a schematic view illustrating a liquid-column resonance phenomenon arising in a liquid-column resonance liquid-chamber in a liquid-column resonance liquid-droplet forming method.
Figure 8E:
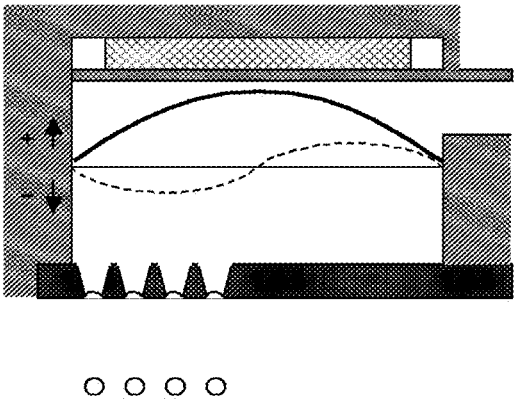
FIG. 8E is a schematic view illustrating a liquid-column resonance phenomenon arising in a liquid-column resonance liquid-chamber in a liquid-column resonance liquid-droplet forming method.

Then, as illustrated in FIG. 8D, the pressure adjacent to the discharge holes 19 is the local minimum. From this time point, the liquid-column resonance liquid-chamber 18 starts to be filled with the toner component liquid 14. Then, as illustrated in FIG. 8E, negative pressure adjacent to the discharge holes 19 is decreased and shifted to a positive pressure side. At this time point, the liquid chamber is completely filled with the toner component liquid 14. Then, as illustrated in FIG. 8A, positive pressure in a liquid-droplet discharging region of the liquid-column resonance liquid-chamber 18 is the local maximum again to discharge the liquid droplets 21 from the discharge holes 19. Thus, the liquid-column resonance standing-wave occurs in the liquid-column resonance liquid-chamber by the vibration generating means driven at a high frequency. The discharge holes 19 are disposed in the liquid-droplet discharging region corresponding to the anti-nodes of the liquid-column resonance standing-wave at which pressure varies to the greatest extent. Therefore, the liquid droplets 21 are continuously discharged from the discharge holes 19 in synchronized with an appearance cycle of the anti-nodes.

<Liquid-Droplet Solidifying Step>

The liquid-droplet solidifying step is a step of solidifying the liquid droplets to form a toner. Specifically, the toner of the present invention can be obtained by solidifying and then collecting the liquid droplets of the toner composition liquid discharged into a gas from the liquid-droplet discharging means.

The solidifying is not particularly limited and may be appropriately selected depending on properties of the toner composition liquid, so long as the toner composition liquid can be made into a solid state. For example, when the toner composition liquid is one in which solid raw materials are dissolved or dispersed in a volatile organic solvent, the toner composition liquid can be solidified by drying the liquid droplets, that is, by volatilizing the solvent in a conveying gas stream after the liquid droplets are jetted. For drying the organic solvent, the degree of drying can be adjusted by appropriately selecting a temperature, a vapor pressure, a kind of a gas to which the liquid droplets are jetted. The liquid droplets need not be dried completely, so long as collected liquid droplets are maintained in a solid state. The collected liquid droplets may be additionally dried in a separate step. The liquid droplets may be solidified by subjecting to temperature variation or a chemical reaction.

In the present invention, it is necessary to recrystallize the release agent that has dissolved during solidifying of the liquid droplets and grow the thus-recrystallized release agent so as to have number average particle diameters satisfying the following relationship: WDa<WDb<WDc.

The first means for recrystallizing and growing the release agent is to dry the liquid droplets under an atmosphere adjusted to a temperature of (Recrystallization temperature of release agent (Tc)−5°) C. or higher. Alternatively, as the second means, when the temperature is lower than the (Recrystallization temperature of release agent (Tc)−5°) C., the liquid droplets may be dried under an environment where a relative humidity in terms of an organic solvent in the toner composition liquid is adjusted to a range of from 10% through 40%.

That is, the method for producing a toner of the present invention is characterized by the followings: the binder resin and the release agent are dissolved in the toner composition liquid without phase separation; an environmental temperature during the liquid-droplet solidifying step is the (Recrystallization temperature of release agent (Tc)−5°) C. or higher where Tc (° C.) denotes a recrystallization temperature of the release agent as determined by the DSC method; and the binder resin and the release agent are phase-separated in toner particles which are produced by solidifying the liquid droplets.

Alternatively, the method for producing a toner of the present invention is characterized by the followings: the binder resin and the release agent are dissolved in the toner composition liquid without phase separation; an environmental temperature during the liquid-droplet solidifying step is less than the (Recrystallization temperature of release agent (Tc)−5°) C. where Tc (° C.) denotes a recrystallization temperature of the release agent as determined by the DSC method and an environmental relative humidity during the liquid-droplet solidifying step in terms of an organic solvent in the toner composition liquid is in a range from 10% through 40%; and the binder resin and the release agent are phase-separated in toner particles which are produced by solidifying the liquid droplets.

In both methods, the release agent can be grown to a sufficiently large crystalline domain by slowing down a speed for recrystallizing the release agent or a speed for drying the organic solvent.

The recrystallization temperature of the release agent can be determined according to the DSC method. In the present invention, the recrystallization temperature is defined as a peak temperature of an exothermic peak that is observed when heating to 150° C. at a heating rate of 10° C./min and then cooling to 0° C. at a cooling rate of 10° C./min.

When the environmental temperature is lower than the (Recrystallization temperature of release agent (Tc)−5°) C., a release agent having a sufficient length or a sufficient degree of branch is less likely to be formed because the speed for recrystallizing is increased.

In the second method, the relative humidity in terms of an organic solvent in the toner composition liquid of lower than 10% is not preferable. This is because the speed for drying the organic solvent is increased and recrystallization of the release agent is promoted, so that a relatively small domain of the release agent is more likely to be formed. On the other hand, when the relative humidity is higher than 40%, the speed for drying the organic solvent is significantly decreased to promote coalescence and fusion of the toner particles during drying. Therefore, a toner having a desired particle size distribution is less likely to be obtained.

In the liquid-droplet solidifying step, the organic solvent and the toner composition liquid may be heated to dissolve the release agent. However, in order to achieve stable, continuous discharging of the liquid droplets, a temperature of the toner composition liquid under an environmental temperature of the liquid-droplet solidifying step is preferably lower than (Tb−15°) C. where Tb (° C.) denotes a boiling point of the organic solvent.

When the temperature is lower than (Tb−15°) C., the liquid droplets can be stably discharged without generating bubbles in the toner composition liquid due to evaporation of the organic solvent or without narrowing discharging holes due to drying of the toner composition liquid adjacent to the discharging holes.

The release agent needs to be dissolved in the toner composition liquid in order to prevent the discharging holes from clogging. In order to obtain uniform toner particles, it is important for the release agent to be dissolved in the toner composition liquid without phase-separation from the binder resin which is also dissolved in the toner composition liquid. Meanwhile, in order for the release agent to exert releasability during fixing to prevent offset, it is important that the binder resin and the release agent are phase-separated from each other in the toner particles from which the organic solvent has been removed. When the release agent is not phase-separated from the binder resin, the release agent cannot exert releasability, and the binder resin is deteriorated in viscosity or elasticity during melting. Thus, hot-offset is more likely to occur.

Therefore, an optimal release agent is selected depending on an organic solvent or a binder resin to be used.

<<Solidified-Particle Collecting Means>>

The collecting is not particularly limited and may be appropriately selected. For example, solidified particles can be collected from the gas by known powder collecting means such as cyclone collectors and back filters.

<Embodiment of Toner Producing Apparatus of the Present Invention>

A toner producing apparatus used in the method for producing a toner of the present invention will now be described in detail referring to FIG. 9.

Figure 9:
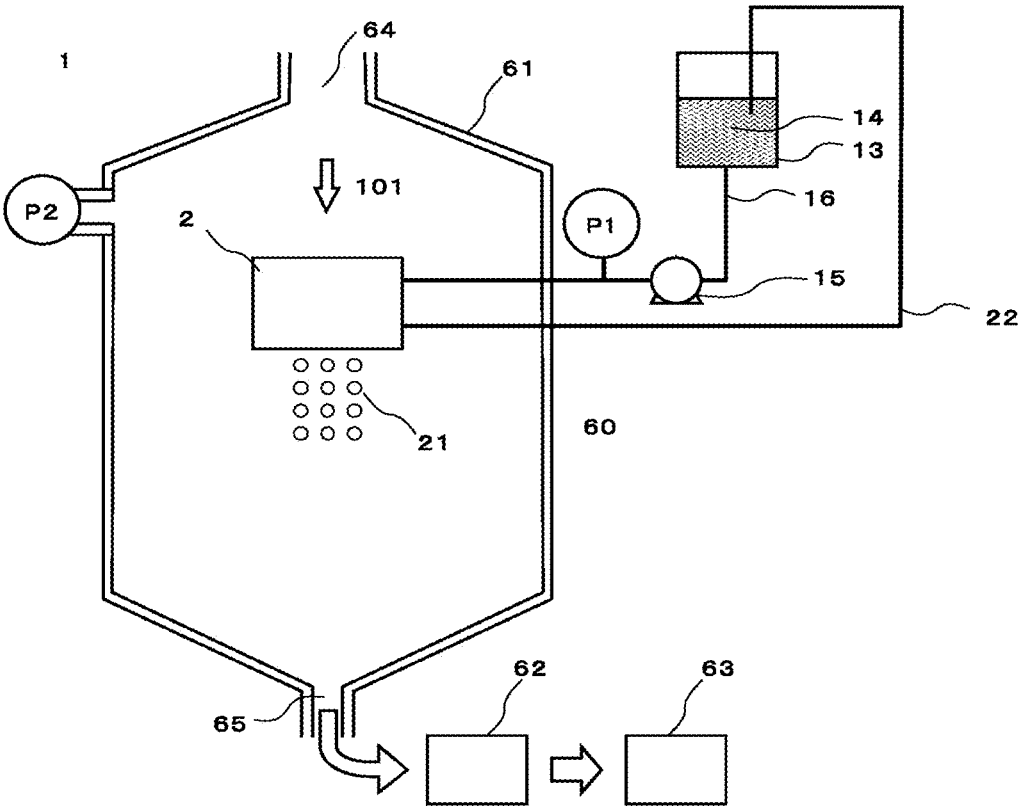
FIG. 9 is a schematic, cross-sectional view illustrating one exemplary toner producing apparatus used in a method for producing a toner of the present invention.

The toner producing apparatus 1 in FIG. 9 includes a liquid-droplet discharging means 2 and a solidifying and collecting unit 60.

The liquid-droplet discharging means 2 is coupled to a raw material container 13 and a liquid circulating pump 15, and is configured to supply the toner component liquid 14 to the liquid-droplet discharging means 2 at any time. The raw material container is configured to store the toner component liquid 14. The liquid circulating pump is configured to supply the toner component liquid 14 stored in the raw material container 13 into the liquid-droplet discharging means 2 through a liquid supplying pipe 16 and to apply pressure to the toner component liquid 14 in the liquid supplying pipe 16 to return the toner component liquid to the raw material container 13 through a liquid returning pipe 22. The liquid supplying pipe 16 includes a pressure gauge P1, and a drying/collecting unit includes a pressure gauge P2. Pressure at which the liquid is fed into the liquid-droplet discharging means 2 is managed by the pressure gauge P1, and pressure inside the drying/collecting unit is managed by the pressure gauge P2. When P1>P2, the toner component liquid 1 may disadvantageously leak out from the holes 12. When P1<P2, a gas may disadvantageously enter the discharging means to cause the liquid droplets not to be discharged. Therefore, the relationship P1 P2 is preferably satisfied.

A descending gas stream 101 from a conveying-gas-stream inlet-port 64 is formed within a chamber 61. The liquid droplets 21 discharged from the liquid-droplet discharging means 2 are conveyed downward not only by gravity but also by a conveying gas stream 101, and then collected by a solidified-particle collecting means 62.

—Conveying Gas Stream—

The following should be noted with regard to conveying gas stream.

When jetted liquid droplets are brought into contact with each other prior to drying, the jetted liquid droplets are aggregated into one particle (hereinafter, this phenomenon may be referred to as coalescence). In order to obtain solidified particles having a uniform particle diameter distribution, it is necessary to keep the jetted liquid droplets apart from each other. However, the liquid droplets are jetted at a certain initial velocity, but gradually slowed down due to air resistance. Therefore, the subsequent liquid droplets catch up with and coalesce with the preceding liquid droplets having been slowed down. This phenomenon occurs constantly. When the thus-coalesced particles are collected, the collected particles have a very poor particle diameter distribution. In order to prevent the liquid droplets from coalescing with each other, the liquid droplets are needed to be solidified and conveyed simultaneously, while preventing, by the action of the conveying gas stream 101, the liquid droplets from slowing down and from contacting with each other. Eventually, the resultant particles are conveyed to the solidified-particle collecting means 62.

Figure 10:
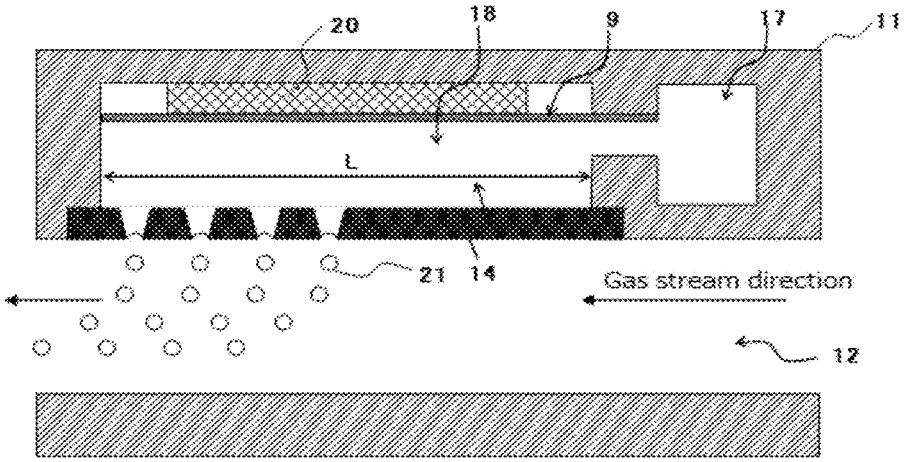
FIG. 10 is a schematic view illustrating another exemplary gas stream path.

For example, as illustrated in FIG. 3, when a portion of the conveying gas stream 101 is orientated in the same direction as a liquid-droplet discharging direction, as a first gas stream, adjacent to the liquid-droplet discharging means, the liquid droplets can be prevented from slowing down immediately after the liquid droplets are discharged. As a result, the liquid droplets can be prevented from coalescing with each other. Alternatively, the gas stream may be orientated in a direction transverse to the liquid-droplet discharging direction, as illustrated in FIG. 10. Alternatively, although not illustrated, the gas stream may be oriented at an angle, the angle being desirably determined so as to discharge the liquid droplets in a direction away from the liquid-droplet discharging means. When a coalescing preventing air-stream is orientated in the direction transverse to the liquid-droplet discharging direction as illustrated in FIG. 10, the coalescing preventing air-stream is preferably orientated in a direction in which trajectories of the liquid droplets do not overlap with each other when the liquid droplets are conveyed from the discharging ports by the coalescing preventing air-stream.

After coalescing is prevented with the first gas stream as described above, the solidified particles may be conveyed to the solidified-particle collecting means by a second gas stream.

A velocity of the first gas stream is desirably equal to or higher than a velocity at which the liquid droplets are jetted. When a velocity of the coalescing preventing air-stream is lower than the velocity at which the liquid droplets are jetted, the coalescing preventing air-stream is difficult to exert a function of preventing the liquid droplet particles from contacting with each other, the function being the essential purpose of the coalescing preventing air-stream.

The first gas stream may have an additional property so as to prevent the liquid droplets from coalescing with each other. The first gas stream may not necessarily have the same properties as the second gas stream. The coalescing preventing air-stream may be added with a chemical substance that promotes solidification of surfaces of the particles, or may be subjected to physical treatment.

The conveying gas stream 101 is not particularly limited in terms of a state of gas stream. Examples of the state include laminar flow, swirl flow, and turbulent flow. A kind of a gas constituting the conveying gas stream 101 is not particularly limited. Examples of the kind include air and incombustible gases (e.g., nitrogen). A temperature of the conveying gas stream 101 may be adjusted appropriately, and is desirably constant during production. The chamber 61 may include a means configured to change the state of the conveying gas stream 101. The conveying gas stream 101 may be used not only for preventing the liquid droplets 21 from coalescing with each other but also for preventing the liquid droplets from depositing on the chamber 61.

<Other Steps>

The method for producing a toner of the present invention may further include a secondary drying step.

When toner particles collected by the solidified-particle collecting means 62 illustrated in FIG. 9 includes a large amount of a residual solvent, secondary drying is performed in order to reduce the residual solvent, if necessary.

The secondary drying is not particularly limited, and may be performed using commonly known drying means such as fluid bed drying and vacuum drying. When an organic solvent remains in the toner, properties of the toner (e.g., heat resistant storability, fixability, and chargeability) are changed over time. Additionally, the organic solvent is volatilized during heat-fixing, which increases the possibility that users and peripheral devices are adversely affected. Therefore, the toner particles need to be sufficiently dried.

(Developer)

A developer of the present invention includes at least the toner of the present invention; and, if necessary, further includes other components such as a carrier.

The toner of the present invention obtained as described above can be suitably used for a one-component developer or a two-component developer which is obtained by mixing the toner with a carrier. In particular, the toner of the present invention can be effectively used for a one-component developer because the toner has improved particle strength, can be prevented from being crushed by a blade, and is excellent in adherence resistance.

<Carrier>

The carrier is not particularly limited and may be appropriately selected depending on the intended purpose. Examples of the carrier include carriers such as ferrite and magnetite, and resin-coated carriers.

The resin-coated carriers are formed of carrier core particles, and resin coating materials that are resins for covering (coating) surfaces of the carrier core particles.

Suitable examples of resins used for the coating materials include styrene/acrylic-based resins such as styrene/acrylic acid ester copolymers and styrene/methacrylic acid ester copolymers; acrylic-based resins such as acrylic acid ester copolymers and methacrylic acid ester copolymers; fluorine-containing resins to such as polytetrafluoroethylene, monochlorotrifluoroethylene polymers, and polyvinylidene fluoride; silicone resins; polyester resins; polyamide resins; polyvinyl butyral; and amino acrylate resins. Other examples include resins usable as coating materials for the carriers, such as ionomer resins and polyphenylene sulfide resins. These may be used alone or in combination.

Binder-type carrier cores, which are obtained by dispersing magnetic powder in resins, may also be used as the carriers.

In the resin-coated carriers, examples of a method for coating surfaces of the carrier cores with at least a resin coating agent include a method in which a resin is dissolved or dispersed in a solvent and the resultant solution or dispersion liquid is applied onto the carrier cores to deposit the resin on the carrier cores, and a method in which a resin and the carrier cores are simply mixed in powder states.

A rate of the resin coating material relative to the resin-coated carrier is not particularly limited and may be appropriately selected depending on the intended purpose, but is preferably from 0.01 parts by mass through 5 parts by mass, more preferably from 0.1 parts by mass through 1 part by mass relative to 100 parts by mass of the resin-coated carrier.

When the resin coating materials is a mixture of two or more kinds of the resin coating materials, the magnetic material may be coated with the mixture, for example, in the following manners (1) and (2):

(1) 100 parts by mass of titanium oxide powder is treated with 12 parts by mass of a mixture of dimethyldichlorosilane and dimethylsilicone oil (mass ratio: 1:5); and (2) 100 parts by mass of silica powder is treated with 20 parts by mass of a mixture of dimethyldichlorosilane and dimethylsilicone oil (mass ratio: 1:5).

For example, styrene/methyl methacrylate copolymers, mixtures of fluorine-containing resins and styrene-based copolymers, and silicone resins are preferably used as the resin coating material. Among them, silicone resins are particularly preferable.

Examples of the mixtures of fluorine-containing resins and styrene-based copolymers include mixtures of polyvinylidene fluoride and styrene/methyl methacrylate copolymers; mixture of polytetrafluoroethylene and styrene/methyl methacrylate copolymers; and mixture of vinylidene fluoride/tetrafluoroethylene copolymers (copolymer mass ratio: from 10:90 through 90:10), styrene/2-ethylhexyl acrylate copolymers (copolymer mass ratio: from 10:90 through 90:10), and styrene/2-ethylhexyl acrylate/methyl methacrylate copolymers (copolymer mass ratio: from 20 through 60: from 50 through 30:10:50). Examples of the silicone resins include modified silicone resins produced by reacting nitrogen-containing silicone resins and nitrogen-containing silane coupling-agents with silicone resins.

Examples of the magnetic materials as the carrier cores include oxides such as ferrite, iron-overload ferrite, magnetite, and γ-iron oxide; and metals such as iron, cobalt, and nickel, and alloys of the metals. Examples of elements included in the magnetic materials include iron, cobalt, nickel, aluminum, copper, lead, magnesium, tin, zinc, antimony, beryllium, bismuth, calcium, manganese, selenium, titanium, tungsten, and vanadium. Among these magnetic materials, copper/zinc/iron-based ferrite which is mainly made of copper, zinc, and iron or manganese/magnesium/iron-based ferrite which is mainly made of manganese, magnesium, and iron are suitable.

A volume resistance value of the carriers can be set by appropriately adjusting the degree of unevenness on surfaces of the carriers and an amount of a resin with which the carriers are coated. For example, volume resistance is preferably from $10^6$ Ω·cm through $10^{10}$ Ω·cm.

A particle diameter of the carriers is not particularly limited and may be appropriately selected depending on the intended purpose, but is preferably from 4 μm through 200 μm, more preferably from 10 μm through 150 μm, further preferably from 20 μm through 100 μm. Among them, in the case of the resin-coated carriers, a 50% particle diameter is particularly preferably from 20 μm through 70 μm. In a two-component developer, the toner of the present invention is preferably used in an amount of from 1 part by mass through 200 parts by mass relative to 100 parts by mass of the carrier, and more preferably used in an amount of from 2 parts by mass through 50 parts by mass relative to 100 parts by mass of the carrier.

(Image Forming Apparatus and Image Forming Method)

An image forming apparatus of the present invention includes at least an electrostatic latent image bearer, an electrostatic-latent-image-forming means, and a developing means; and, if necessary, further includes other means.

An image forming method according to the present invention includes at least an electrostatic-latent-image-forming step and a developing step; and, if necessary, further includes other steps.

The image forming method can suitably be performed by the image forming apparatus. The electrostatic-latent-image-forming step can suitably be performed by the electrostatic-latent-image-forming means. The developing step can suitably be performed by the developing means. The other steps can suitably be performed by the other means.

<Electrostatic Latent Image Bearer>

A material, a structure, and a size of the electrostatic latent image bearer are not particularly limited and may be appropriately selected from those known in the art. Examples of the material of the electrostatic latent image bearer include inorganic photoconductors (e.g., amorphous silicon and selenium) and organic photoconductors (e.g., polysilane and phthalopolymethine). Among them, amorphous silicon is preferable from the viewpoint of long service life.

The amorphous silicon photoconductor may be a photoconductor which is produced by heating a support to be a temperature of from 50° C. through 400° C. and then forming a photoconductive layer of a-Si on the support through film formation methods (e.g., vacuum vapor deposition, sputtering, ion plating, thermal CVD (Chemical Vapor Deposition), photo-CVD, and plasma CVD). Among them, suitable is the plasma CVD; i.e., a method in which gaseous raw materials are decomposed through application of direct current or high frequency or through microwave glow discharge, to form an a-Si deposited film on the support.

A shape of the electrostatic latent image bearer is not particularly limited and may be appropriately selected depending on the intended purpose, but is preferably cylindrical. An outer diameter of the cylindrical electrostatic latent image bearer is not particularly limited and may be appropriately selected depending on the intended purpose, but is preferably from 3 mm through 100 mm, more preferably from 5 mm through 50 mm, particularly preferably from 10 mm through 30 mm.

<Electrostatic-Latent-Image-Forming Means and Electrostatic-Latent-Image-Forming Step>

The electrostatic-latent-image-forming means is not particularly limited and may be appropriately selected depending on the intended purpose, so long as the electrostatic-latent-image-forming means is configured to form an electrostatic latent image on the electrostatic latent image bearer. Examples of the electrostatic-latent-image-forming means include a means including at least: a charging member configured to charge a surface of the electrostatic latent image bearer; and an exposure member configured to imagewise expose the surface of the electrostatic latent image bearer to light.

The electrostatic-latent-image-forming step is not particularly limited and may be appropriately selected depending on the intended purpose, so long as the electrostatic-latent-image-forming step is a step of forming an electrostatic latent image on the electrostatic latent image bearer. The electrostatic-latent-image-forming step can be performed using the electrostatic-latent-image-forming means by, for example, charging a surface of the electrostatic latent image bearer and then imagewise exposing the surface to light.

<<Charging Member and Charging>>

The charging member is not particularly limited and may be appropriately selected depending on the intended purpose. Examples of the charging member include contact chargers known per se including a conductive or semi-conductive roller, brush, film and rubber blade; and non-contact chargers utilizing corona discharge such as corotron and scorotron.

The charging can be performed by, for example, applying voltage to a surface of the electrostatic latent image bearer using the charging member.

The charging member may have any shape such as a magnetic brush or a fur brush as well as a roller. The shape of the charging member may be selected according to the specification or configuration of the image forming apparatus.

The charging member is not limited to the contact charging members as described above. However, the contact charging members are preferably used because it is possible to produce an image forming apparatus in which a lower amount of ozone is generated from the charging member.

<<Exposure Member and Exposure>>

The exposure member is not particularly limited and may be appropriately selected depending on the intended purpose, so long as the exposure member can imagewise expose a surface of the electrostatic latent image bearer, which has been charged with the charging member, to light according to an image to be formed. Examples of the exposure member include various exposure members such as copy optical exposure members, rod lens array exposure members, laser optical exposure members, and liquid crystal shutter optical exposure members.

A light source used for the exposure member is not particularly limited and may be appropriately selected depending on the intended purpose. Examples of the light source include light emitters in general such as fluorescent lamps, tungsten lamps, halogen lamps, mercury lamps, sodium lamps, light-emitting diodes (LED), laser diodes (LD), and electroluminescence (EL) devices.

Also, various filters may be used for the purpose of emitting only light having a desired wavelength range. Examples of the filters include sharp-cut filters, band-pass filters, infrared cut filters, dichroic filters, interference filters, and color temperature conversion filters.

The exposure can be performed by, for example, imagewise exposing a surface of the electrostatic latent image bearer to light using the exposure member.

Note that, in the present invention, a back-exposure method may be employed. That is, the electrostatic latent image bearer may be imagewise exposed to light from a back side.

<Developing Means and Developing Step>

The developing means is not particularly limited and may be appropriately selected depending on the intended purpose, so long as the developing means includes a developer and is configured to develop the electrostatic latent image formed on the electrostatic latent image bearer to form a visible image (toner image).

The developing step is not particularly limited and may be appropriately selected depending on the intended purpose, so long as the developing step is a step of developing the electrostatic latent image formed on the electrostatic latent image bearer with a developer to form a visible image (toner image). The developing step can be performed by the developing means.

The developing means may be used in a dry-developing manner or a wet-developing manner, and may be a monochrome developing means or a multi-color developing means.

The developing means preferably includes a stirrer configured to charge the toner by friction generated during stirring; a magnetic-field generating means which is fixed inside the developing means; and a developer bearer configured to be rotatable while bearing a developer including the toner on a surface of the developer bearer.

In the developing means, for example, the toner and the carrier are stirred and mixed, and the toner is charged by friction generated during stirring and mixing. The thus-charged toner is held in the form of a brush on a surface of a rotating magnetic roller to form a magnetic brush. The magnetic roller is disposed adjacent to the electrostatic latent image bearer and thus part of the toner constituting the magnetic brush formed on the surface of the magnet roller is transferred onto a surface of the electrostatic latent image bearer by the action of electrically attractive force. As a result, the electrostatic latent image is developed with the toner to form a visual toner image on the surface of the electrostatic latent image bearer.

<Other Means and Other Steps>

Examples of the other means include a transfer means, a fixing means, a cleaning means, and a charge-eliminating means.

Examples of the other steps include a transfer step, a fixing step, a cleaning step, and a charge-eliminating step.

<<Transfer Means and Transfer Step>>

The transfer means is not particularly limited and may be appropriately selected depending on the intended purpose, so long as the transfer means is configured to transfer the visible image onto a recording medium. Preferably, the transfer means includes a primary transfer means configured to transfer the visible image onto an intermediate transfer member to form a composite transfer image; and a secondary transfer means configured to transfer the composite transfer image onto a recording medium.

The transfer step is not particularly limited and may be appropriately selected depending on the intended purpose, so long as the transfer step is a step of transferring the visible image onto a recording medium. Preferably, the transfer step includes primarily transferring the visible image onto the intermediate transfer member and then secondarily transferring the visible image onto the recording medium.

For example, the transfer step can be performed using the transfer means by charging the photoconductor with a transfer charger to transfer the visible image.

Here, when the image to be secondarily transferred onto the recording medium is a color image made of a plurality of color toners, the transfer step may be performed as follows: the color toners are sequentially superposed on top of another on the intermediate transfer member by the transfer means to form an image on the intermediate transfer member, and then, the image on the intermediate transfer member is secondarily transferred at one time onto the recording medium by the intermediate transfer means.

The intermediate transfer member is not particularly limited and may be appropriately selected from known transfer members depending on the intended purpose. For example, the intermediate transfer member is suitably a transfer belt.

The transfer means (the primary transfer means and the secondary transfer means) preferably includes at least a transfer device configured to transfer the visible image formed on the photoconductor onto the recording medium utilizing peeling charging. Examples of the transfer device include corona transfer devices utilizing corona discharge, transfer belts, transfer rollers, pressing transfer rollers, and adhesive transfer devices.

The recording medium is not particularly limited and may be appropriately selected depending on the intended purpose, so long as a developed but unfixed image can be transferred onto the recording medium. Typically, plain paper is used as the recording medium, but a PET base for OHP can also be used.

<<Fixing Means and Fixing Step>>

The fixing means is not particularly limited and may be appropriately selected depending on the intended purpose, so long as the fixing means is configured to fix a transferred image which has been transferred on the recording medium. The fixing means is preferably a known heating-pressurizing member. Examples of the heating-pressurizing member include a combination of a heat roller and a press roller and a combination of a heat roller, a press roller, and an endless belt.

The fixing step is not particularly limited and may be appropriately selected depending on the intended purpose, so long as the fixing step is a step of fixing a visible image which has been transferred on the recording medium. The fixing step may be performed every time an image of each color toner is transferred onto the recording medium, or at one time (i.e., at the same time) on a superposed image of color toners.

The fixing step can be performed by the fixing means.

The heating-pressurizing member usually performs heating preferably at from 80° C. through 200° C.

Note that, in the present invention, known photofixing devices may be used instead of or in addition to the fixing means depending on the intended purpose.

A surface pressure at the fixing step is not particularly limited and may be appropriately selected depending on the intended purpose, but is preferably from 10 $N/cm^2$ through 80 $N/cm^2$.

<<Cleaning Means and Cleaning Step>>

The cleaning means is not particularly limited and may be appropriately selected depending on the intended purpose, so long as the cleaning means is configured to be able to remove the toner remaining on the photoconductor. Examples of the cleaning means include magnetic brush cleaners, electrostatic brush cleaners, magnetic roller cleaners, blade cleaners, brush cleaners, and web cleaners.

The cleaning step is not particularly limited and may be appropriately selected depending on the intended purpose, so long as the cleaning step is a step of being able to remove the toner remaining on the photoconductor. The cleaning step may be performed by the cleaning means.

<<Charge-Eliminating Means and Charge-Eliminating Step>>

The charge-eliminating means is not particularly limited and may be appropriately selected depending on the intended purpose, so long as the charge-eliminating means is configured to apply a charge-eliminating bias to the photoconductor to charge-eliminate the photoconductor. Examples of the charge-eliminating means include charge-eliminating lamps.

The charge-eliminating step is not particularly limited and may be appropriately selected depending on the intended purpose, so long as the charge-eliminating step is a step of applying a charge-eliminating bias to the photoconductor for charge elimination. The charge-eliminating step may be performed by the charge-eliminating means.

One exemplary aspect of a method for forming an image by an image forming apparatus of the present invention will now be described referring to FIG. 11. A color image forming apparatus 100A illustrated in FIG. 11 includes a photoconductor drum 100 serving as the electrostatic latent image bearer (hereinafter may be referred to as a "photoconductor 100"), a charging roller 200 serving as the charging means, an exposure device 30 serving as the exposure means, a developing device 40 serving as the developing means, an intermediate transfer member 50, a cleaning device 600 including a cleaning blade and serving as the cleaning means, and a charge-eliminating lamp 70 serving as the charge-eliminating means.

The intermediate transfer member 50 is an endless belt and is designed so as to be movable in a direction indicated by the arrow by three rollers 51. The three rollers 51 are disposed inside the belt and the belt is stretched around the three rollers 51. Some of the three rollers 51 also serve as a transfer bias roller which is able to apply a predetermined transfer bias (primary transfer bias) to the intermediate transfer member 50. A cleaning device 90 including a cleaning blade is disposed adjacent to the intermediate transfer member 50. Further, a transfer roller 80 serving as the transfer means is disposed adjacent to the intermediate transfer member 50 so as to face the intermediate transfer member 50. The transfer roller 80 is able to apply a transfer bias for transferring (secondarily transferring) a developed image (toner image) onto a sheet of transfer paper 95 serving as a recording medium. Around the intermediate transfer member 50, a corona charger 58, which is configured to apply charges to a toner image on the intermediate transfer member 50, is disposed between a contact portion of the photoconductor 10 with the intermediate transfer member 50 and a contact portion of the intermediate transfer member 50 with the sheet of the transfer paper 95 in a rotational direction of the intermediate transfer member 50.

The developing device 40 includes a developing belt 410 serving as the developer bearer and developing units arranged around the developing belt 410 (a black developing unit 45K, a yellow developing unit 45Y, a magenta developing unit 45M, and a cyan developing unit 45C). Note that, the black developing unit 45K includes a developer stored container 42K, a developer supply roller 43K, and a developing roller 44K. The yellow developing unit 45Y includes a developer stored container 42Y, a developer supply roller 43Y, and a developing roller 44Y. The magenta developing unit 45M includes a developer stored container 42M, a developer supply roller 43M, and a developing roller 44M. The cyan developing unit 45C includes a developer stored container 42C, a developer supply roller 43C, and a developing roller 44C. Also, the developing belt 410 is an endless belt which is rotatably stretched around a plurality of belt rollers and is partially in contact with the electrostatic latent image bearer 100.

Figure 11:
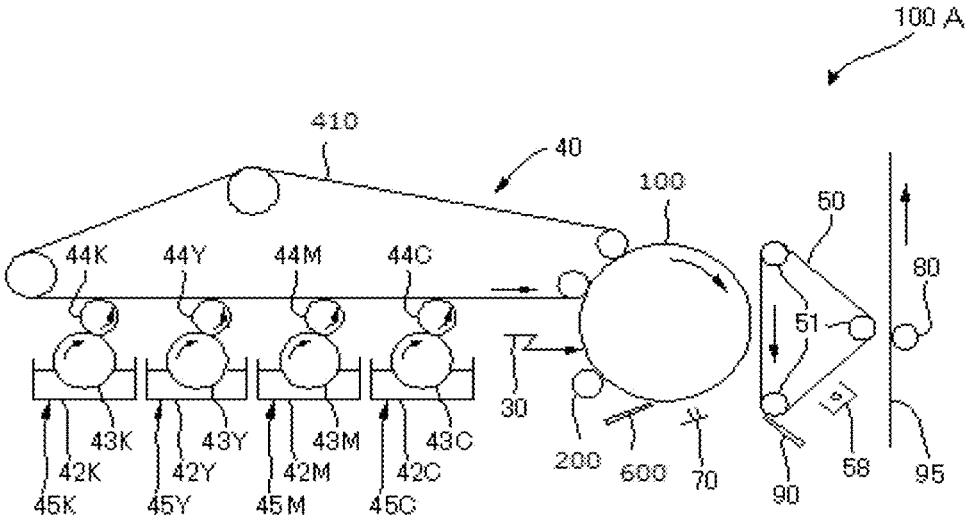
FIG. 11 is a schematic, configurational view illustrating one exemplary image forming apparatus of the present invention.

In the color image forming apparatus 100A illustrated in FIG. 11, for example, the charging roller 200 uniformly charges the photoconductor drum 100. The exposure device 30 imagewise exposes the photoconductor drum 100 to light to form an electrostatic latent image. The electrostatic latent image formed on the photoconductor drum 100 is developed with a toner supplied from the developing device 40 to form a toner image. The toner image is transferred (primarily transferred) onto the intermediate transfer member 50 by voltage applied from the roller 51 and then transferred (secondarily transferred) onto the sheet of the transfer paper 95. As a result, a transferred image is formed on the sheet of the transfer paper 95. Note that, a residual toner remaining on the photoconductor 100 is removed by the cleaning device 600, and the photoconductor 100 is once charge-eliminated by the charge-eliminating lamp 70.

(Process Cartridge)

A process cartridge of the present invention is molded so as to be detachably mounted to various image forming apparatuses. The process cartridge includes at least an electrostatic latent image bearer configured to bear an electrostatic latent image; and a developing means configured to develop the electrostatic latent image borne on the electrostatic latent image bearer with the developer of the present invention to form a toner image. Note that, the process cartridge of the present invention may further include other means, if necessary.

The developing means includes at least a developer stored container configured to store the developer of the present invention; and a developer bearer configured to bear and convey the developer stored in the developer stored container. Note that, the developing means may further include a regulating member configured to regulate a thickness of the developer to be borne.

Figure 12:
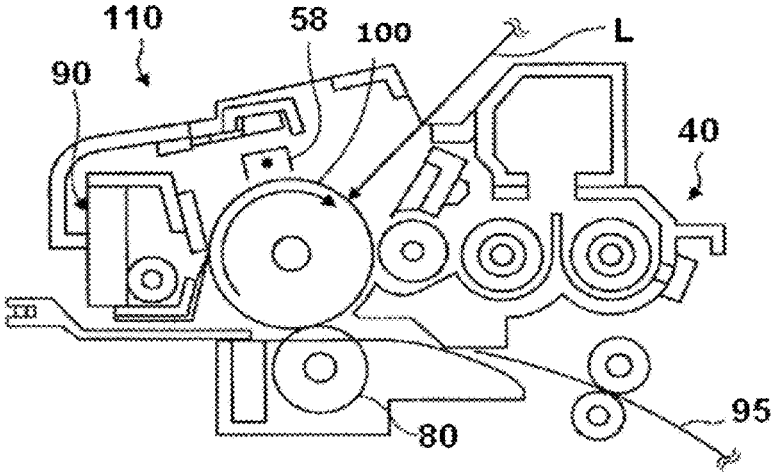
FIG. 12 is a schematic, configurational view illustrating one exemplary process cartridge.

FIG. 12 illustrates one exemplary process cartridge of the present invention. A process cartridge 110 includes a photoconductor drum 100, a corona charger 58, a developing device 40, a transfer roller 80, and a cleaning device 90.

EXAMPLES

The present invention will now be described in more detail referring to Examples and Comparative Examples, but the present invention is not limited to the Examples. Note that, the term "part(s)" denotes part(s) by mass.

Physical properties of polymers used in the Examples and the Comparative Examples were determined in the following manner.

<Measurement of Particle Diameter and Particle Size Distribution of Toner>

A volume average particle diameter (Dv) and a number average particle diameter (Dn) of the toner of the present invention are measured with a particle size measuring device ("MULTISIZER III," available from Beckman Coulter Inc.) at an aperture diameter of 50 μm. After the volume and the number of the toner particles are measured, a volume distribution and a number distribution are calculated. The volume average particle diameter (Dv) and the number average particle diameter (Dn) of the toner can be determined based on the resultant distributions. The particle size distribution is represented by a ratio Dv/Dn which is obtained by dividing the volume average particle diameter (Dv) of the toner by the number average particle diameter (Dn) of the toner.

<Measurement of Amount (% by Mass) of Release Agent by Differential Scanning Calorimetry (DSC)>

A total amount of a release agent in a toner particle was measured by differential scanning calorimetry (DSC). A toner sample and a release agent sample were separately measured by the device described below under the conditions described below. An amount of the release agent contained in the toner was calculated from a ratio of endothermic amounts of the release agents obtained from the toner sample and the release agent sample.

Measuring device: DSC instrument (DSC60; available from Shimadzu Corporation)

Amount of sample: about 5 mg

Heating rate: 10° C./min

Measurement range: from room temperature through 150° C.

Measurement atmosphere: nitrogen gas atmosphere

The total amount of the release agent was calculated according to a formula below.

Total amount of release agent (% by mass)=(Endothermic amount (J/g) of release agent in toner sample)×100)/(Endothermic amount (J/g) of release agent only).

<Measurement of Amount (% by Mass) of Release Agent by Attenuated Total Reflection Fourier Transform Infrared Spectroscopy (FTIR-ATR)>

A surface release agent amount in a toner particle was determined by attenuated total reflection Fourier transform infrared spectroscopy (FTIR-ATR). An analytical depth is about 0.3 μm according to the measurement principle. This method is able to measure an amount of the release agent that is present in a region from a surface of the toner particle to a depth of 0.3 μm. The amount was measured in the following manner.

First, as a sample, 3 g of a toner was formed into a pellet having a diameter of 40 mm (thickness: about 2 mm) by pressing using an automatic pellet molder (Type M No. 50

BRP-E, available from MAEKAWA TESTING MACHINE CO.) under a load of 6 t for 1 min.

A surface of the resultant toner pellet was measured by FTIR-ATR.

A microscopic FTIR instrument used was SPECTRUM ONE (available from PERKIN ELMER Co., Ltd.) equipped with a MULTISCOPE FTIR unit. This measurement was performed by micro ATR using a germanium (Ge) crystal having a diameter of 100 μm.

The measurement was performed 20 times cumulatively at an infrared incident angle of 41.5° at a resolution of 4 $cm^{-1}$.

A ratio of intensities of a peak from the release agent and a peak from the binder resin was determined as a relative release agent amount in a surface of a toner particle. An average of four measurements obtained at different measurement positions was used.

A surface release agent amount of the sample was calculated based on a relation with a relative release agent amount of a sample for a calibration curve in which a known amount of a release agent is dispersed uniformly.

A method for calculating an amount (% by mass) of the release agent of Example 2 described below will now be described.

—Measurement of Amount (% by Mass) of Release Agent of Example 2—

A mixture of a WAX 2 and a Polyester resin A in which the WAX 2 is mixed at a known ratio was measured for a WAX peak intensity and a binder resin peak intensity. Based on these values, a relative WAX intensity (WAX peak intensity/binder resin peak intensity) was determined (see Table 1 below).

Figure 14:
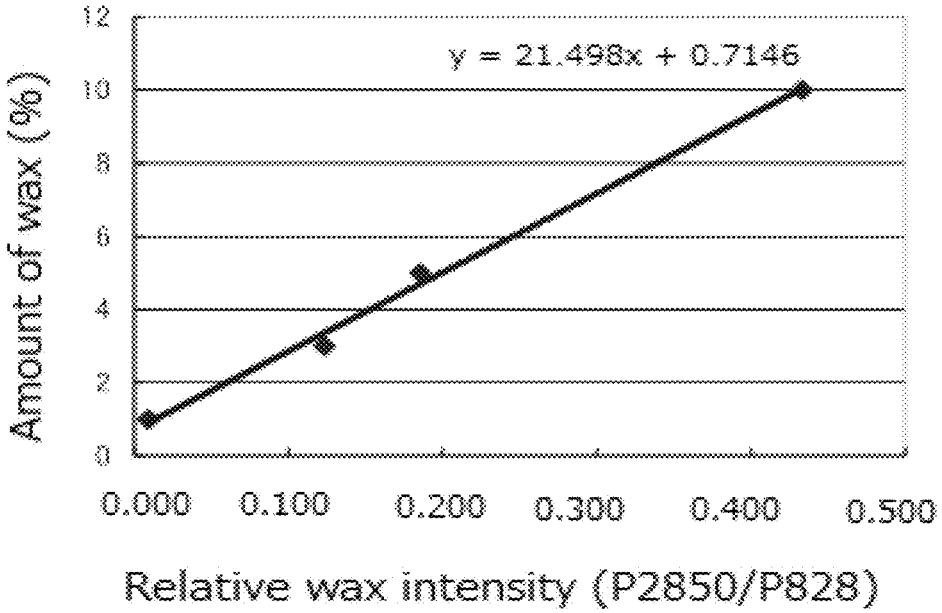
FIG. 14 is a graph illustrating one exemplary calibration curve used for measuring an amount of a release agent according to a FTIR-ATR method.

Based on data of the relative WAX intensity and a WAX amount, a calibration curve illustrated in FIG. 14 was generated.

The WAX peak intensity and the binder resin peak intensity were measured in a sample of Example 2. Based on these values, the relative WAX intensity was determined (see Table 2 below).

The result of the relative WAX intensity was substituted into the calibration curve illustrated in FIG. 14 to calculate the WAX amount (% by mass).

TABLE 1

| Sample | WAX amount (% by mass) | WAX peak intensity 2850 $cm^{-1}$ (2834-2862) | Binder resin peak intensity 828 $cm^{-1}$ (743-890) | Relative WAX intensity P2850/P828 |
|---|---|---|---|---|
| Mixture of WAX 2/ Polyester resin A | 1 | 0.004 | 0.444 | 0.009 |
| | 3 | 0.051 | 0.413 | 0.123 |
| | 5 | 0.020 | 0.108 | 0.185 |
| | 10 | 0.243 | 0.561 | 0.433 |

TABLE 2

| Sample | WAX peak intensity 2850 $cm^{-1}$ (2834-2862) | Binder resin peak intensity 828 $cm^{-1}$ (743-890) | Relative WAX intensity P2850/P828 | WAX amount (% by mass) (caluculated from calibration curve illustrated in FIG. 14) |
|---|---|---|---|---|
| Toner 2 | 0.035 | 0.426 | 0.082 | 2.5 |

<Measurement of Aa, Ab, Ac, WDa, WDb, and WDc>

In TEM observation, for example, a toner was embedded in an epoxy resin, and then sliced at a cross-section passing through a center of the toner with an ultramicrotome (ultrasonic) to produce a section of the toner. The section was stained with $RuO_4$, and then observed with a transmission electron microscope (TEM) while adjusting a magnification. Regions Aa, Ab, and Ac and number average particle diameters WDa, WDb, and WDc were determined on a torn surface of the toner with an image analysis software IMAGEJ.

A torn surface was prepared from each of 50 toners.

The resultant 50 torn surfaces were extracted as measurement samples. Values of the WDa, the WDb, and the WDc are calculated for each of the 50 samples and averaged.

Example 1

<Production of Toner 1>

—Preparation of Colorant Dispersion Liquid—

First, as a colorant, a carbon black dispersion liquid was prepared.

Carbon black (REGAL 400, available from Cabot Corporation) (20 parts) and a pigment dispersing agent (AJISPER PB821, available from Ajinomoto Fine-Techno Co., Inc.) (2 parts) were primarily dispersed in ethyl acetate (78 parts) using a mixer equipped with a stirring blade. The resultant primary dispersion liquid was dispersed more finely with a strong shearing force by DYNO-MILL to prepare a secondary dispersion liquid in which aggregates were completely removed. The resultant secondary dispersion liquid was further passed through a polytetrafluoroethylene (PTFE) filter having a pore size of 0.45 μm (FLORINATE MEMBRANE FILTER FHLP09050, available from Nihon Millipore Inc.) to disperse the carbon black to a sub-micron level. Thus, the carbon black dispersion liquid was prepared.

—Preparation of Toner Composition Liquid—

A [WAX 1] (10 parts) serving as a release agent and a [Polyester Resin A] (273.3 parts) serving as a binder resin were mixed together and dissolved in ethyl acetate (676.7 parts) at 70° C. using a mixer equipped with a stirring blade. The [WAX 1] and the [Polyester resin A] were dissolved in the ethyl acetate without phase separation to obtain a transparent solution. After that, a temperature of the transparent solution was adjusted to 55° C. The carbon black dispersion liquid (100 parts) was mixed with the solution and stirred for 10 min to prepare a toner composition liquid.

The [WAX 1] was a synthetic amide wax having a melting point of 62.6° C. and a recrystallization temperature of 52.7° C. (WA-4, available from NOF Corporation).

The [Polyester Resin A] was a binder resin formed of terephthalic acid, isophthalic acid, succinic acid, ethylene glycol, and neopentyl glycol and having a weight average molecular weight of 24,000 and a Tg of 60° C. The [Polyester Resin A] was produced in the following manner.

—Production Method of Polyester Resin A—

Ethylene glycol (0.5 mol) and neopentyl glycol (0.5 mol) serving as alcohol components; terephthalic acid (0.38 mol), isophthalic acid (0.57 mol), and succinic acid (0.05 mol) serving as carboxylic acid components; and tin octylate serving as an esterification catalyst were charged in a 5 L four-necked flask equipped with a nitrogen introducing tube, a dehydrating tube, a stirrer, and a thermocouple and were allowed to condensate under a nitrogen atmosphere at 180° C. for 4 hours. Then, the resultant condensation product was heated to 210° C., allowed to react for 1 hour, and allowed to further react at 8 KPa for 1 hour. Thus, the Polyester A was synthesized.

A weight average molecular weight Mw of the binder resin was determined by measuring a THF soluble content of the binder resin with a gel permeation chromatography (GPC) measuring instrument GPC-150C (available from Waters Corporation). Columns KF801 to KF807 (available from Shodex Co., Ltd.) were used. A detector RI (Refraction Index) detector was used. Ethyl acetate has a boiling point of 76.8° C.

—Production of Toner Base Particles—

Liquid droplets of the resultant toner composition liquid were discharged using a toner producing apparatus illustrated in FIG. 9 equipped with a liquid-droplet discharging head illustrated in FIG. 5A serving as a liquid-droplet discharging means under the conditions described below. After the liquid droplets were discharged, the liquid droplets were dried and solidified by a liquid-droplet solidifying means using dry nitrogen, collected with a cyclon, and then dried with air blowing for 48 hours at 35° C./90% RH, for 24 hours at 40° C./50% RH, and for 24 hours at 50° C./50% RH. Thus, toner base particles were produced.

Note that, the toner composition liquid and members of the toner producing apparatus configured to contact with the toner composition liquid were controlled to a temperature of 55° C. The toner was continuously produced for 6 hours, but discharging holes were not clogged.

[Conditions of Producing Apparatus]

| Longitudinal length L of liquid-column resonance | |
|---|---|
| liquid-chamber: | 1.85 mm |
| Opening diameter of discharging holes: | 8.0 μm |
| Drying temperature (nitrogen): | 60° C. |
| Driving frequency: | 340 kHz |
| Voltage applied to piezoelectric material: | 10.0 V |

Then, commercially available silica powder [NAX 50] (primary average particle diameter: 30 nm, available from NIPPON AEROSIL CO., LTD.) (2.8 parts) and [H20TM] (primary average particle diameter: 20 nm, available from Clariant) (0.9 parts) were mixed with the toner base particles produced as described above (100 parts) using a Henschel mixer. The resultant mixture was filtered through a 60 μm-mesh sieve to remove coarse particles or aggregates. Thus, a [Toner 1] was obtained.

Composition of components constituting the toner base particles of the [Toner 1] is presented in Table 3.

Physical properties of the [Toner 1] were determined by the above-described measurement methods. Results are presented in Table 4.

<Production of Developer and Evaluation of Developer>

<<Production and Evaluation of Two-Component Developer>>

The [Toner 1] (4 parts) was mixed with a magnetic carrier described below (96 parts) in a ball mill to obtain a Two-component developer 1.

—Production of Carrier—

| | |
|---|---|
| Silicone resin (organo straight silicone) | 100 parts |
| Toluene | 100 parts |
| γ-(2-aminoethyl)aminopropyl trimethoxysilane | 5 parts |
| Carbon black | 10 parts |

The resultant mixture was dispersed with a homomixer for 20 min to prepare a coating layer forming liquid. This coating layer forming liquid was coated onto surfaces of spherical magnetite (particle diameter: 50 μm) (1,000 parts) with a fluid bed coating device. Thus, a magnetic carrier was produced.

An image forming apparatus containing a [Developer 1] which includes the [Toner 1] was used to evaluate a cold-offset property, a hot-offset property, charging stability, background fog, and image stability by evaluation methods described below. Results are presented in Table 5.

[Cold-Offset Property]

A commercially available copier IMAGIO NEO C600 (available from Ricoh Company Limited) containing the developer were used to produce a toner sample, a rectangular image of 3 cm×5 cm, at a deposition amount of 0.85 mg/cm$^2$ at a position of 5 cm from a leading end of a sheet of A4 size paper (T6000 70W, long grain, available from Ricoh Company Limited). Then, the image was fixed at a liner velocity of 300 mm/sec while a fixing member was controlled to a temperature of 130° C. constantly (a toner weight was calculated from weights of the sheet before and after image output).

Whether offset occurred at 130° C. was visually observed by an evaluator and evaluated according to criteria below.

—Evaluation Criteria—

A: No cold-offset occurred.

B: 3 or less small cold-offset regions were observed.

C: More than 3 small cold-offset regions were observed.

D: Cold-offset occurred.

[Hot-Offset Property]

A commercially available copier IMAGIO NEO C600 (available from Ricoh Company Limited) containing the developer were used to produce a toner sample, a rectangular image of 3 cm×5 cm, at a deposition amount of 0.85 mg/cm$^2$ at a position of 5 cm from a leading end of a sheet of A4 size paper (T6000 70W, long grain, available from Ricoh Company Limited). The images were output while a fixing temperature varied from a lower temperature to a higher temperature. A temperature at which glossiness of the image was decreased or a case in which an offset image was observed in the image was determined as an offset occurrence temperature.

—Evaluation Criteria—

B: The offset occurrence temperature was 200° C. or higher.

D: The offset occurrence temperature was lower than 200° C.

[Charging Stability]

A tandem color image forming apparatus (IMAGIO NEO C600, available from Ricoh Company Limited) containing the developer was used to output a chart having an image area of 20% while a toner concentration was controlled so as to give an image density of 1.4±0.2. A charging amount (μc/g) of the electrophotographic developer after output of 200,000 sheets was compared with an initial charging amount before output. A rate of change in charging amounts (a decrease of the charging amount after running of 200,000 sheets/the initial charging amount) was evaluated according to criteria below. The charging amount was measured by a blow-off method.

—Evaluation Criteria—

A: Lower than 15%

B: 15% or higher but lower than 30%

C: 30% or higher but lower than 50%

D: 50% or higher

Toner deposition on an electrophotographic carrier or toner deterioration decreases the charging amount. Therefore, it may be considered that the smaller the rate of change in charging amounts before and after the running is, the lower the degree of filming of the toner on the electrophotographic carrier is.

[Evaluation of Background Fog]

A tandem color image forming apparatus (IMAGIO NEO C600, available from Ricoh Company Limited) was used to continuously output a chart having an image area of 5% on 200,000 sheets. After that, the degree of background fog on an image background region was visually observed and evaluated according to criteria below.

—Evaluation Criteria—

B: Toner deposition was not observed on the image background region.

C: Toner deposition was slightly observed on the image background region when observed from an angle.

D: Toner deposition was clearly observed on the image background region.

[Evaluation of Image Stability]

A commercially available copier (IMAGIO NEO 455, available from Ricoh Company Limited) containing the developer was used to perform a continuous running test on 50,000 sheets of TYPE 6000 PAPER (available from Ricoh Company Limited) at a printing rate of an image occupation rate of 7%. Image quality (image density, fine line reproducibility, and background fog) of the 50,000th sheet was evaluated according to criteria below.

B: The 50,000th sheet had excellent image quality equivalent to an initial image.

C: Any of evaluation items of the image density, the fine line reproducibility, and the background fog was changed from the initial image, but a rate of change from the initial image was 30% or lower.

D: Any of evaluation items of the image density, the fine line reproducibility, and the background fog was clearly changed from the initial image, and the rate of change from the initial image was 30% or higher.

<<Production and Evaluation of One-Component Developer>>

An image forming apparatus containing a one-component developer which consists of the [Toner 1] was used to evaluate a cold-offset property, a hot-offset property, adherence resistance, background fog, and image stability by evaluation methods described below. Results are presented in Table 5.

[Cold-Offset Property]

IPSIO SP C220 (available from Ricoh Company, Ltd.) was modified so as to be able to change a fixing roll temperature to an arbitrary temperature. A sheet of transfer paper ("TYPE 6200"; available from Ricoh Company, Ltd.) was set to the modified device. A solid image was formed on the sheet at each toner deposition amount of 1.00±0.05 mg/cm$^2$.

The sheet on which the solid image had been formed was fed through the device while a fixing roll temperature was controlled to a temperature of 140° C. constantly. Whether offset occurred at 140° C. was visually observed by an evaluator and evaluated according to criteria below.

—Evaluation Criteria—

A: No cold-offset occurred.

B: 3 or less small cold-offset regions were observed.

C: More than 3 small cold-offset regions were observed.

D: Cold-offset occurred.

[Hot-Offset Property]

IPSIO SP C220 (available from Ricoh Company, Ltd.) was modified so as to be able to change a fixing roll temperature to an arbitrary temperature. Sheets of transfer paper ("TYPE 6200"; available from Ricoh Company, Ltd.) were set to the modified device. Solid images were formed on the sheets at each toner deposition amount of 1.00±0.05 mg/cm$^2$. The images were output while a fixing temperature varied from a lower temperature to a higher temperature. A temperature at which glossiness of the image was decreased or a case in which an offset image was observed in the image was determined as an offset occurrence temperature.

—Evaluation Criteria—

B: The offset occurrence temperature was 200° C. or higher.

D: The offset occurrence temperature was lower than 200° C.

[Adherence Resistance]

IPSIO SP C220 (available from Ricoh Company, Ltd.) was used to output a white solid image on 2,000 sheets of paper. Then, a toner adhered onto a regulation blade was evaluated on 4 ranks.

This experiment was performed under an environment of a temperature of 27° C. and a humidity of 40%.

—Evaluation Criteria—

A: No toner adherence was observed, and image quality was very good.

B: Unnoticeable toner adherence was observed at a level giving no adverse effect to image quality.

C: Toner adherence was observed at a level giving an adverse effect to image quality.

D: Noticeable toner adherence was observed at a level giving a considerable adverse effect to image quality.

[Background Fog]

The toner was charged into a Bk cartridge of IPSIO SP C220 (available from Ricoh Company, Ltd.). A blank image was printed out. After that, a sheet on which the blank image had been formed and a photoconductor were observed.

This experiment was performed under an environment of a temperature of 27° C. and a humidity of 40%.

—Evaluation Criteria—

A: Toner deposition was not observed neither on the blank image nor the photoconductor.

B: Toner deposition was not observed on the blank image, but toner deposition was slightly observed on the photoconductor when observed from an angle.

C: Toner deposition was slightly observed on the blank image when observed from an angle.

D: Toner deposition was clearly observed on the blank image.

[Image Stability]

IPSIO SP C220 (available from Ricoh Company, Ltd.) was used to output an image chart having an image area of 1% on 2,000 sheets. After that, a black solid image was output on a sheet of TYPE 6000 PAPER (available from Ricoh Company, Ltd.). Initial image density and an image density of the black solid image were measured with a spectrodensitometer (available from X-Rite). Difference in image density before and after output of 2,000 sheets was evaluated according to criteria below.

—Evaluation Criteria—

A: The difference was less than 0.1%.

B: The difference was 0.1% or more but less than 0.2%.

C: The difference was less than 0.2% and less than 0.3%.

D: The difference was 0.3% or more.

[Score in Comprehensive Evaluation]

Scores in a comprehensive evaluation were calculated based on the above evaluation results according to the following scoring scale: A (3 points), B (2 points), C (1 point), D (0 points), and unevaluable (–) (0 points). The higher score represents the better result.

Example 2

A [Toner 2] was obtained in the same manner as in Example 1, except that preparation of a toner composition liquid and production of toner base particles were performed in the following manner.

—Preparation of Toner Composition Liquid—

A [WAX 2] (10 parts) serving as a release agent and a [Polyester Resin A] (273.3 parts) serving as a binder resin were mixed together and dissolved in ethyl acetate (676.7 parts) at 70° C. using a mixer equipped with a stirring blade. The [WAX 2] and the [Polyester resin A] were dissolved in the ethyl acetate without phase separation to obtain a transparent solution. After that, a temperature of the transparent solution was adjusted to 55° C. The carbon black dispersion liquid (100 parts) was mixed with the solution and stirred for 10 min to prepare a toner composition liquid.

Note that, the [WAX 2] was a synthetic ester wax including, as a main component, an aliphatic ester and having a melting point of 53.0° C. and a recrystallization temperature of 46.0° C. (WAX-158, available from NOF Corporation).

—Production of Toner Base Particles—

Liquid droplets of the resultant toner composition liquid were discharged using the same producing apparatus as in Example 1 in the same manner as in Example 1, except that liquid-droplet discharging conditions were changed as described below. After the liquid droplets were discharged, the liquid droplets were dried and solidified by a liquid-droplet solidifying means using dry nitrogen, collected with a cyclon, and then dried with air blowing for 48 hours at 35° C./90% RH, for 24 hours at 40° C./50% RH, and for 24 hours at 50° C./50% RH. Thus, toner base particles were produced.

Note that, the toner composition liquid and members of the toner producing apparatus configured to contact with the toner composition liquid were controlled to a temperature of 55° C. The toner was continuously produced for 6 hours, but discharging holes were not clogged.

[Conditions of Producing Apparatus]

| Longitudinal length L of liquid-column resonance | |
|---|---|
| liquid-chamber: | 1.85 mm |
| Opening diameter of discharging holes: | 8.0 μm |
| Drying temperature (nitrogen): | 55° C. |
| Driving frequency: | 340 kHz |
| Voltage applied to piezoelectric material: | 10.0 V |

The resultant toner base particles were processed in the same manner as in Example 1 to obtain the Toner 2.

Composition of components constituting the toner base particles of the [Toner 2] is presented in Table 3.

Physical properties of the [Toner 2] were determined by the above-described measurement methods in the same manner as in Example 1. Results are presented in Table 4.

An image forming apparatus containing a [Developer 2] which includes the [Toner 2] was used to evaluate a cold-offset property, a hot-offset property, charging stability, background fog, and image stability in the same manner as in Example 1. Results are presented in Table 5.

Example 3

A [Toner 3] was obtained in the same manner as in Example 1, except that preparation of a toner composition liquid and production of toner base particles were performed in the following manner.

—Preparation of Toner Composition Liquid—

A [WAX 2] (10 parts) serving as a release agent and a [Polyester Resin A] (273.3 parts) serving as a binder resin were mixed together and dissolved in ethyl acetate (676.7 parts) at 70° C. using a mixer equipped with a stirring blade. The [WAX 2] and the [Polyester resin A] were dissolved in the ethyl acetate without phase separation to obtain a transparent solution. After that, a temperature of the transparent solution was adjusted to 55° C. The carbon black dispersion liquid (100 parts) was mixed with the solution and stirred for 10 min to prepare a toner composition liquid.

—Production of Toner Base Particles—

Liquid droplets of the resultant toner composition liquid were discharged using the same producing apparatus as in Example 1 in the same manner as in Example 1, except that liquid-droplet discharging conditions were changed as described below. After the liquid droplets were discharged, the liquid droplets were dried and solidified by a liquid-droplet solidifying means using dry nitrogen, collected with a cyclon, and then dried with air blowing for 48 hours at 35° C./90% RH, for 24 hours at 40° C./50% RH, and for 24 hours at 50° C./50% RH. Thus, toner base particles were produced.

Note that, the toner composition liquid and members of the toner producing apparatus configured to contact with the toner composition liquid were controlled to a temperature of 55° C. The toner was continuously produced for 6 hours, but discharging holes were not clogged.

[Conditions of Producing Apparatus]

| Longitudinal length L of liquid-column resonance | |
|---|---|
| liquid-chamber: | 1.85 mm |
| Opening diameter of discharging holes: | 8.0 μm |
| Drying temperature (nitrogen): | 60° C. |
| Driving frequency: | 340 kHz |
| Voltage applied to piezoelectric material: | 10.0 V |

The resultant toner base particles were processed in the same manner as in Example 1 to obtain the Toner 3.

Composition of components constituting the toner base particles of the [Toner 3] is presented in Table 3.

Physical properties of the [Toner 3] were determined by the above-described measurement methods in the same manner as in Example 1. Results are presented in Table 4.

An image forming apparatus containing a [Developer 3] which includes the [Toner 3] was used to evaluate a cold-offset property, a hot-offset property, charging stability, background fog, and image stability in the same manner as in Example 1. Results are presented in Table 5.

Example 4

A [Toner 4] was obtained in the same manner as in Example 1, except that preparation of a toner composition liquid and production of toner base particles were performed in the following manner.

—Preparation of Toner Composition Liquid—

A [WAX 2] (10 parts) serving as a release agent and a [Polyester Resin A] (273.3 parts) serving as a binder resin were mixed together and dissolved in ethyl acetate (676.7 parts) at 70° C. using a mixer equipped with a stirring blade. The [WAX 2] and the [Polyester resin A] were dissolved in the ethyl acetate without phase separation to obtain a transparent solution. After that, a temperature of the transparent solution was adjusted to 55° C. The carbon black dispersion liquid (100 parts) was mixed with the solution and stirred for 10 min to prepare a toner composition liquid.

—Production of Toner Base Particles—

Liquid droplets of the resultant toner composition liquid were discharged using the same producing apparatus as in Example 1 in the same manner as in Example 1, except that liquid-droplet discharging conditions were changed as described below. After the liquid droplets were discharged, the liquid droplets were dried and solidified by a liquid-droplet solidifying means using dry nitrogen, collected with a cyclon, and then dried with air blowing for 48 hours at 35° C./90% RH, for 24 hours at 40° C./50% RH, and for 24 hours at 50° C./50% RH. Thus, toner base particles were produced.

Note that, the toner composition liquid and members of the toner producing apparatus configured to contact with the toner composition liquid were controlled to a temperature of 55° C. The toner was continuously produced for 6 hours, but discharging holes were not clogged.

[Conditions of Producing Apparatus]

| Longitudinal length L of liquid-column resonance | |
|---|---|
| liquid-chamber: | 1.85 mm |
| Opening diameter of discharging holes: | 8.0 μm |
| Drying temperature (nitrogen): | 50° C. |
| Driving frequency: | 340 kHz |
| Voltage applied to piezoelectric material: | 10.0 V |

The resultant toner base particles were processed in the same manner as in Example 1 to obtain the Toner 4.

Composition of components constituting the toner base particles of the [Toner 4] is presented in Table 3.

Physical properties of the [Toner 4] were determined by the above-described measurement methods in the same manner as in Example 1. Results are presented in Table 4.

An image forming apparatus containing a [Developer 4] which includes the [Toner 4] was used to evaluate a cold-offset property, a hot-offset property, charging stability, background fog, and image stability in the same manner as in Example 1. Results are presented in Table 5.

Example 5

A [Toner 5] was obtained in the same manner as in Example 1, except that preparation of a toner composition liquid and production of toner base particles were performed in the following manner.

—Preparation of Toner Composition Liquid—

A [WAX 3] (10 parts) serving as a release agent and a [Polyester Resin A] (273.3 parts) serving as a binder resin were mixed together and dissolved in ethyl acetate (676.7 parts) at 70° C. using a mixer equipped with a stirring blade. The [WAX 3] and the [Polyester resin A] were dissolved in the ethyl acetate without phase separation to obtain a transparent solution. After that, a temperature of the transparent solution was adjusted to 55° C. The carbon black dispersion liquid (100 parts) was mixed with the solution and stirred for 10 min to prepare a toner composition liquid.

Note that, the [WAX 3] was a synthetic ester wax including, as a main component, an aliphatic ester and having a melting point of 68.9° C. and a recrystallization temperature of 61.2° C. (WEP-4, available from NOF Corporation).

—Production of Toner Base Particles—

Liquid droplets of the resultant toner composition liquid were discharged using the same producing apparatus as in Example 1 in the same manner as in Example 1, except that liquid-droplet discharging conditions were changed as described below. After the liquid droplets were discharged, the liquid droplets were dried and solidified by a liquid-droplet solidifying means using dry nitrogen, collected with a cyclon, and then dried with air blowing for 48 hours at 35° C./90% RH, for 24 hours at 40° C./50% RH, and for 24 hours at 50° C./50% RH. Thus, toner base particles were produced.

Note that, the toner composition liquid and members of the toner producing apparatus configured to contact with the toner composition liquid were controlled to a temperature of 55° C. The toner was continuously produced for 6 hours, but discharging holes were not clogged.

[Conditions of Producing Apparatus]

| Longitudinal length L of liquid-column resonance | |
|---|---|
| liquid-chamber: | 1.85 25 mm |
| Opening diameter of discharging holes: | 8.0 μm |
| Drying temperature (nitrogen): | 60° C. |
| Driving frequency: | 340 kHz |
| Voltage applied to piezoelectric material: | 10.0 V |

The resultant toner base particles were processed in the same manner as in Example 1 to obtain the Toner 5.

Composition of components constituting the toner base particles of the [Toner 5] is presented in Table 3.

Physical properties of the [Toner 5] were determined by the above-described measurement methods in the same manner as in Example 1. Results are presented in Table 4.

An image forming apparatus containing a [Developer 5] which includes the [Toner 5] was used to evaluate a cold-offset property, a hot-offset property, charging stability, background fog, and image stability in the same manner as in Example 1. Results are presented in Table 5.

Example 6

A [Toner 6] was obtained in the same manner as in Example 1, except that preparation of a toner composition liquid and production of toner base particles were performed in the following manner.

—Preparation of Toner Composition Liquid—

A [WAX 4] (10 parts) serving as a release agent and a [Polyester Resin B] (273.3 parts) serving as a binder resin were mixed together and dissolved in ethyl acetate (676.7 parts) at 70° C. using a mixer equipped with a stirring blade. The [WAX 4] and the [Polyester resin B] were dissolved in the ethyl acetate without phase separation to obtain a transparent solution. After that, a temperature of the transparent solution was adjusted to 50° C. The carbon black dispersion liquid (100 parts) was mixed with the solution and stirred for 10 min to prepare a toner composition liquid.

Note that, the [WAX 4] was a synthetic ester wax including, as a main component, an aliphatic ester and having a melting point of 64.6° C. and a recrystallization temperature of 57.0° C. (WAX-16, available from NOF Corporation).

Note that, the [Polyester Resin B] was a binder resin formed of terephthalic acid, isophthalic acid, ethylene glycol, and neopentyl glycol and having a weight average molecular weight of 26,000 and a Tg of 60° C. The [Polyester Resin B] was produced in the following manner.

—Production Method of Polyester Resin B—

Ethylene glycol (0.5 mol) and neopentyl glycol (0.5 mol) serving as alcohol components; terephthalic acid (0.4 mol) and isophthalic acid (0.6 mol) serving as carboxylic acid components; and tin octylate serving as an esterification catalyst were charged in a 5 L four-necked flask equipped with a nitrogen introducing tube, a dehydrating tube, a stirrer, and a thermocouple and were allowed to condensate under a nitrogen atmosphere at 180° C. for 4 hours. Then, the resultant condensation product was heated to 210° C., allowed to react for 1 hour, and allowed to further react at 8 KPa for 1 hour. Thus, the Polyester B was synthesized.

—Production of Toner Base Particles—

Liquid droplets of the resultant toner composition liquid were discharged using the same producing apparatus as in Example 1 in the same manner as in Example 1, except that a step of applying a mist of ethyl acetate so as to have a relative humidity of 11% relative to saturated humidity at 60° C. and liquid-droplet discharging conditions were changed as described below. After the liquid droplets were discharged, the liquid droplets were dried and solidified by a liquid-droplet solidifying means using dry nitrogen, collected with a cyclon, and then dried with air blowing for 48 hours at 35° C./90% RH, for 24 hours at 40° C./50% RH, and for 24 hours at 50° C./50% RH. Thus, toner base particles were produced.

Note that, the toner composition liquid and members of the toner producing apparatus configured to contact with the toner composition liquid were controlled to a temperature of 50° C. The toner was continuously produced for 6 hours, but discharging holes were not clogged.

[Conditions of Producing Apparatus]

| Longitudinal length L of liquid-column resonance | |
|---|---|
| liquid-chamber: | 1.85 mm |
| Opening diameter of discharging holes: | 8.0 μm |
| Drying temperature (nitrogen): | 60° C. |
| Relative humidity of ethyl acetate (nitrogen stream): | 11% |
| Driving frequency: | 340 kHz |
| Voltage applied to piezoelectric material: | 10.0 V |

The resultant toner base particles were processed in the same manner as in Example 1 to obtain the Toner 6.

Composition of components constituting the toner base particles of the [Toner 6] is presented in Table 3.

Physical properties of the [Toner 6] were determined by the above-described measurement methods in the same manner as in Example 1. Results are presented in Table 4.

An image forming apparatus containing a [Developer 6] which includes the [Toner 6] was used to evaluate a cold-offset property, a hot-offset property, charging stability, background fog, and image stability in the same manner as in Example 1. Results are presented in Table 5.

Example 7

A [Toner 7] was obtained in the same manner as in Example 1, except that preparation of a toner composition liquid and production of toner base particles were performed in the following manner.

—Preparation of Toner Composition Liquid—

A [WAX 4] (10 parts) serving as a release agent, and a [Polyester Resin B] (215.6 parts) and a [Styrene acrylic resin A] (57.7 parts) serving as a binder resin were mixed together and dissolved in ethyl acetate (676.7 parts) at 70° C. using a mixer equipped with a stirring blade. The [WAX 4], the Polyester resin B, and the Styrene acrylic resin A were dissolved in the ethyl acetate without phase separation to obtain a transparent solution. After that, a temperature of the transparent solution was adjusted to 50° C. The carbon black dispersion liquid (100 parts) was mixed with the solution and stirred for 10 min to prepare a toner composition liquid.

Note that, the [Styrene acrylic resin A] was a copolymer resin formed of styrene-butyl acrylate and having a glass transition temperature Tg of 62° C.

The Styrene acrylic resin A was produced in the following manner.

—Production Method of Styrene Acrylic Resin A—

A mixed monomer of styrene (2610.7 mol), n-butyl acrylate (651.2 mol), and glycidyl methacrylate (0.1 mol); and 2,2-bis(4,4-di-t-butylperoxycyclohexyl)propane (0.3 mol) serving as an initiator were charged in an autoclave reaction tank equipped with a thermometer, a stirrer, and a nitrogen introducing tube and were allowed to polymerize in a nitrogen stream at 90° C. for 5 hours. Then, xylene (820 mol) was added to the resultant polymer, and allowed to polymerize at 90° C. for 1 hour and then at 110° C. for 1 hour. Further, 2,2-bis(4,4-di-t-butylperoxycyclohexyl)propane (0.1 mol) and xylene (408 mol) were added to the resultant polymer, and allowed to polymerize at 110° C. for 4 hours. Then, di-t-butylperoxide (2.4 mol) and xylene (84 mol) were added at 150° C. to the resultant polymer, and allowed to polymerize for 2 hours. The polymerization was terminated and desolvated under reduced pressure. Thus, the Styrene acrylic resin A was synthesized.

—Production of Toner Base Particles—

Liquid droplets of the resultant toner composition liquid were discharged using the same producing apparatus as in Example 1 in the same manner as in Example 1, except that liquid-droplet discharging conditions were changed as described below. After the liquid droplets were discharged, the liquid droplets were dried and solidified by a liquid-droplet solidifying means using dry nitrogen, collected with a cyclon, and then dried with air blowing for 48 hours at 35° C./90% RH, for 24 hours at 40° C./50% RH, and for 24 hours at 50° C./50% RH. Thus, toner base particles were produced.

Note that, the toner composition liquid and members of the toner producing apparatus configured to contact with the toner composition liquid were controlled to a temperature of 55° C. The toner was continuously produced for 6 hours, but discharging holes were not clogged.

[Conditions of Producing Apparatus]

| Longitudinal length L of liquid-column resonance | |
|---|---|
| liquid-chamber: | 1.85 mm |
| Opening diameter of discharging holes: | 8.0 μm |
| Drying temperature (nitrogen): | 60° C. |
| Relative humidity of ethyl acetate (nitrogen stream): | 40% |
| Driving frequency: | 340 kHz |
| Voltage applied to piezoelectric material: | 10.0 V |

The resultant toner base particles were processed in the same manner as in Example 1 to obtain the Toner 7.

Composition of components constituting the toner base particles of the [Toner 7] is presented in Table 3.

Physical properties of the [Toner 7] were determined by the above-described measurement methods in the same manner as in Example 1. Results are presented in Table 4.

An image forming apparatus containing a [Developer 7] which includes the [Toner 7] was used to evaluate a cold-offset property, a hot-offset property, charging stability, background fog, and image stability in the same manner as in Example 1. Results are presented in Table 5.

Example 8

A [Toner 8] was obtained in the same manner as in Example 1, except that preparation of a toner composition liquid and production of toner base particles were performed in the following manner.

—Preparation of Toner Composition Liquid—

A [WAX 7] (10 parts) serving as a release agent and a [Polyester Resin A] (273.3 parts) serving as a binder resin were mixed together and dissolved in ethyl acetate (676.7 parts) at 70° C. using a mixer equipped with a stirring blade. The [WAX 7] and the [Polyester resin A] were dissolved in the ethyl acetate without phase separation to obtain a transparent solution. After that, a temperature of the transparent solution was adjusted to 55° C. The carbon black dispersion liquid (100 parts) was mixed with the solution and stirred for 10 min to prepare a toner composition liquid.

Note that, the [WAX 7] was a synthetic ester wax including, as a main component, an aliphatic ester and having a melting point of 55.2° C. and a recrystallization temperature of 48° C. (WAX-42, available from NOF Corporation).

—Production of Toner Base Particles—

Liquid droplets of the resultant toner composition liquid were discharged using the same producing apparatus as in Example 1 in the same manner as in Example 1, except that liquid-droplet discharging conditions were changed as described below. After the liquid droplets were discharged, the liquid droplets were dried and solidified by a liquid-droplet solidifying means using dry nitrogen, collected with a cyclon, and then dried with air blowing for 48 hours at 35° C./90% RH, for 24 hours at 40° C./50% RH, and for 24 hours at 50° C./50% RH. Thus, toner base particles were produced.

Note that, the toner composition liquid and members of the toner producing apparatus configured to contact with the toner composition liquid were controlled to a temperature of 55° C. The toner was continuously produced for 6 hours, but discharging holes were not clogged.

[Conditions of Producing Apparatus]

| Longitudinal length L of liquid-column resonance | |
|---|---|
| liquid-chamber: | 1.85 mm |
| Opening diameter of discharging holes: | 8.0 μm |
| Drying temperature (nitrogen): | 60° C. |
| Driving frequency: | 340 kHz |
| Voltage applied to piezoelectric material: | 10.0 V |

The resultant toner base particles were processed in the same manner as in Example 1 to obtain the Toner 8.

Composition of components constituting the toner base particles of the [Toner 8] is presented in Table 3.

Physical properties of the [Toner 8] were determined by the above-described measurement methods in the same manner as in Example 1. Results are presented in Table 4.

An image forming apparatus containing a [Developer 8] which includes the [Toner 8] was used to evaluate a cold-offset property, a hot-offset property, charging stability, background fog, and image stability in the same manner as in Example 1. Results are presented in Table 5.

Example 9

A [Toner 9] was obtained in the same manner as in Example 1, except that preparation of a toner composition liquid and production of toner base particles were performed in the following manner.

—Preparation of Toner Composition Liquid—

A [WAX 7] (2 parts) serving as a release agent and a [Polyester Resin A] (273.3 parts) serving as a binder resin were mixed together and dissolved in ethyl acetate (676.7 parts) at 70° C. using a mixer equipped with a stirring blade. The [WAX 7] and the [Polyester resin A] were dissolved in the ethyl acetate without phase separation to obtain a transparent solution. After that, a temperature of the transparent solution was adjusted to 55° C. The carbon black dispersion liquid (100 parts) was mixed with the solution and stirred for 10 min to prepare a toner composition liquid.

—Production of Toner Base Particles—

Liquid droplets of the resultant toner composition liquid were discharged using the same producing apparatus as in Example 1 in the same manner as in Example 1, except that liquid-droplet discharging conditions were changed as described below. After the liquid droplets were discharged, the liquid droplets were dried and solidified by a liquid-droplet solidifying means using dry nitrogen, collected with a cyclon, and then dried with air blowing for 48 hours at 35° C./90% RH, for 24 hours at 40° C./50% RH, and for 24 hours at 50° C./50% RH. Thus, toner base particles were produced.

Note that, the toner composition liquid and members of the toner producing apparatus configured to contact with the toner composition liquid were controlled to a temperature of 55° C. The toner was continuously produced for 6 hours, but discharging holes were not clogged.

[Conditions of Producing Apparatus]

| Longitudinal length L of liquid-column resonance | |
|---|---|
| liquid-chamber: | 1.85 mm |
| Opening diameter of discharging holes: | 8.0 μm |
| Drying temperature (nitrogen): | 60° C. |
| Driving frequency: | 340 kHz |
| Voltage applied to piezoelectric material: | 10.0 V |

The resultant toner base particles were processed in the same manner as in Example 1 to obtain the Toner 9.

Composition of components constituting the toner base particles of the [Toner 9] is presented in Table 3.

Physical properties of the [Toner 9] were determined by the above-described measurement methods in the same manner as in Example 1. Results are presented in Table 4.

An image forming apparatus containing a [Developer 9] which includes the [Toner 9] was used to evaluate a cold-offset property, a hot-offset property, charging stability, background fog, and image stability in the same manner as in Example 1. Results are presented in Table 5.

Example 10

A [Toner 10] was obtained in the same manner as in Example 1, except that preparation of a toner composition liquid and production of toner base particles were performed in the following manner.

—Preparation of Toner Composition Liquid—

A [WAX 7] (30 parts) serving as a release agent and a [Polyester Resin A] (273.3 parts) serving as a binder resin were mixed together and dissolved in ethyl acetate (676.7 parts) at 70° C. using a mixer equipped with a stirring blade. The [WAX 7] and the [Polyester resin A] were dissolved in the ethyl acetate without phase separation to obtain a transparent solution. After that, a temperature of the transparent solution was adjusted to 55° C. The carbon black dispersion liquid (100 parts) was mixed with the solution and stirred for 10 min to prepare a toner composition liquid.

—Production of Toner Base Particles—

Liquid droplets of the resultant toner composition liquid were discharged using the same producing apparatus as in Example 1 in the same manner as in Example 1, except that liquid-droplet discharging conditions were changed as described below. After the liquid droplets were discharged, the liquid droplets were dried and solidified by a liquid-droplet solidifying means using dry nitrogen, collected with a cyclon, and then dried with air blowing for 48 hours at 35° C./90% RH, for 24 hours at 40° C./50% RH, and for 24 hours at 50° C./50% RH. Thus, toner base particles were produced.

Note that, the toner composition liquid and members of the toner producing apparatus configured to contact with the toner composition liquid were controlled to a temperature of 55° C. The toner was continuously produced for 6 hours, but discharging holes were not clogged.

[Conditions of Producing Apparatus]

| Longitudinal length L of liquid-column resonance | |
|---|---|
| liquid-chamber: | 1.85 mm |
| Opening diameter of discharging holes: | 8.0 μm |
| Drying temperature (nitrogen): | 60° C. |
| Driving frequency: | 340 kHz |
| Voltage applied to piezoelectric material: | 10.0 V |

The resultant toner base particles were processed in the same manner as in Example 1 to obtain the Toner 10.

Composition of components constituting the toner base particles of the [Toner 10] is presented in Table 3.

Physical properties of the [Toner 10] were determined by the above-described measurement methods in the same manner as in Example 1. Results are presented in Table 4.

An image forming apparatus containing a [Developer 10] which includes the [Toner 10] was used to evaluate a cold-offset property, a hot-offset property, charging stability, background fog, and image stability in the same manner as in Example 1. Results are presented in Table 5.

Example 11

A [Toner 11] was obtained in the same manner as in Example 1, except that preparation of a toner composition liquid and production of toner base particles were performed in the following manner.

—Preparation of Toner Composition Liquid—

A [WAX 7] (10 parts) serving as a release agent and a [Polyester Resin A] (273.3 parts) serving as a binder resin were mixed together and dissolved in ethyl acetate (676.7 parts) at 70° C. using a mixer equipped with a stirring blade. The [WAX 7] and the [Polyester resin A] were dissolved in the ethyl acetate without phase separation to obtain a transparent solution. After that, a temperature of the transparent solution was to adjusted to 55° C. The carbon black dispersion liquid (100 parts) was mixed with the solution and stirred for 10 min to prepare a toner composition liquid.

—Production of Toner Base Particles—

Liquid droplets of the resultant toner composition liquid were discharged using the same producing apparatus as in Example 1 in the same manner as in Example 1, except that liquid-droplet discharging conditions were changed as described below. After the liquid droplets were discharged, the liquid droplets were dried and solidified by a liquid-droplet solidifying means using dry nitrogen, collected with a cyclon, and then dried with air blowing for 48 hours at 35° C./90% RH, for 24 hours at 40° C./50% RH, and for 24 hours at 50° C./50% RH. Thus, toner base particles were produced.

Note that, the toner composition liquid and members of the toner producing apparatus configured to contact with the toner composition liquid were controlled to a temperature of 55° C. The toner was continuously produced for 6 hours, but discharging holes were not clogged.

[Conditions of Producing Apparatus]

| Longitudinal length L of liquid-column resonance | |
|---|---|
| liquid-chamber: | 1.85 mm |
| Opening diameter of discharging holes: | 8.0 μm |
| Drying temperature (nitrogen): | 38° C. |
| Driving frequency: | 340 kHz |
| Voltage applied to piezoelectric material: | 10.0 V |

The resultant toner base particles were processed in the same manner as in Example 1 to obtain the Toner 11.

Composition of components constituting the toner base particles of the [Toner 11] is presented in Table 3.

Physical properties of the [Toner 11] were determined by the above-described measurement methods in the same manner as in Example 1. Results are presented in Table 4.

An image forming apparatus containing a [Developer 11] which includes the [Toner 11] was used to evaluate a cold-offset property, a hot-offset property, charging stability, background fog, and image stability in the same manner as in Example 1. Results are presented in Table 5.

Example 12

A [Toner 12] was obtained in the same manner as in Example 1, except that preparation of a toner composition liquid and production of toner base particles were performed in the following manner.

—Preparation of Toner Composition Liquid—

A [WAX 7] (10 parts) serving as a release agent and a [Polyester Resin A] (273.3 parts) serving as a binder resin were mixed together and dissolved in ethyl acetate (676.7 parts) at 70° C. using a mixer equipped with a stirring blade. The [WAX 7] and the [Polyester resin A] were dissolved in the ethyl acetate without phase separation to obtain a transparent solution. After that, a temperature of the transparent solution was adjusted to 55° C. The carbon black dispersion liquid (100 parts) was mixed with the solution and stirred for 10 min to prepare a toner composition liquid.

—Production of Toner Base Particles—

Liquid droplets of the resultant toner composition liquid were discharged using the same producing apparatus as in Example 1 in the same manner as in Example 1, except that liquid-droplet discharging conditions were changed as described below. After the liquid droplets were discharged, the liquid droplets were dried and solidified by a liquid-droplet solidifying means using dry nitrogen, collected with a cyclon, and then dried with air blowing for 48 hours at 35° C./90% RH, for 24 hours at 40° C./50% RH, and for 24 hours at 50° C./50% RH. Thus, toner base particles were produced.

Note that, the toner composition liquid and members of the toner producing apparatus configured to contact with the toner composition liquid were controlled to a temperature of 38° C. The toner was continuously produced for 6 hours, but discharging holes were not clogged.

[Conditions of Producing Apparatus]

| Longitudinal length L of liquid-column resonance | |
|---|---|
| liquid-chamber: | 1.85 mm |
| Opening diameter of discharging holes: | 8.0 μm |
| Drying temperature (nitrogen): | 35° C. |
| Driving frequency: | 340 kHz |
| Voltage applied to piezoelectric material: | 10.0 V |

The resultant toner base particles were processed in the same manner as in Example 1 to obtain the Toner 12.

Composition of components constituting the toner base particles of the [Toner 12] is presented in Table 3.

Physical properties of the [Toner 12] were determined by the above-described measurement methods in the same manner as in Example 1. Results are presented in Table 4.

An image forming apparatus containing a [Developer 12] which includes the [Toner 12] was used to evaluate a cold-offset property, a hot-offset property, charging stability, background fog, and image stability in the same manner as in Example 1. Results are presented in Table 5.

Comparative Example 1

A [Comparative toner 1] was obtained in the same manner as in Example 1, except that preparation of a toner composition liquid and production of toner base particles were performed in the following manner.

—Preparation of Toner Composition Liquid—

A [WAX 5] (10 parts) serving as a release agent and a [Polyester Resin B] (273.3 parts) serving as a binder resin were mixed together and dissolved in ethyl acetate (676.7 parts) at 70° C. using a mixer equipped with a stirring blade. The [WAX 5] and the [Polyester resin A] were dissolved in the ethyl acetate without phase separation to obtain a transparent solution. After that, a temperature of the transparent solution was adjusted to 40° C. The carbon black dispersion liquid (100 parts) was mixed with the solution and stirred for 10 min to prepare a toner composition liquid.

Note that, the [WAX 5] was a synthetic ester wax having a melting point of 75.2° C. and a recrystallization temperature of 64.3° C. (WEP-2, available from NOF Corporation).

—Production of Toner Base Particles—

Liquid droplets of the resultant toner composition liquid were discharged using the same producing apparatus as in Example 1 in the same manner as in Example 1, except that liquid-droplet discharging conditions were changed as described below. After the liquid droplets were discharged, the liquid droplets were dried and solidified by a liquid-droplet solidifying means using dry nitrogen, collected with a cyclon, and then dried with air blowing for 48 hours at 35° C./90% RH, for 24 hours at 40° C./50% RH, and for 24 hours at 50° C./50% RH. Thus, toner base particles were produced.

Note that, the toner composition liquid and members of the toner producing apparatus configured to contact with the toner composition liquid were controlled to a temperature of 40° C. The toner was continuously produced for 6 hours, but discharging holes were not clogged.

[Conditions of Producing Apparatus]

| Longitudinal length L of liquid-column resonance | |
|---|---|
| liquid-chamber: | 1.85 mm |
| Opening diameter of discharging holes: | 8.0 μm |
| Drying temperature (nitrogen): | 55° C. |
| Driving frequency: | 340 kHz |
| Voltage applied to piezoelectric material: | 10.0 V |

The resultant toner base particles were processed in the same manner as in Example 1 to obtain the Comparative toner 1.

Composition of components constituting the toner base particles of the [Comparative toner 1] is presented in Table 3.

Physical properties of the [Comparative toner 1] were determined by the above-described measurement methods in the same manner as in Example 1. Results are presented in Table 4.

An image forming apparatus containing a [Comparative developer 1] which includes the [Comparative toner 1] was used to evaluate a cold-offset property, a hot-offset property, charging stability, background fog, and image stability in the same manner as in Example 1. Results are presented in Table 5.

Comparative Example 2

A [Comparative toner 2] was obtained in the same manner as in Example 1, except that preparation of a toner composition liquid and production of toner base particles were performed in the following manner.

—Preparation of Toner Composition Liquid—

A [WAX 6] (10 parts) serving as a release agent and a [Polyester Resin B] (273.3 parts) serving as a binder resin were mixed together and dissolved in ethyl acetate (676.7 parts) at 70° C. using a mixer equipped with a stirring blade. The [WAX 6] and the [Polyester resin B] were dissolved in the ethyl acetate without phase separation to obtain a transparent solution. After that, a temperature of the transparent solution was adjusted to 40° C. The carbon black dispersion liquid (100 parts) was mixed with the solution and stirred for 10 min to prepare a toner composition liquid.

Note that, the [WAX 6] was a synthetic ester wax having a melting point of 71.7° C. and a recrystallization temperature of 64.5° C. (WEP-3, available from NOF Corporation).

—Production of Toner Base Particles—

Liquid droplets of the resultant toner composition liquid were discharged using the same producing apparatus as in Example 1 in the same manner as in Example 1, except that liquid-droplet discharging conditions were changed as described below. After the liquid droplets were discharged, the liquid droplets were dried and solidified by a liquid-droplet solidifying means using dry nitrogen, collected with a cyclon, and then dried with air blowing for 48 hours at 35° C./90% RH, for 24 hours at 40° C./50% RH, and for 24 hours at 50° C./50% RH. Thus, toner base particles were produced.

Note that, the toner composition liquid and members of the toner producing apparatus configured to contact with the toner composition liquid were controlled to a temperature of 40° C. The toner was continuously produced for 6 hours, but discharging holes were not clogged.

[Conditions of Producing Apparatus]

| Longitudinal length L of liquid-column resonance | |
|---|---|
| liquid-chamber: | 1.85 mm |
| Opening diameter of discharging holes: | 8.0 μm |
| Drying temperature (nitrogen): | 40° C. |
| Driving frequency: | 340 kHz |
| Voltage applied to piezoelectric material: | 10.0 V |

The resultant toner base particles were processed in the same manner as in Example 1 to obtain the Comparative toner 2.

Composition of components constituting the toner base particles of the [Comparative toner 2] is presented in Table 3.

Physical properties of the [Comparative toner 2] were determined by the above-described measurement methods in the same manner as in Example 1. Results are presented in Table 4.

An image forming apparatus containing a [Comparative developer 2] which includes the [Comparative toner 2] was used to evaluate a cold-offset property, a hot-offset property, charging stability, background fog, and image stability in the same manner as in Example 1. Results are presented in Table 5.

Comparative Example 3

A [Comparative toner 3] was obtained in the same manner as in Example 1, except that preparation of a toner composition liquid and production of toner base particles were performed in the following manner.

—Preparation of Toner Composition Liquid—

A [WAX 8] (10 parts) serving as a release agent and a [Polyester Resin A] (273.3 parts) serving as a binder resin were mixed together and dissolved in ethyl acetate (676.7 parts) at 70° C. using a mixer equipped with a stirring blade. The [WAX 8] and the [Polyester resin A] were dissolved in the ethyl acetate without phase separation to obtain a transparent solution. After that, a temperature of the transparent solution was adjusted to 55° C. The carbon black dispersion liquid (100 parts) was mixed with the solution and stirred for 10 min to prepare a toner composition liquid. Note that, the [WAX 8] was a synthetic ester wax including, as a main component, an aliphatic ester and having a melting point of 82° C. and a recrystallization temperature of 70° C. (WEP-5, available from NOF Corporation).

—Production of Toner Base Particles—

Liquid droplets of the resultant toner composition liquid were discharged using the same producing apparatus as in Example 1 in the same manner as in Example 1, except that liquid-droplet discharging conditions were changed as described below. After the liquid droplets were discharged, the liquid droplets were dried and solidified by a liquid-droplet solidifying means using dry nitrogen, collected with a cyclon, and then dried with air blowing for 48 hours at 35° C./90% RH, for 24 hours at 40° C./50% RH, and for 24 hours at 50° C./50% RH. Thus, toner base particles were produced.

Note that, the toner composition liquid and members of the toner producing apparatus configured to contact with the toner composition liquid were controlled to a temperature of 55° C. The toner was continuously produced for 6 hours, but discharging holes were not clogged.

[Conditions of Producing Apparatus]

| Longitudinal length L of liquid-column resonance | |
|---|---|
| liquid-chamber: | 1.85 mm |
| Opening diameter of discharging holes: | 8.0 μm |
| Drying temperature (nitrogen): | 55° C. |
| Driving frequency: | 340 kHz |
| Voltage applied to piezoelectric material: | 10.0 V |

The resultant toner base particles were processed in the same manner as in Example 1 to obtain the Comparative toner 3.

Composition of components constituting the toner base particles of the [Comparative toner 3] is presented in Table 3.

Physical properties of the [Comparative toner 3] were determined by the above-described measurement methods in the same manner as in Example 1. Results are presented in Table 4.

An image forming apparatus containing a [Comparative developer 3] which includes the [Comparative toner 3] was used to evaluate a cold-offset property, a hot-offset property, charging stability, background fog, and image stability in the same manner as in Example 1. Results are presented in Table 5.

Comparative Example 4

A [Comparative toner 4] was obtained in the same manner as in Example 1, except that preparation of a toner composition liquid and production of toner base particles were performed in the following manner.

—Preparation of Toner Composition Liquid—

A [WAX 9] (10 parts) serving as a release agent and a [Polyester Resin A] (273.3 parts) serving as a binder resin were mixed together and dissolved in ethyl acetate (676.7 parts) at 70° C. using a mixer equipped with a stirring blade. The [WAX 9] and the [Polyester resin A] were dissolved in the ethyl acetate without phase separation to obtain a transparent solution. After that, a temperature of the transparent solution was adjusted to 55° C. The carbon black dispersion liquid (100 parts) was mixed with the solution and stirred for 10 min to prepare a toner composition liquid. Note that, the [WAX 9] was a paraffin wax having a melting point of 68° C. and a recrystallization temperature of 60° C. (HNP-11, available from NIPPON SEIRO CO., LTD.).

—Production of Toner Base Particles—

Liquid droplets of the resultant toner composition liquid were discharged using the same producing apparatus as in Example 1 in the same manner as in Example 1, except that liquid-droplet discharging conditions were changed as described below. After the liquid droplets were discharged, the liquid droplets were dried and solidified by a liquid-droplet solidifying means using dry nitrogen, collected with a cyclon, and then dried with air blowing for 48 hours at 35° C./90% RH, for 24 hours at 40° C./50% RH, and for 24 hours at 50° C./50% RH. Thus, toner base particles were produced.

Note that, the toner composition liquid and members of the toner producing apparatus configured to contact with the toner composition liquid were controlled to a temperature of 55° C. The toner was continuously produced for 6 hours, but discharging holes were not clogged.

[Conditions of Producing Apparatus]

| Longitudinal length L of liquid-column resonance | |
|---|---|
| liquid-chamber: | 1.85 mm |
| Opening diameter of discharging holes: | 8.0 μm |
| Drying temperature (nitrogen): | 55° C. |
| Driving frequency: | 340 kHz |
| Voltage applied to piezoelectric material: | 10.0 V |

The resultant toner base particles were processed in the same manner as in Example 1 to obtain the Comparative toner 4.

Composition of components constituting the toner base particles of the [Comparative toner 4] is presented in Table 3.

Physical properties of the [Comparative toner 4] were determined by the above-described measurement methods in the same manner as in Example 1. Results are presented in Table 4.

An image forming apparatus containing a [Comparative developer 4] which includes the [Comparative toner 4] was used to evaluate a cold-offset property, a hot-offset property, charging stability, background fog, and image stability in the same manner as in Example 1. Results are presented in Table 5.

Comparative Example 5

A [Comparative toner 5] was obtained in the same manner as in Example 1, except that preparation of a toner composition liquid and production of toner base particles were performed in the following manner.

—Preparation of Toner Composition Liquid—

A [WAX 7] (10 parts) serving as a release agent and a [Polyester Resin A] (273.3 parts) serving as a binder resin were mixed together and dissolved in ethyl acetate (676.7 parts) at 70° C. using a mixer equipped with a stirring blade. The [WAX 7] and the [Polyester resin A] were dissolved in the ethyl acetate without phase separation to obtain a transparent solution. After that, a temperature of the transparent solution was adjusted to 55° C. The carbon black dispersion liquid (100 parts) was mixed with the solution and stirred for 10 min to prepare a toner composition liquid. Note that, the [WAX 7] was as described above.

—Production of Toner Base Particles—

Liquid droplets of the resultant toner composition liquid were discharged using the same producing apparatus as in Example 1 in the same manner as in Example 1, except that liquid-droplet discharging conditions were changed as described below. After the liquid droplets were discharged, the liquid droplets were dried and solidified by a liquid-droplet solidifying means using dry nitrogen, collected with a cyclon, and then dried with air blowing for 48 hours at 35° C./90% RH, for 24 hours at 40° C./50% RH, and for 24 hours at 50° C./50% RH. Thus, toner base particles were produced.

Note that, the toner composition liquid and members of the toner producing apparatus configured to contact with the toner composition liquid were controlled to a temperature of 50° C. The toner was continuously produced for 6 hours, but discharging holes were not clogged.

[Conditions of Producing Apparatus]

| Longitudinal length L of liquid-column resonance | |
|---|---|
| liquid-chamber: | 1.85 mm |
| Opening diameter of discharging holes: | 8.0 μm |
| Drying temperature (nitrogen): | 35° C. |
| Driving frequency: | 340 kHz |
| Voltage applied to piezoelectric material: | 10.0 V |

The resultant toner base particles were processed in the same manner as in Example 1 to obtain the Comparative toner 5.

Composition of components constituting the toner base particles of the [Comparative toner 5] is presented in Table 3.

Physical properties of the [Comparative toner 5] were determined by the above-described measurement methods in the same manner as in Example 1. Results are presented in Table 4.

An image forming apparatus containing a [Comparative developer 5] which includes the [Comparative toner 5] was used to evaluate a cold-offset property, a hot-offset property, charging stability, background fog, and image stability in the same manner as in Example 1. Results are presented in Table 5.

Comparative Example 6

A [Comparative toner 6] was obtained in the same manner as in Example 1, except that preparation of a toner composition liquid and production of toner base particles were performed in the following manner.

—Preparation of Toner Composition Liquid—

A [WAX 7] (10 parts) serving as a release agent and a [Polyester Resin A] (273.3 parts) serving as a binder resin were mixed together and dissolved in ethyl acetate (676.7 parts) at 70° C. using a mixer equipped with a stirring blade. The [WAX 7] and the [Polyester resin A] were dissolved in the ethyl acetate without phase separation to obtain a transparent solution. After that, a temperature of the transparent solution was adjusted to 55° C. The carbon black dispersion liquid (100 parts) was mixed with the solution and stirred for 10 min to prepare a toner composition liquid.

—Production of Toner Base Particles—

Liquid droplets of the resultant toner composition liquid were discharged using the same producing apparatus as in Example 1 in the same manner as in Example 1, except that liquid-droplet discharging conditions were changed as described below. After the liquid droplets were discharged, the liquid droplets were dried and solidified by a liquid-droplet solidifying means using dry nitrogen, collected with a cyclon, and then dried with air blowing for 48 hours at 35° C./90% RH, for 24 hours at 40° C./50% RH, and for 24 hours at 50° C./50% RH. Thus, toner base particles were produced.

Note that, the toner composition liquid and members of the toner producing apparatus configured to contact with the toner composition liquid were controlled to a temperature of 35° C. The toner was continuously produced for 6 hours, but discharging holes were not clogged.

[Conditions of Producing Apparatus]

| Longitudinal length L of liquid-column resonance | |
|---|---|
| liquid-chamber: | 1.85 mm |
| Opening diameter of discharging holes: | 8.0 μm |
| Drying temperature (nitrogen): | 50° C. |

-continued

| Longitudinal length L of liquid-column resonance | |
|---|---|
| Driving frequency: | 340 kHz |
| Voltage applied to piezoelectric material: | 10.0 V |

The resultant toner base particles were processed in the same manner as in Example 1 to obtain the Comparative toner 6.

Composition of components constituting the toner base particles of the [Comparative toner 6] is presented in Table 3.

Physical properties of the [Comparative toner 6] were determined by the above-described measurement methods in the same manner as in Example 1. Results are presented in Table 4.

An image forming apparatus containing a [Comparative developer 6] which includes the [Comparative toner 6] was used to evaluate a cold-offset property, a hot-offset property, charging stability, background fog, and image stability in the same manner as in Example 1. Results are presented in Table 5.

Comparative Example 7

A [Comparative toner 7] was obtained in the same manner as in Example 1, except that preparation of a toner composition liquid and production of toner base particles were performed in the following manner.

—Preparation of Toner Composition Liquid—

A [WAX 7] (1 part) serving as a release agent and a [Polyester Resin A] (273.3 parts) serving as a binder resin were mixed together and dissolved in ethyl acetate (676.7 parts) at 70° C. using a mixer equipped with a stirring blade. The [WAX 7] and the [Polyester resin A] were dissolved in the ethyl acetate without phase separation to obtain a transparent solution. After that, a temperature of the transparent solution was adjusted to 55° C. The carbon black dispersion liquid (100 parts) was mixed with the solution and stirred for 10 min to prepare a toner composition liquid.

—Production of Toner Base Particles—

Liquid droplets of the resultant toner composition liquid were discharged using the same producing apparatus as in Example 1 in the same manner as in Example 1, except that liquid-droplet discharging conditions were changed as described below. After the liquid droplets were discharged, the liquid droplets were dried and solidified by a liquid-droplet solidifying means using dry nitrogen, collected with a cyclon, and then dried with air blowing for 48 hours at 35° C./90% RH, for 24 hours at 40° C./50% RH, and for 24 hours at 50° C./50% RH. Thus, toner base particles were produced.

Note that, the toner composition liquid and members of the toner producing apparatus configured to contact with the toner composition liquid were controlled to a temperature of 55° C. The toner was continuously produced for 6 hours, but discharging holes were not clogged.

[Conditions of Producing Apparatus]

| Longitudinal length L of liquid-column resonance | |
|---|---|
| liquid-chamber: | 1.85 mm |
| Opening diameter of discharging holes: | 8.0 μm |
| Drying temperature (nitrogen): | 60° C. |

-continued

| Longitudinal length L of liquid-column resonance | |
|---|---|
| Driving frequency: | 340 kHz |
| Voltage applied to piezoelectric material: | 10.0 V |

The resultant toner base particles were processed in the same manner as in Example 1 to obtain the Comparative toner 7.

Composition of components constituting the toner base particles of the [Comparative toner 7] is presented in Table 3.

Physical properties of the [Comparative toner 7] were determined by the above-described measurement methods in the same manner as in Example 1. Results are presented in Table 4.

An image forming apparatus containing a [Comparative developer 7] which includes the [Comparative toner 7] was used to evaluate a cold-offset property, a hot-offset property, charging stability, background fog, and image stability in the same manner as in Example 1. Results are presented in Table 5.

Comparative Example 8

A [Comparative toner 8] was obtained in the same manner as in Example 1, except that preparation of a toner composition liquid and production of toner base particles were performed in the following manner.

—Preparation of Toner Composition Liquid—

A [WAX 7] (35 parts) serving as a release agent and a [Polyester Resin A] (273.3 parts) serving as a binder resin were mixed together and dissolved in ethyl acetate (676.7 parts) at 70° C. using a mixer equipped with a stirring blade. The [WAX 7] and the [Polyester resin A] were dissolved in the ethyl acetate without phase separation to obtain a transparent solution. After that, a temperature of the transparent solution was adjusted to 55° C. The carbon black dispersion liquid (100 parts) was mixed with the solution and stirred for 10 min to prepare a toner composition liquid.

—Production of Toner Base Particles—

Liquid droplets of the resultant toner composition liquid were discharged using the same producing apparatus as in Example 1 in the same manner as in Example 1, except that liquid-droplet discharging conditions were changed as described below. After the liquid droplets were discharged, the liquid droplets were dried and solidified by a liquid-droplet solidifying means using dry nitrogen, collected with a cyclon, and then dried with air blowing for 48 hours at 35° C./90% RH, for 24 hours at 40° C./50% RH, and for 24 hours at 50° C./50% RH. Thus, toner base particles were produced.

Note that, the toner composition liquid and members of the toner producing apparatus configured to contact with the toner composition liquid were controlled to a temperature of 55° C. The toner was continuously produced for 6 hours, but discharging holes were not clogged.

[Conditions of Producing Apparatus]

| Longitudinal length L of liquid-column resonance | |
|---|---|
| liquid-chamber: | 1.85 mm |
| Opening diameter of discharging holes: | 8.0 μm |
| Drying temperature (nitrogen): | 60° C. |

-continued

| Longitudinal length L of liquid-column resonance | |
|---|---|
| Driving frequency: | 340 kHz |
| Voltage applied to piezoelectric material: | 10.0 V |

The resultant toner base particles were processed in the same manner as in Example 1 to obtain the Comparative toner 8.

Composition of components constituting the toner base particles of the [Comparative toner 8] is presented in Table 3.

Physical properties of the [Comparative toner 8] were determined by the above-described measurement methods in the same manner as in Example 1. Results are presented in Table 4.

An image forming apparatus containing a [Comparative developer 8] which includes the [Comparative toner 8] was used to evaluate a cold-offset property, a hot-offset property, charging stability, background fog, and image stability in the same manner as in Example 1. Results are presented in Table 5.

TABLE 3

| | | Release agent | | | Solubility at 45° C. | |
|---|---|---|---|---|---|---|
| | | Kind | Melting point (° C.) | Recrystallization temperature (° C.) | (g/100 g ethyl acetate) | Binder resin |
| Ex. 1 | Toner 1 | WAX 1 | 62.6 | 52.7 | 70.4 | Polyester A |
| Ex. 2 | Toner 2 | WAX 2 | 53 | 46 | 358.1 | Polyester A |
| Ex. 3 | Toner 3 | WAX 2 | 53 | 46 | 358.1 | Polyester A |
| Ex. 4 | Toner 4 | WAX 2 | 53 | 46 | 358.1 | Polyester A |
| Ex. 5 | Toner 5 | WAX 3 | 68.9 | 61.2 | 10.4 | Polyester A |
| Ex. 6 | Toner 6 | WAX 4 | 64.6 | 57 | 21.2 | Polyester B |
| Ex. 7 | Toner 7 | WAX 4 | 64.6 | 57 | 21.2 | Polyester B + Styrene acryl A |
| Ex. 8 | Toner 8 | WAX 7 | 55.2 | 48 | 205 | Polyester A |
| Ex. 9 | Toner 9 | WAX 7 | 55.2 | 48 | 205 | Polyester A |
| Ex. 10 | Toner 10 | WAX 7 | 55.2 | 48 | 205 | Polyester A |
| Ex. 11 | Toner 11 | WAX 7 | 55.2 | 48 | 205 | Polyester A |
| Ex. 12 | Toner 12 | WAX 7 | 55.2 | 48 | 205 | Polyester A |
| Comp. Ex. 1 | Comparative toner 1 | WAX 5 | 75.2 | 64.3 | 0.4 | Polyester B |
| Comp. Ex. 2 | Comparative toner 2 | WAX 6 | 71.7 | 64.5 | 0.7 | Polyester B |
| Comp. Ex. 3 | Comparative toner 3 | WAX 8 | 82 | 70 | 0 | Polyester A |
| Comp. Ex. 4 | Comparative toner 4 | WAX 9 | 68 | 60 | 0 | Polyester A |
| Comp. Ex. 5 | Comparative toner 5 | WAX 7 | 55.2 | 48 | 205 | Polyester A |
| Comp. Ex. 6 | Comparative toner 6 | WAX 7 | 55.2 | 48 | 205 | Polyester A |
| Comp. Ex. 7 | Comparative toner 7 | WAX 7 | 55.2 | 48 | 205 | Polyester A |
| Comp. Ex. 8 | Comparative toner 8 | WAX 7 | 55.2 | 48 | 205 | Polyester A |

TABLE 4

| | | Volume average particle diamter Dv (μm) | Particle size distribution Dv/Dn | Most frequent diameter (μm) | Second peak (μm) | Amount of release agent (% by mass) | Amount of release agent from surface of toner to depth of 0.3 μm (% by mass) | WDa (μm) | WDb (μm) | WDc (μm) | WDc/WDa |
|---|---|---|---|---|---|---|---|---|---|---|---|
| Ex. 1 | Toner 1 | 5.5 | 1.11 | 4.2 | 6.2 | 3.2 | 1.1 | 0.12 | 0.15 | 0.21 | 1.75 |
| Ex. 2 | Toner 2 | 5.7 | 1.12 | 4.9 | 6.3 | 3.1 | 2.5 | 0.23 | 0.59 | 0.85 | 3.70 |
| Ex. 3 | Toner 3 | 5.4 | 1.11 | 4.8 | 5.8 | 3.1 | 3.4 | 0.33 | 0.66 | 1.35 | 4.09 |
| Ex. 4 | Toner 4 | 5.3 | 1.1 | 5 | 6.2 | 3.2 | 0.2 | 0.16 | 0.29 | 0.52 | 3.25 |
| Ex. 5 | Toner 5 | 5.5 | 1.09 | 4.9 | 6.3 | 3.2 | 4 | 0.37 | 0.39 | 0.4 | 1.08 |
| Ex. 6 | Toner 6 | 5.7 | 1.14 | 5 | 6.5 | 3.0 | 2.4 | 0.11 | 0.12 | 0.13 | 1.18 |
| Ex. 7 | Toner 7 | 5.9 | 1.17 | 5 | 6.3 | 3.1 | 3.1 | 0.12 | 0.15 | 0.19 | 1.58 |
| Ex. 8 | Toner 8 | 5.5 | 1.12 | 5 | 6.4 | 3.0 | 2.8 | 0.24 | 0.54 | 0.88 | 3.67 |
| Ex. 9 | Toner 9 | 5.6 | 1.13 | 5 | 6.3 | 1.0 | 0.3 | 0.17 | 0.23 | 0.33 | 1.94 |
| Ex. 10 | Toner 10 | 5.5 | 1.11 | 4.9 | 6.3 | 8.0 | 3.2 | 0.66 | 0.85 | 0.88 | 1.33 |
| Ex. 11 | Toner 11 | 5.4 | 1.28 | 5.3 | 6.5 | 3.1 | 3.8 | 0.12 | 0.13 | 0.15 | 1.25 |
| Ex. 12 | Toner 12 | 5.4 | 1.31 | 5.2 | 6.4 | 3.1 | 3.9 | 0.16 | 0.18 | 0.19 | 1.19 |
| Comp. Ex. 1 | Comparative toner 1 | 5.4 | 1.09 | 5 | 6.1 | 3.0 | 4.5 | 0.45 | 0.45 | 0.44 | 0.98 |

TABLE 4-continued

| | | Volume average particle diamter Dv (μm) | Particle size distribution Dv/Dn | Most frequent diameter (μm) | Second peak (μm) | Amount of release agent (% by mass) | Amount of release agent from surface of toner to depth of 0.3 μm (% by mass) | WDa (μm) | WDb (μm) | WDc (μm) | WDc/WDa |
|---|---|---|---|---|---|---|---|---|---|---|---|
| Comp. Ex. 2 | Comparative toner 2 | 5.6 | 1.1 | 4.9 | 6.2 | 3.0 | 4.2 | 0.42 | 0.42 | 0.42 | 1.00 |
| Comp. Ex. 3 | Comparative toner 3 | 5.6 | 1.11 | 4.8 | 6.2 | 3.1 | 4.6 | 0.44 | 0.45 | 0.44 | 1.00 |
| Comp. Ex. 4 | Comparative toner 4 | 5.5 | 1.12 | 4.9 | 6.2 | 3.0 | 4.5 | 0.41 | 0.4 | 0.41 | 1.00 |
| Comp. Ex. 5 | Comparative toner 5 | 5.4 | 1.35 | 5.2 | 6.4 | 3.0 | 3.5 | 0.26 | 0.22 | 0.35 | 1.35 |
| Comp. Ex. 6 | Comparative toner 6 | 5.5 | 1.32 | 5.3 | 6.4 | 3.0 | 3.2 | 0.14 | 0.14 | 0.18 | 1.29 |
| Comp. Ex. 7 | Comparative toner 7 | 5.5 | 1.13 | 5.0 | 6.2 | 0.5 | 0.05 | 0.10 | 0.11 | 0.11 | 1.10 |
| Comp. Ex. 8 | Comparative toner 8 | 5.6 | 1.15 | 5.0 | 6.2 | 9.0 | 3.0 | 0.25 | 0.28 | 0.42 | 1.68 |

TABLE 5

| | | Two-component developing | | | | | One-component developing | | | | | |
|---|---|---|---|---|---|---|---|---|---|---|---|---|
| | | Cold-offset property | Hot-offset property | Charging stability | Background fog | Image stability | Cold-offset property | Hot-offset property | Adherence resistance | Background fog | Image stability | Score in comprehensive evaluation |
| Ex. 1 | Toner 1 | A | B | C | B | C | A | B | C | B | B | 19 |
| Ex. 2 | Toner 2 | A | B | A | B | B | A | B | A | A | A | 26 |
| Ex. 3 | Toner 3 | B | B | A | B | B | B | B | A | B | B | 22 |
| Ex. 4 | Toner 4 | A | B | A | B | B | B | B | A | A | B | 24 |
| Ex. 5 | Toner 5 | A | B | C | C | C | A | B | C | C | C | 16 |
| Ex. 6 | Toner 6 | B | B | A | B | B | B | B | B | B | C | 20 |
| Ex. 7 | Toner 7 | B | B | B | B | B | B | B | B | C | B | 19 |
| Ex. 8 | Toner 8 | A | B | A | A | A | A | B | A | A | A | 28 |
| Ex. 9 | Toner 9 | B | B | A | B | B | B | B | A | B | B | 22 |
| Ex. 10 | Toner 10 | A | B | A | C | B | A | B | C | C | B | 20 |
| Ex. 11 | Toner 11 | A | B | C | C | C | A | B | B | C | C | 17 |
| Ex. 12 | Toner 12 | A | B | C | C | C | A | B | B | C | C | 17 |
| Comp. Ex. I | Comparative toner I | C | B | C | D | B | C | B | D | D | C | 10 |
| Comp. Ex. 2 | Comparative toner 2 | C | D | C | D | C | C | D | C | C | C | 7 |
| Comp. Ex. 3 | Comparative toner 3 | C | D | C | C | B | C | D | B | C | B | 11 |
| Comp. Ex. 4 | Comparative toner 4 | C | D | C | C | B | C | D | B | C | B | 11 |
| Comp. Ex. 5 | Comparative toner 5 | B | D | B | C | C | B | D | B | C | C | 12 |
| Comp. Ex. 6 | Comparative toner 6 | B | D | C | C | C | B | D | C | C | C | 10 |
| Comp. Ex. 7 | Comparative toner 7 | B | D | C | C | C | B | D | B | C | C | 11 |
| Comp. Ex. 8 | Comparative toner 8 | B | D | C | C | C | B | D | B | C | C | 11 |

Aspects of the present invention are, for example, as follows.

<1> A toner including:

a binder resin; and a release agent, wherein an amount of the release agent included in the toner is from 1% by mass through 8% by mass relative to an amount of the toner, as expressed as an equivalent mass of an endothermic amount of the release agent determined by differential scanning calorimetry (DSC), wherein an amount of the release agent that is present in a region from a surface of the toner to a depth of 0.3 μm is from 0.1% by mass through 4% by mass, as determined by attenuated total reflection Fourier transform infrared spectroscopy (FTIR-ATR), and wherein, in an image of a torn surface of the toner, the image being taken by a transmission electron microscope (TEM), a relationship below is satisfied:

$$WDa < WDb < WDc$$

where

WDa denotes a number average particle diameter of the release agent present in a region Aa that is a region from a surface of the toner to a depth that is one-sixth of a diameter d of the toner (⅙d), WDc denotes a number average particle diameter of the release agent present in a central region Ac that is a circular region having a center located at a center of the toner and a radius of ⅙d, and WDb denotes a number average particle diameter of the release agent present in a region Ab that is a region other than the region Aa or the region Ac.

<2> The toner according to <1>, wherein a solubility of the release agent is 20 g or more relative to 100 g of ethyl acetate of 45° C.

<3> The toner according to <1> or <2>, wherein the solubility of the release agent is 200 g or more relative to 100 g of ethyl acetate of 45° C.

<4> The toner according to any one of <1> to <3>, wherein a melting point of the release agent is 60° C. or less.

<5> The toner according to any one of <1> to <4>, wherein the number average particle diameter WDa of the release agent is from 0.15 μm through 0.35 μm.

<6> The toner according to any one of <1> to <5>, wherein the number average particle diameter WDb of the release agent is from 0.50 μm through 0.60 μm.

<7> The toner according to any one of <1> to <6>, wherein the number average particle diameter WDc of the release agent is from 0.60 μm through 1.00 μm.

<8> The toner according to any one of <1> to <7>, wherein a ratio of the number average particle diameter WDc to the number average particle diameter WDa (WDc/WDa) of the release agent is from 3.5 through 4.0.

<9> The toner according to any one of <1> to <8>, wherein the toner has a second most frequent (by number) peak within a range of from 1.21 times through 1.31 times as large as a most frequent (by number) number particle diameter (a most frequent diameter) in a distribution plot of number particle diameter of the toner versus frequency (by number) of the toner.

<10> A method for producing the toner according to any one of <1> to <9>, the method including:

discharging a toner composition liquid, in which at least the binder resin and the release agent are dissolved or dispersed in an organic solvent, to form liquid droplets; and solidifying the liquid droplets to form toner particles.

DESCRIPTION OF THE REFERENCE NUMERAL

1: toner producing apparatus
2: liquid-droplet discharging means
9: elastic plate
10: liquid-column resonance liquid-droplet discharging unit
11: liquid-column resonance liquid-droplet discharging means
12: gas stream path
13: raw material container
14: toner composition liquid
15: liquid circulating pump
16: liquid supplying pipe
17: common liquid supplying-path
18: liquid-column resonance path
19: discharging holes
20: vibration generating means
21: liquid droplets
22: liquid returning pipe
24: nozzle angle
30: exposure device
40: developing device
41: thin film
50: intermediate transfer member
51: roller
58: corona charger
60: drying/collecting means
61: chamber
62: toner collecting means
63: toner storing portion
64: conveying-gas-stream inlet-port
65: conveying-gas-stream outlet-port
70: charge-eliminating lamp
80: transfer roller
90: cleaning device
95: transfer paper
100: photoconductor drum
100A: color image forming apparatus
101: descending gas stream
110: process cartridge
200: charging roller
410: developing belt
600: cleaning device
P1: pressure gauge for liquid
P2: pressure gauge for chamber

The invention claimed is:

1. A toner comprising:

a binder resin; and a release agent, wherein an amount of the release agent included in the toner is from 1% by mass through 8% by mass relative to an amount of the toner, as expressed as an equivalent mass of an endothermic amount of the release agent determined by differential scanning calorimetry (DSC), wherein an amount of the release agent that is present in a region from a surface of the toner to a depth of 0.3 μm is from 0.1% by mass through 3.4% by mass, as determined by attenuated total reflection Fourier transform infrared spectroscopy (FTIR-ATR), and wherein, in an image of a torn surface of the toner, the image being taken by a transmission electron microscope (TEM), a relationship below is satisfied:

$$WDa < WDb < WDc$$

where

WDa denotes a number average particle diameter of the release agent present in a region Aa that is a region from a surface of the toner to a depth that is one-sixth of a diameter d of the toner (⅙d), WDc denotes a number average particle diameter of the release agent present in a central region Ac that is a circular region having a center located at a center of the toner and a radius of ⅙d, and WDb denotes a number average particle diameter of the release agent present in a region Ab that is a region other than the region Aa or the region Ac.

2. The toner according to claim 1, wherein a solubility of the release agent is 20 g or more relative to 100 g of ethyl acetate of 45° C.

3. The toner according to claim 1, wherein the solubility of the release agent is 200 g or more relative to 100 g of ethyl acetate of 45° C.

4. The toner according to claim 1, wherein a melting point of the release agent is 60° C. or less.

5. The toner according to claim 1, wherein the number average particle diameter WDa of the release agent is from 0.15 μm through 0.35 μm.

6. The toner according to claim 1, wherein the number average particle diameter WDb of the release agent is from 0.50 μm through 0.60 μm.

7. The toner according to claim 1, wherein the number average particle diameter WDc of the release agent is from 0.60 μm through 1.00 μm.

8. The toner according to claim 1, wherein a ratio of the number average particle diameter WDc to the number average particle diameter WDa (WDc/WDa) of the release agent is from 3.5 through 4.0.

9. The toner according to claim 1, wherein the toner has a second most frequent (by number) peak within a range of from 1.21 times through 1.31 times as large as a most frequent (by number) number particle diameter (a most frequent diameter) in a distribution plot of number particle diameter of the toner versus frequency (by number) of the toner.

10. A method for producing the toner according to claim 1, the method comprising:

discharging a toner composition liquid, in which at least the binder resin and the release agent are dissolved or dispersed in an organic solvent, to form liquid droplets; and solidifying the liquid droplets to form toner particles.

* * * * *